US006300024B1

(12) United States Patent
Yusa et al.

(10) Patent No.: US 6,300,024 B1
(45) Date of Patent: Oct. 9, 2001

(54) TONER, TWO-COMPONENT TYPE DEVELOPER, HEAT FIXING METHOD, IMAGE FORMING METHOD AND APPARATUS UNIT

(75) Inventors: Hiroshi Yusa, Machida; Satoshi Yoshida, Tokyo; Takashige Kasuya; Yuki Karaki, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/605,755

(22) Filed: Jun. 28, 2000

(30) Foreign Application Priority Data

Jun. 30, 1999 (JP) ..... 11-186712

(51) Int. Cl.[7] ..... G03G 13/01

(52) U.S. Cl. ..... 430/45; 430/111; 430/124; 430/126; 399/321

(58) Field of Search ..... 430/45, 111, 124; 399/321

(56) References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 3,681,106 | 8/1972 | Burns et al. | 117/17.5 |
| 4,071,361 | 1/1978 | Marushima | 96/1.4 |
| 4,386,147 | 5/1983 | Seimiya et al. | 430/99 |
| 4,387,211 | 6/1983 | Yasuda et al. | 528/179 |
| 4,514,487 | 4/1985 | Kasuya et al. | 430/137 |
| 4,533,614 | 8/1985 | Fukumoto et al. | 430/99 |
| 4,657,837 | 4/1987 | Morita et al. | 430/109 |
| 4,810,612 | 3/1989 | Ueda et al. | 430/109 |
| 4,851,960 | 7/1989 | Nakamura et al. | 361/225 |
| 4,863,824 | 9/1989 | Uchida et al. | 430/109 |
| 4,883,736 | 11/1989 | Hoffend et al. | 430/110 |
| 4,917,983 | 4/1990 | Uchida et al. | 430/109 |
| 4,921,771 | 5/1990 | Tomono et al. | 430/110 |
| 5,180,649 | 1/1993 | Kukimoto et al. | 430/106.6 |
| 5,547,800 | 8/1996 | Nishimori et al. | 430/110 |
| 5,707,771 * | 1/1998 | Matsunaga | 430/110 |
| 5,753,399 | 5/1998 | Hayase et al. | 430/109 |
| 5,817,443 | 10/1998 | Matsushima et al. | 430/109 |
| 5,840,457 | 11/1998 | Urawa et al. | 430/45 |
| 6,040,104 * | 3/2000 | Nakamura et al. | 430/111 |

FOREIGN PATENT DOCUMENTS

| | | |
|---|---|---|
| 0 662 640 | 7/1995 | (EP) . |
| 0 686 883 | 12/1995 | (EP) . |
| 47-12334 | 6/1972 | (JP) . |
| 50-44836 | 4/1975 | (JP) . |
| 50-75043 | 6/1975 | (JP) . |
| 50-134652 | 10/1975 | (JP) . |
| 52-3305 | 1/1977 | (JP) . |
| 56-87051 | 7/1981 | (JP) . |
| 56-98202 | 8/1981 | (JP) . |
| 57-37353 | 3/1982 | (JP) . |
| 57-190825 | 7/1982 | (JP) . |
| 57-208559 | 12/1982 | (JP) . |
| 59-7960 | 1/1984 | (JP) . |
| 59-29256 | 2/1984 | (JP) . |
| 60-214368 | 10/1985 | (JP) . |
| 61-138259 | 6/1986 | (JP) . |
| 61-213858 | 9/1986 | (JP) . |
| 62-78568 | 4/1987 | (JP) . |
| 62-78569 | 4/1987 | (JP) . |
| 63-113558 | 5/1988 | (JP) . |
| 63-149669 | 6/1988 | (JP) . |
| 63-188158 | 8/1988 | (JP) . |
| 63-225244 | 9/1988 | (JP) . |
| 63-225245 | 9/1988 | (JP) . |
| 63-225246 | 9/1988 | (JP) . |
| 1-295269 | 11/1989 | (JP) . |
| 1-302267 | 12/1989 | (JP) . |
| 1-82267 | 3/1990 | (JP) . |
| 2-158747 | 6/1990 | (JP) . |
| 3-96964 | 4/1991 | (JP) . |
| 3-188468 | 8/1991 | (JP) . |
| 3-203746 | 9/1991 | (JP) . |
| 4-24648 | 1/1992 | (JP) . |
| 4-338973 | 11/1992 | (JP) . |
| 5-142963 | 6/1993 | (JP) . |
| 6-59502 | 3/1994 | (JP) . |
| 6-175395 | 6/1994 | (JP) . |
| 7-234537 | 9/1995 | (JP) . |
| 7-261459 | 10/1995 | (JP) . |
| 8-30036 | 2/1996 | (JP) . |
| 8-54750 | 2/1996 | (JP) . |
| 8-101530 | 4/1996 | (JP) . |
| 8-334930 | 12/1996 | (JP) . |
| 9-34163 | 2/1997 | (JP) . |
| 10-133422 | 5/1998 | (JP) . |

* cited by examiner

*Primary Examiner*—John Goodrow
(74) *Attorney, Agent, or Firm*—Fitzpatrick, Cella, Harper & Scinto

(57) ABSTRACT

A toner is principally constituted by a binder resin, a colorant and a wax. The toner has a maximum heat-absorption peak of 60–135° C. as measured by differential scanning calorimetry (DSC). The toner further has a vis-coelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6. The toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn). The resultant toner is effective in improving a low-temperature fixability and a high-temperature anti-offset characteristic while retaining an appropriate gloss of a fixed image in a broader temperature range.

166 Claims, 10 Drawing Sheets

TONER, TWO-COMPONENT TYPE DEVELOPER, HEAT FIXING METHOD, IMAGE FORMING METHOD AND APPARATUS UNIT

FIELD OF THE INVENTION AND RELATED ART

The present invention relates to a toner for use in a recording method, such as electrophotography, image forming method for visualizing electrostatic latent images and jet recording; a two-component type developer using the toner; a heat fixing method using the toner; an image forming method and an image forming apparatus unit using the toner.

Hitherto, a large number of electrophotographic processes have been known, inclusive of those disclosed in U.S. Pat. Nos. 2,297,691; 3,666,363; and 4,071,361. In these processes, in general, an electrical or electrostatic latent image is formed on a photosensitive member comprising a photoconductive material by various means, then the latent image is developed with a toner, and the resultant toner image is, after being transferred onto a recording or transfer (-receiving) material such as paper etc., as desired, fixed by heating and/or pressing to obtain a copy or print carrying a fixed toner image on the recording material. According to necessity, residual toner remaining on the photosensitive member without transfer is cleaned by various methods. The above steps are repeated for successive image formation.

For complying with varying market demands in recent years, such an image forming system or apparatus is severely required to be smaller in size and lighter in weight, and exhibit higher speed and higher reliability. The image forming apparatus has been used as not only an ordinary copying machine for office purpose for making a copy of an original but also a digital printer as a computer output equipment or that for making a copy of high-definition image for graphic design.

Further, with the popularization of computer equipment for personal users, full-color image communication has extensively begun to spread as an information transmission mechanism through images.

In such circumstances, even with respect to a printer or copying machine as one of output equipment, a full-color printer or copying machine is quickly commercialized principally in a low-end (or grade) machine market. As a result, color images are becoming closer ones for personal users.

For this reason, full-color images are required to provide high definition and high image qualities, so that a toner used therefor is required to exhibit further higher performances.

One of important performances required of a toner for use in a digital full-color printer or a high-definition full-color copying machine is a fixing performance.

For a fixing step, various fixing methods and devices have been developed but a most ordinary one currently used is a heat-pressure fixing system using hot or heating rollers.

In the heat-pressure fixing system using the hot rollers, under pressure application, a fixation sheet carrying a toner image is caused to pass over and in contact with a heating roller surfaced with a material (e.g., silicone rubber or fluorine-containing resin) exhibiting a releasability to a toner thereby fixing the toner image onto the fixation sheet. In this fixation scheme, as the heating roller surface and the toner image on the fixation sheet contact with each other in a melting state under application of pressure, a very good heat efficiency is attained for melt-attaching the toner image onto the fixation sheet to afford quick fixation, thus being very effective in the case of a high-speed electrophotographic copying machine.

In the above scheme, however, due to the contact in a melting state under pressure application between the heating roller surface and the toner image, a part of the toner image is attached and transferred to the fixing roller surface, thus soiling a subsequent fixation sheet (offset phenomenon) in some cases. Accordingly, the prevention of toner attachment onto the heating (fixing) roller surface is one of essential requirements for the heat-pressure fixing system.

In the case of full-color image formation, color reproduction is performed by using four toners including a black toner in addition to the three toners of yellow, magenta and cyan as primary colors for colorant. The resultant multicolor toner image is fixed onto paper or a transparency film or sheet for an overhead projector (OHP) (hereinafter, such an sheet is referred to as "OHT sheet"), thus being required to satisfy color reproducibility and/or transmission properties.

For this reason, the toner layer is required to be sufficiently melted to provide a smooth image surface. In order to prevent the offset phenomenon, it has been principally practiced to uniformly coat the fixing roller surface with an oil such as silicone oil. This method is very effective for the prevention of toner offset but requires a device for supplying the offset-preventing liquid, thus still involving a problem of requiring a complicated fixing device leading to an obstacle factors to design of a small-size and inexpensive system.

The OHT sheet (transparency film or sheet for the OHP) increased in its necessity for presentation purpose has a low oil-absorbing capability, different from the case of paper, thus involving a problem of a sticky surface of the OHT sheet. For this reason, a full-color toner allowing fixation with no or less oil application is greatly required.

A market demand on gloss of a full-color toner image is gradually changed. Specifically, a higher-gloss image is heretofore preferred but in recent years, a medium to lower-gloss image providing a natural moist feel of a material tends to become suitable in some case. Further, a stability of gloss against temperature change is also increasingly required. For instance, a smaller fixing device has a smaller heat capacitance, so that the temperature of a heating roller is lowered when a toner image to be fixed is caused to pass through the fixing device, thus causing a difference in heat quantity between a forward end and a rear end of the fixing image during the fixation thereby to cause a difference in gloss. Further, in the case where print of a large-size paper is performed immediately after continuous print of a small-size paper, a difference in temperature is caused to occur between a paper-passing portion and a non-paper-passing portion of the small-size paper, thus being liable to cause a similar phenomenon. This is particularly noticeable in the case of a full-color solid image to provide a sense of incongruity.

In order to solve the above-mentioned problems, various toners have been proposed.

Japanese Laid-Open Patent Application (JP-A) 6-59502 has disclosed a toner comprising a release agent and having a storage modulus G' at 150° C. at least $10^4$ dyn/cm$^2$, a loss modulus G" at 150° C. of at least $10^4$ dyn/cm$^2$, and an apparent viscosity of $0.1–5\times10^3$ Pa.sec. However, viscoelasticities of the toner are taken into consideration only at 150° C., thus being insufficient to improve a temperature stability of gloss and a low-temperature fixability of the toner in combination. When a toner having the above properties is actually tested, the resultant low-temperature fixability and fixable temperature range in which a good gloss-image is obtained are both insufficient.

JP-A 5-142963 has disclosed a toner having a storage modulus G' and a loss modulus G" both at 180° C. However, viscoelasticities of the toner are also taken into consideration only at 180° C., thus being insufficient to discuss the improvement in temperature stability of gloss and low-temperature fixability in combination.

JP-A 8-54750 has disclosed a toner satisfying a correlative formula between a volume-average particle size and a storage modulus G' at 170° C. but a viscoelasticity of the toner is similarly determined at a single point (170° C.), thus resulting in insufficient improvement in temperature stability of gloss and low-temperature fixability in combination.

JP-A 8-334930 has disclosed a toner comprising a polyester resin which has storage moduluses G' and tan δ at 130° C. measured at varying angular frequencies and contains a specific alcohol component. However, even if viscoelasticities of the polyester resin are prescribed, viscoelasticities of the resultant toner are largely changed depending upon a formulation and method for producing the toner. Accordingly, the viscoelasticities of the polyester resin is insufficient to improve both the temperature stability of gloss and low-temperature fixability of the toner at the same time. Indeed, even a toner using the above polyester resin fails to exhibit insufficient performances as to both of the temperature stability of gloss and low-temperature fixability of the toner in some cases.

JP-A 10-133422 has disclosed a toner comprising a vinyl resin having a specified molecular weight and having storage moduluses and loss moduluses at 160° C. and 180° C. The toner, however, fails to provide a sufficient low-temperature fixability and a wider fixable temperature range providing a good gloss-image.

JP-A 9-34163 has disclosed a toner comprising 5–40 wt. parts of a low-softening point substance per 100 wt. parts of a binder resin and having viscoelasticities including a ratio between storage moduluses at 60° C. and 80° C. (G'60/G'80) and a ratio between storage moduluses at 155° C. and 190° C. (G'155/G'190). However, the low-softening point substance contained in the toner is a component functioning so as to suppress an occurrence of high-temperature offset at the time of fixation. Such a component generally comprises a wax having a crystallinity, thus affecting color reproducibility and transmission properties on a projection image as to an OHT sheet. Accordingly, the toner is desired to decrease the content of the low-softening point substance and provide an anti-offset characteristic and a low-temperature fixability similar to those in the original content of the low-softening point substance and also stably provide an appropriate gloss value.

JP-A 6-175395 has disclosed a color toner comprising a styrene-acrylic resin and having storage moduluses G' at 90° C. and 150° C., thus improving a flatness of a toner image during fixation. However, the resultant image gloss is high and it is necessary to effect oil application to a fixing device.

For solving the above-mentioned problems, there is a method wherein a flowability in a melting state of a toner is suppressed by using a cross-linked binder resin. However, a larger cross-link degree of the binder resin leads to a lower quick-melting characteristic of the toner, thus being accompanied with a problem such that it is difficult to fix the toner image unless the heating roller temperature is high. For this reason, a toner allowing a low-temperature fixation and an image having a certain gloss value in a wide temperature region at the time of fixation is desired.

In order to provide a toner per se with a good fixability and anti-offset characteristic, methods wherein waxes are incorporated into toners have been disclosed in JP-A 52-3304, JP-A 52-3305, JP-A 57-52574, JP-A 61-138259, JP-A 56-87051, JP-A 63-188158, JP-A 63-113558 and JP-A 8-030036.

These waxes are used for improving the anti-offset characteristic and low-temperature fixability of the toner and many copying machines and printers are commercialized as electrophotographic apparatus realizing oil-less fixation.

However, these apparatus are insufficient to provide a resultant image with an appropriate gloss to realize color reproducibility and transmission properties on an OHT sheet when used as a high-quality full-color electrophotographic apparatus providing pictorial full-color images.

The waxes are liable to lower toner performances including anti-blocking characteristic, a developing characteristic when subjected to heat due to, e.g., temperature increase within an image-forming apparatus (such as a copying machine), and a developing characteristic when left standing for a long period due to blooming of the waxes.

The waxes are not readily dispersed in toner particles, so that a dissociated or localized portion of the waxes is liable to adversely affect developing performance, durability, etc. On the other hand, when the waxes are used in an amount not adversely affecting the above characteristics, the waxes fail to provide a sufficient releasability, thus requiring the use of another release agent such as an oil.

In order to realize a good fixability and anti-offset characteristic, JP-A 47-12334, JP-A 57-37353 and JP-A 57-208559 have proposed a toner comprising a polyester binder resin comprising a non-linear copolymer obtained from a monomer component or composition which comprises an etherified bisphenol monomer, a dicarboxylic acid monomer, and a polyfunctional alcohol monomer having at least 3 functional groups and/or a polyfunctional carboxylic acid monomer having at least 3 functional groups. More specifically, the polyester resin obtained through crosslinking of the polyester derived from the etherified bisphenol monomer and the dicarboxylic acid monomer with a lot of monomer components comprising the polyfunctional alcohol monomer and/or the polyfunctional carboxylic aid monomer is incorporated into toner particles as a binder resin, thus providing the toner with an offset-preventing performance. However, the resultant toner has a somewhat high softening point, so that it is difficult to effect a good low-temperature fixation. Further, when the toner is used in a full-color copying machine, the anti-high temperature offset characteristic of the toner is of a practically acceptable level but there are difficulties in fixability and sharp-melting characteristic as described above. As a result, a color-mixing characteristic and a color reproducibility based on superposition of respective color toners using the above polyester.

JP-A 57-109825, JP-A 62-78568, JP-A 62-78569, Japanese Patent Publication (JP-B) 63-57785 and JP-A 59-29256 have disclosed a toner comprising a polyester binder resin comprising a non-linear copolymer obtained from a monomer composition which comprises an etherified bisphenol monomer, a dicarboxylic acid monomer having a long-chain aliphatic hydrocarbon group or another dicarboxylic acid monomer, and a polyfunctional alcohol monomer having at least 3 functional groups and/or a polyfunctional carboxylic acid monomer having at least 3 functional groups and has a side chain comprising a saturated or unsaturated aliphatic hydrocarbon group having 3–22 carbon atoms. The polyester resin is principally directed to a toner for a high-speed copying machine. With respect to its viscoelasticities, utterly different from the above-mentioned polyester resins principally improving viscosity, an elasticity is enhanced to considerably suppress the high-temperature offset to the heating roller. At the time of fixation, a degree of application of pressure and heating to the heating roller is controlled as high as possible, whereby the toner is pressed and embedded into a spacing between fibrous portions of the transfer paper in a melted state to effect heat-pressure fixation, thus realizing a toner for high-speed copying.

For this reason, the formation of continuous film comprising melted toner layers required for color copying is little realized, thus failing to provide a smooth surface. The fixed toner is present at the surface of the transfer paper in a particulate form, so that the resultant color image becomes dark and dull color to have a poor saturation. At the surfaces of toner particles, incident light is scattered or diffused to little pass through the toner images on the OHT sheet. As a result, the OHT sheet carrying such toner images is practically unacceptable.

JP-B 55-6895 and JP-A 56-98202 have proposed a method wherein a binder resin is designed to have a broader molecular weight distribution range to prevent the offset phenomenon. According to this method, however, a degree of polymerization of the binder resin generally becomes higher, thus requiring a higher operational fixing temperature.

In order to prevent an occurrence of the offset phenomenon, various methods have been proposed.

JP-B 57-493, JP-A 50-44836 and JP-A 57-37353 have disclosed a method wherein a resin is made non-linear one or crosslinked to suppress the offset phenomenon. JP-A 61-213858, JP-A 1-295269, JP-A 1-30061, JP-A 1-302267 and JP-A 3-96964 have disclosed a method wherein the offset phenomenon is remedied by crosslinking a polyester resin with metal ion. JP-A 3-203746 and JP-A 4-24648 have proposed a method for improving the anti-offset characteristic of a toner by using a covalent crosslinked or branched resin (called crosslinked polymer) obtained by using a polyfunctional monomer or a polyfunctional initiator. JP-A 61-213858 and JP-A 6-175395 have proposed a toner using an ionic (electrovalent) crosslinked polymer comprising a metal oxide and a polymer chain strongly bonded to the metal oxide.

Although the above methods using the crosslinked polymers are effective in improving the anti-offset characteristic, the fixability intrinsic to the binder resin is lowered and entanglement of polymer molecules is strong. As a result, a resinous component due to crosslinking represented by, e.g., a THF (tetrahydrofuran)-insoluble content (gel content) makes a dispersion of a colorant or a charge control agent into the binder resin difficult, thus resulting in an unsuitable full-color toner. The crosslinked resinous component is also liable to lower a pulverizability of a kneaded product for the toner at the time of toner production.

JP-A 63-225244, JP-A 6-225245 and JP-A 63-225246 have disclosed a toner comprising two species of non-linear polyesters for the purpose of improving the low-temperature fixability, anti-high temperature offset characteristic and anti-blocking characteristic. JP-A 60-214368, JP-A 2-082267, JP-A 2-158747, JP-A 4-338973, JP-A 7-261459 and JP-A 8-101530 have disclosed a method for improving fixability and anti-offset characteristic of a toner by blending two species of polyesters having different physical properties. This method, however, is insufficient to realize full-color fixation since application of a release agent (e.g., silicon oil) onto the fixing roller surface is still required although the application amount of the release agent is decreased, thus failing to provide a satisfactory oil-less full-color toner as yet.

JP-A 3-188468 has proposed a toner comprising toner particles which comprises a polyester as a binder resin satisfying the following conditions (A)–(C): (A) when the polyester resin has an acid value (Av) and a hydroxyl value (OHv), Av is in the range of 20–35 mgKOH/g and a ratio of Av/OHv is in the range of 1.0–1.5; (B) a THF-insoluble content is at most 10%; and (C) a THF-soluble content has a molecular weight distribution according to GPC (gel permeation chromatography) such that a weight-average molecular weight (Mw) and a number-average molecular weight (Mn) provide a ratio $(Mw/Mn) \geqq 10$, there is at least one peak in a region of a number-average molecular weight of 3,000–8,000 (low-molecular weight side peak), there is one peak or shoulder in a region of a number-average molecular weight of 100,000–600,000 (high-molecular weight side peak), and there is 5–15% of the region of the high-molecular weight side peak. However, the polyester resin has a higher acid value (Av=20–35 mgKOH/g) to increase a content of a crosslinked component (e.g., at least 2% of THF-insoluble content in its working examples). Further, although the polyester resin contains a soft segment, the content of a polyfunctional carboxylic acid component is large, thus failing to realize full-color fixability (combination of gloss control and anti-offset characteristic).

JP-A 7-234537 has proposed a toner comprising as a main component a polyester resin having a soft segment having 5–30 carbon atoms and a wax having specified thermal properties and a toner comprising a mixture of a non-linear polyester resin comprising the above polyester resin with a linear polyester resin. Although these toners contain the soft segment component, a content of a polyfunctional monomer component having three or more functional groups based on the soft segment component is larger, thus failing to provide full-color fixability (realization of combination of gloss control with anti-offset characteristic).

As described above, in order to provide a color toner capable of exhibiting a good low-temperature fixability and an excellent anti-offset characteristic and being applicable to oil-less fixation scheme while satisfying color reproducibility of pictorial full-color images with an appropriate gloss and color reproducibility and transmission properties on an OHT sheet, the above-mentioned toners still leave problems to be solved in addition to image characteristics described later.

Accordingly, a toner exhibiting good low-temperature fixability and anti-high temperature offset characteristic and providing images having an appropriate gloss in a certain range in a broader temperature range is desired.

SUMMARY OF THE INVENTION

A generic object of the present invention is to provide a toner having solved the above-mentioned problems, a two-component type developer using the toner, a heat-fixing method using the toner, an image-forming method using the toner, and an apparatus unit including the toner.

A more specific object of the present invention is to provide a full-color toner and an image-forming method capable of allowing low-temperature fixation with substantially no oil and exhibiting an excellent anti-offset characteristic.

Another object of the present invention is to provide a toner and an image-forming method capable of stably providing an image having an appropriate gloss in a wider temperature range without causing a difference in gloss of a fixed image even when a temperature of a fixing roller is changed by a reduction of heat capacity due to a small-sized fixing apparatus and high-speed continuous printing or copying operation.

According to the present invention, there is provided toner comprising: at least a binder resin, a colorant and a wax, wherein the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

According to the present invention, there is also provided a two-component type developer comprising:

a toner and a carrier, said toner comprising at least a binder resin, a colorant and a wax, wherein the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

According to the present invention, there is further provided a heat fixing method, comprising the steps of:

forming a toner image on a recording material, and fixing the toner image onto the recording material by causing a fixing member to contact the surface of the toner image formed on the recording material while applying heat and pressure to the toner image, wherein the fixing member supplies a silicone oil to a fixing surface of the toner image in an amount of $0–1\times10^{-7}$ g/cm per unit are of the recording material in the fixing step; and the toner comprises at least a binder resin, a colorant and a wax, the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

The present invention further provides an image forming method, comprising the steps of:

charging an electrostatic latent image-bearing member, forming an electrostatic latent image on the charged latent image-bearing member, developing the electrostatic latent image with a toner to form a toner image, transferring the developed toner image onto a recording material via or without via an intermediate transfer member, and fixing the toner image onto the recording material by causing a fixing member to contact the surface of the toner image formed on the recording material while applying heat and pressure to the toner image, wherein the fixing member supplies a silicone oil to a fixing surface of the toner image in an amount of $0–1\times10^{-7}$ g/cm$^2$ per unit are of the recording material in the fixing step; and the toner comprises at least a binder resin, a colorant and a wax, the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

The present invention further provides an apparatus unit detachably mountable on a main assembly of an image forming apparatus, comprising:

a toner for developing an electrostatic latent image, a toner container for holding the toner, a toner-carrying member for holding and carrying the toner to a developing region, and a toner layer thickness-regulating member for regulating a thickness of a layer of the toner held on the toner-carrying member, wherein the toner comprises at least a binder resin, a colorant and a wax, the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
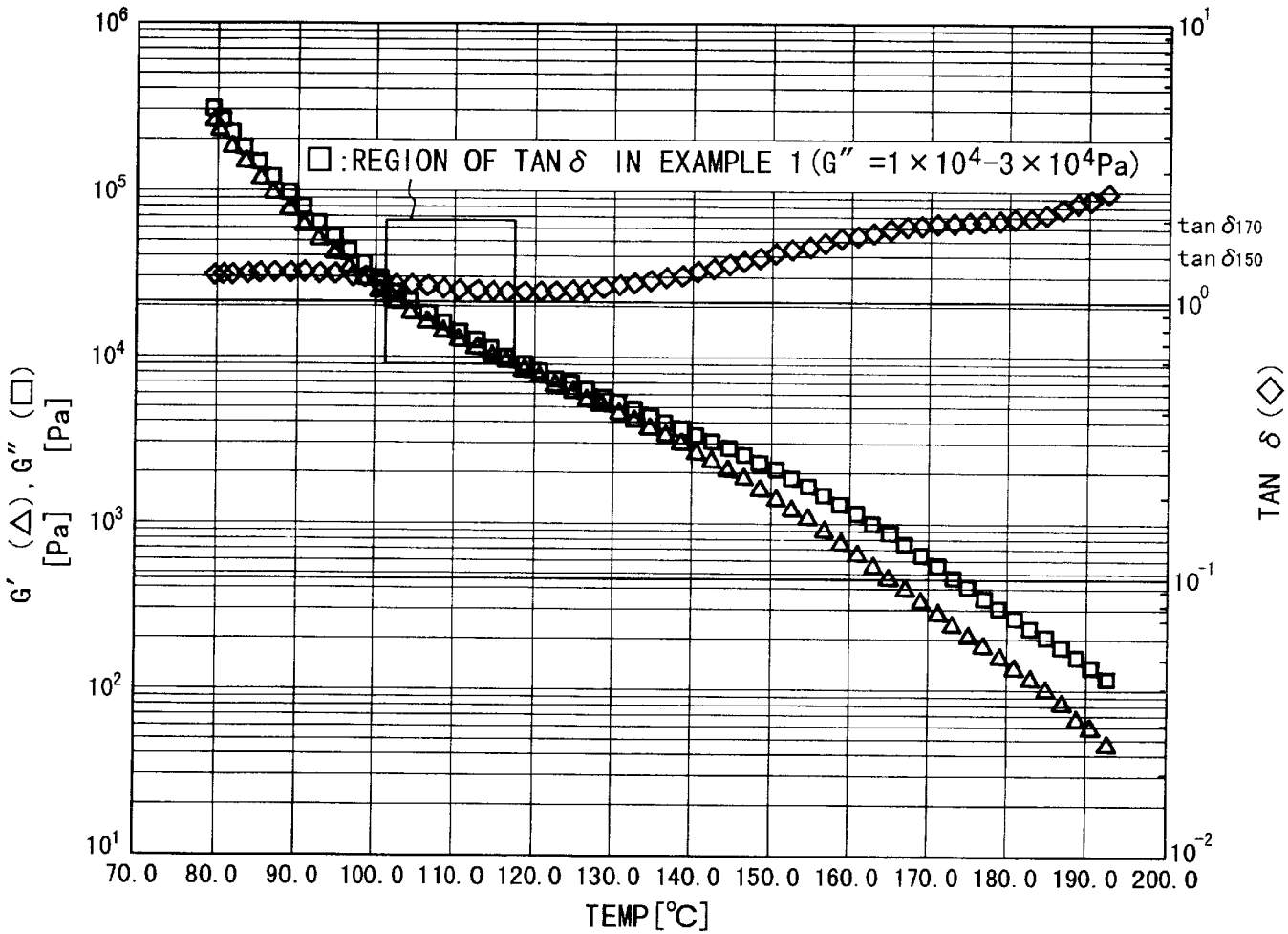
FIG. 1 is a graph showing a storage modulus (G') curve, a loss modulus (G") curve and a tan δ curve of a toner used in Example 1 described hereinafter.
Figure 2:
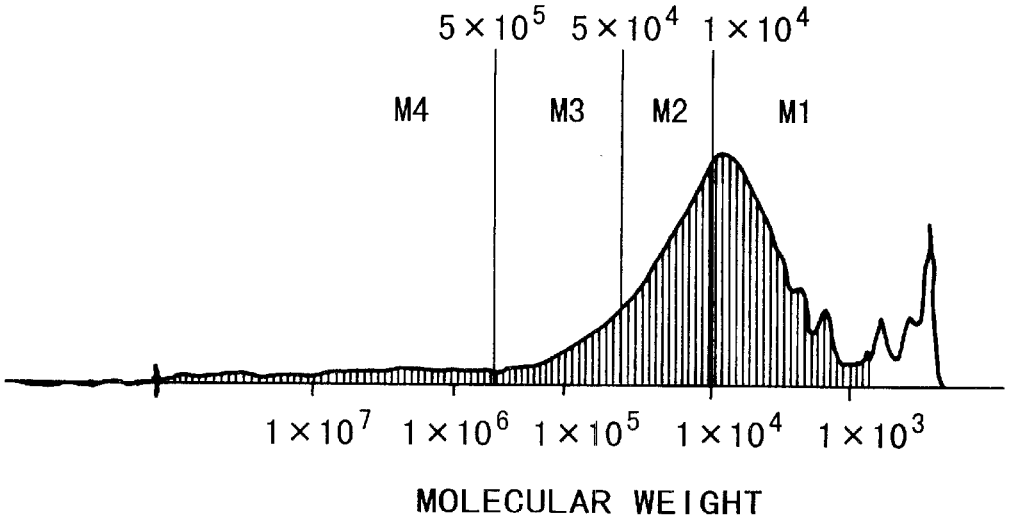
FIG. 2 is a GPC chart showing a molecular weight distribution of a THF-soluble content of the toner used in Example 1.

As a result of our study on various characteristics of a toner, particularly viscoelasticities and a molecular weight distribution, we have found that even when an amount of a specific wax particularly effective for improving anti-high temperature offset characteristic of a fixed image is decreased while retaining color reproducibility and light-transmission properties of an OHT sheet, it is possible to not only provide a lowered fixing initiation temperature and a broader fixable temperature range but also allow gloss control of the fixed image. Further, in a molecular weight distribution of a THF (tetrahydrofuran)-soluble content of a toner according GPC (gel permeation chromatography), by broadening a range of a molecular weight distribution including a particular molecular weight region in which a main peak is present and preferably by controlling a THF-insoluble content (based on the weight of an entire resinous component in a toner) in a specific range, it is possible to facilitate a gloss control of the fixed image and improve the anti-high temperature offset characteristic in combination with the effect of decrease in amount of the wax incorporated in the toner. As a result, it has been confirmed that by using the above-mentioned toner, it is possible to accomplish oil-less fixation (good fixing roller separation characteristic and anti-offset characteristic) and appropriate gloss-images in a broader temperature range including low temperatures and provide excellent color reproducibility and light transmission properties on a projection image as to the OHP sheet.

In the present invention, the toner has a viscoelastic characteristic measured at an angular frequency of the toner of 6.28 rad/sec including: a temperature giving a loss molecules G" of $3\times10^4$ Pa (T (30000 Pa)) of 90–115° C., preferably 95–110° C.; a temperature giving a loss modulus G" of $2\times10^4$ Pa (T (20000 Pa)) of 95–120; a temperature giving a loss modulus G" of $1\times10^4$ Pa (T (10000 Pa)) of 105–135° C., preferably 110–130° C.; a tan δ (loss modulus G"/storage modulus G') when G"=$1\times10^4$–$3\times10^4$ Pa of 0.6–2.0, preferably 0.7–1.5; a storage modulus at 170° C. (G' (170° C.)) of $1\times10^2$–$1\times10^4$ Pa, preferably $2\times10^2$–$5\times10^{13}$ Pa; a loss modulus at 170° C. (G" (170° C.)) of $1\times10^2$–$1\times10^4$ Pa, preferably $2\times10^2$–$5\times10^3$ Pa; and a ratio of a tan δ at 170° C. (tan $\delta_{170}$) to a tan δ at 150° C. (tan $\delta_{150}$) (tan $\delta_{170}$/tan $\delta_{150}$) of 1.05–1.6, preferably 1.15–1.4.

In the present invention, as described above, the temperatures giving loss moduli G" of $3\times10^4$ Pa, $2\times10^4$ Pa and $1\times10^4$ Pa (T (30000 Pa), T (20000 Pa) and T (10000 Pa)) are specified, respectively.

The loss modulus G" is an index of a viscosity of a polymer, i.e., an irreversible property with respect to stress, thus representing a liability to deformation of the toner under pressure application at the time of passing of the toner through fixing rollers in a fixing step.

In a region where the loss modulus G" of the toner exceeds $3\times10^4$ Pa, the toner is somewhat deformed by pressure application but does not start to attach to a recording material as yet. On the other hand, in a region where the loss modulus G" is below $1\times10^4$ Pa, flowing of the toner is caused due to too large toner deformation against pressure when the toner passes through the fixing rollers, thus resulting in an occurrence of a high-temperature offset phenomenon. Accordingly, values of the loss moduli G" are selectively determined to represent a viscoelastic characteristic of the toner at the time of actually fixing the toner when the toner passes through the fixing rollers. The temperatures giving such loss moduli G" (i.e., T (30000 Pa), T (20000 Pa) and (T (10000 Pa)) closely relate to a fixing initiation temperature and a fixable temperature range.

If the temperature T (30000 Pa) is in a range of 90–115° C., preferably 95–110° C., the toner can exhibit a sufficient (low-temperature fixability without impairing a storage stability. If the temperature T (30000 Pa) is below 90° C., the storage stability of the toner is liable to be lowered. Further, above 115° C., the low-temperature fixability becomes insufficient.

By setting the temperature T (20000 Pa) in a range of 95–120° C., it is possible to appropriately keep a toner-softening rate, thus principally stabilize a resultant gloss value and enlarge a fixing region. If the temperature T (20000 Pa) is below 95° C., the high-temperature offset and winding of the recording material about the fixing roller is liable to occur. Above 120° C., the fixability of the toner at low-temperatures becomes insufficient.

By setting the temperature T (10000 Pa) in a range of 105–135° C., preferably 110–130° C., it is possible to provide an appropriate gloss in a broader temperature range and a broader fixable region. If the temperature T (10000 Pa) is below 105° C., the fixable region becomes narrower, thus being liable to increase the gloss value. As a result, it is difficult to obtain an appropriate gloss in a broader temperature region. Above, 135° C., the toner is not readily softened to lower the low-temperature fixability, thus failing to attain a high gloss at low temperatures.

The storage modulus G' is an index of an elasticity of a polymer, i.e., a reversible property with respect to stress, thus representing a recovery force after the toner is deformed by pressure application at the time of passing of the toner through the fixing rollers in a fixing step. The storage modulus G' largely affects flatness or smoothness of the surface of a fixed image, thus closely relating to gloss of the fixed image.

Further, the higher recovery force means a larger affect on the toner due to elongation and/or shrinkage of polymer molecule per se within the toner particles, thus also closely relating to the high-temperature offset due to prevention of flowing of the softened toner.

The tan δ (G"/G') specified above is an index of a balance of the loss modulus G" and the storage modulus G'. In the present invention, the tan δ is specified in a temperature range giving the loss modulus G" of $1\times10^4$–$3\times10^4$ Pa in which the toner is fixed well, in view of the above-mentioned relationships.

If the tan δ (G"/G') when the loss modulus G" i in the range of $1\times10^4$–$3\times10^4$ Pa is the range of 0.6–2.0 (preferably 0.7–1.5), it is possible to provide a good balance of the loss modulus G" and the storage modulus G' leading to an excellent temperature stability of gloss, thus providing an image having a natural gloss of ca. 10–25 in a broader temperature range including a low temperature and a high temperature. Further, if the gloss is ca. 10, the toner image surface is sufficiently smooth, thus realizing good light-transmission properties on the OHT sheet even at the low-temperature.

In this regard, in the ordinary fixing step regarding the OHT sheet, the fixing speed is lowered or the fixing temperature is increased in order to provide the good light-transmission properties. In the present invention, sufficient light-transmission properties can be obtained as the OHT sheet without largely changing the fixing speed and temperature.

If the tan δ (when G"=$1\times10^4$–$3\times10^4$) is below 0.6, with respect to the viscoelastic characteristic of the toner at the fixation, the elasticity of the toner is too large compared with the viscosity, so that the toner image surface once smoothened by pressure application of the fixing rollers is roughened by the recovery force of the toner when the applied pressure is released, thus excessively lowering the gloss to impair the light-transmission properties as to the OHT sheet.

If the tan δ exceeds 2.0, the elasticity of the toner is considerably smaller than the viscosity, so that the recovery force of the toner is little exhibited, thus resulting a smooth toner image surface providing a considerably high gloss.

In the present invention, each of the storage modulus G' (170° C.) and the loss modulus G" (170° C.) is in the range of $1\times10^2$–$1\times10^4$ Pa, preferably $2\times10^2$–$5\times10^3$ Pa, and the ratio (tan $\delta_{170}$/tan $\delta_{150}$) is in the range of 1.05–1.6, preferably 1.15–1.4.

By setting and controlling the values of G' (170° C.) and G" (170° C.) and temperature-dependence of tan δ in the above ranges, it becomes possible to effect a gloss control stable against temperature change while suppressing an excessive increase in gloss. Further, it becomes possible to suppress the occurrence of the high-temperature offset by the control of flowability of the softened toner.

If either one of the storage modulus G' (170° C.) and the loss modulus G" (170° C.) is below $1\times10^4$ Pa, the toner flows excessively, thus being liable to cause the high-temperature offset. Above $1\times10^4$ Pa, the fixability at low temperature becomes insufficient.

If the ratio of tan δ (tan $\delta_{170}$/tan $\delta_{150}$) is below 1.05, the gloss is not increased even when the fixing temperature is increased, thus failing to provide a good gloss-image. Above 1.6, the resultant glass becomes excessively high, thus causing a problem regarding the gloss stability.

In the present invention, the tan δ when G"=$3\times10^4$ Pa and the tan δ when G'=$1\times10^4$ Pa may preferably provide a difference therebetween of below 0.4 as an absolute value in order to enlarged the fixing region.

If the difference exceeds 0.4, a non-offset region is liable to be narrowed. For example, in the case where a gel component which is not softened at low temperatures is co-present as a monodomain in a resinous component which is softened at low temperatures, the resultant difference (between the tan δ when G"=$3\times10^4$ Pa and the tan δ when G"=$1\times10^4$ Pa) exceeds 0.4, thus remarkably narrowing the non-offset region.

In the present invention, the toner has a maximum heat-absorption peak of 60–135° C., preferably 60–125° C., more preferably 60–120° C., as measured by differential scanning calorimetry (DSC). A low-softening point wax having a maximum heat-absorption peak in the above range is incorporated in the toner in an amount of 0.3–5.0 wt. %, preferably 0.5–5.0 wt. %, more preferably 0.5–4.5 wt. %. The wax contained in the toner effectively improves the anti-high temperature offset characteristic and separability or releasability of the fixed image from the fixing roller, thus largely contributing to enlargement of a temperature range allowing a good separability of the fixed image.

If the maximum heat-absorption peak of the toner is below 60° C., a toner storage stability is lowered. Above 135° C., the separability of the recording material from the fixing roller is lowered at low temperatures, winding of the recording material about the fixing roller is caused to occur, thus resulting in a narrower fixable temperature region.

The wax used in the present invention may preferably have a viscosity of 5–200 mPa.s, more preferably 5–100 mPa.s, further preferably 5–50 mPa.s at a temperature giving the loss modulus G" of $1\times10^4$ Pa (as measured at the angular frequency of the toner of 6.28 rad/sec) in view of the separability-improving effect on the recording material at the time of fixation.

If the wax viscosity is below 5 mPa.s, soiling of the toner on members contacting the toner is liable to occur and above 200 mPa.s, winding of the recording material about the fixing roller is liable to occur particularly at low temperatures.

If the wax content in the toner is below 0.3 wt. %, the fixing image separability from the fixing roller and the anti-high temperature offset characteristic are liable to become insufficient. Above 5.0 wt. %, a projection image as to the OHT sheet is liable to lower its color reproducibility and light-transmission properties. Further, in the case of a toner wherein the wax is uniformly dispersed within toner particles, a large amount of the wax is present at the surfaces of the toner particles, thus being liable to lower the flowability and anti-blocking property of the toner.

The toner according to the present invention may preferably contain a tetrahydrofuran (THF)-soluble content exhibiting a broadened molecular weight distribution according to a gel permeation chromatography (GPC) including a main peak in a particular molecular weight region and may more preferably further contain a small amount of a THF-insoluble content, whereby it becomes possible to freely effect gloss control of the fixed image, thus readily formulating the toner so as to provide a designed gloss to the toner.

In the present invention, the THF-insoluble content may preferably be contained in the toner in an amount of 0–15.0 wt. %, more preferably 1–10.0 wt. %, further preferably 2.0–7.0 wt. %, per the entire resinous component of the toner.

If the THF-insoluble content is above 15 wt. %, the resultant gloss is not increased even when the fixing temperature is increased, thus not readily providing the good gloss-image.

The toner contains a THF-soluble content exhibiting a molecular weight distribution according to GPC chromatogram providing a main peak in a molecular weight region of 2,000–30,000, preferably 5,000–20,000, and a ratio (Mw/Mn) of above 100, preferably 100–2,000, more preferably 105–2,000, further preferably 110–1500, between weight-average molecular weight (Mw) and number-average molecular weight (Mn).

If the main peak molecular weight is below 2,000 or above 30,000, it becomes difficult to effect free gloss control of the fixed toner image.

If the ratio (Mw/Mn) is below 100, the free gloss control of the fixed toner image is not readily effected and the anti-high temperature offset characteristic is lowered.

The THF-soluble content exhibits a molecular weight distribution according to GPC chromatogram including a content (M1) of a component having molecular weights of at most $1\times10^4$ of 35–55% (preferably 35–50%), a content (M2) of a component having molecular weights above $1\times10^4$ and at most $5\times10^4$ of 30–45% (preferably 30–40%), a content (M3) of a component having molecular weights above $5\times10^4$ and at most $5\times10^5$ of 8–20% (preferably 8–15%), and a content (M4) of a component having molecular weights above $5\times10^5$ of 2–12% (preferably 2–10%). In order to facilitate the gloss control, the contents M1, M2, M3 and M4 satisfying the following relationships:

$75\% \leqq M1+M2 \leqq 90\%$ (preferably $75\% \leqq M1+M2 \leqq 85\%$), and $M1>M2>M3>M4$.

If the content (M2) ($\leqq 1\times10^4$) is below 35%, the gloss is not readily increased to lower the low-temperature fixability and above 55%, the offset phenomenon is liable to occur.

If the content (M2) ($1\times10^4<M2<5\times10^4$) is below 30%, the low-temperature fixability is liable to be lowered and above 45%, the offset phenomenon is liable to occur.

If the content (M3) ($5\times10^4<M3\leqq 5\times10^5$) is below 8%, a fluctuation of gloss against temperature becomes large and winding of the recording material about the fixing roller at high temperature is liable to occur and above 20%, the gloss is not readily increased.

If the content (M4) ($>5\times10^5$) is below 2%, the gloss fluctuation against temperature becomes large and the recording material winding about the fixing roller at high temperature is liable to occur and above 12%, the projection image through the OHT sheet is liable to lower its color reproducibility and light-transmission characteristic.

In the case where M1+M2 is below 75%, it is difficult to sufficiently improve the low-temperature fixability, gloss control and light-transmission characteristic on the OHT sheet. Above 90%, the non-offset region becomes narrower.

Visco-elastic properties (storage modulus G' and loss modulus G" of the toner) described herein are based on values measured under the following conditions.

Apparatus: Rheometer RDA-II type (available from Rheometrics Co.)

Sample holder: Parallel plates having a diameter of 25 mm.

Sample: A toner is heat-molded into a disk of ca. 25 mm in diameter and ca. 3 mm in height.

Measurement frequency: 6.28 rad/sec.

Setting of measurement strain: Initially set to 0.1%, followed by measurement in an automatic measurement mode.

Correction of sample elongation: Adjusted in an automatic measurement mode.

Measurement temperatures: From 80° C. to 190° C. at a temperature-increasing rate of 2° C./min.

The THF-insoluble content of a toner is measured in the following manner.

<Measurement of THF-insoluble Content>

Ca. 0.5–1.0 g of a sample toner is weighed (at $W_1$ g), placed in a cylindrical filter (e.g., "No. 86R", available from Toyo Roshi K.K.) and then subjected to extraction with 200 ml of solvent THF in a Soxhlet's extractor for 12 hours. The solvent is evaporated from the extract solution to leave a THF-soluble resin content, which is dried under vacuum at 100° C. for one whole day and then weighed (at $W_2$ g). The weight of components, such as a magnetic material or a pigment and wax, other than the resinous component is determined (at $W_3$ g). THF-insoluble content ($THF_{ins.}$) is calculated as follows:

$$THF_{ins.}\ (\text{wt. }\%)=[(W_1-W_3-W_2)/(W_1-W_3)]\times100.$$

The molecular weight distribution of THF-soluble contents of a toner described herein are based on GPC measurement performed according to the following manner.

<Molecular Weight Distribution Measurement by GPC>

A sample toner may be prepared as follows.

The toner sample subjected to the Soxhlet's extraction (for measurement of THF-insoluble content) and THF are mixed in a ratio of ca. 5–25 mg/5 ml and then left standing for several hours at room temperature. Then, the mixture is sufficiently shaken and then further left standing for one whole day at room temperature. Thereafter, the mixture is caused to pass through a sample treating filter having a pore size of 0.4–0.5 μm (e.g., "Maishoridisk H-25-5", available from Toso K.K. or "Ekikurodisk 25CR", available from German Science Japan Co.) to recover the filtrate as a GPC sample.

In the GPC apparatus, a column is stabilized in a heat chamber at 40° C., tetrahydrofuran (THF) solvent is caused to flow through the column at that temperature at a rate of 1 ml/min., and about 100 $\mu$l of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK quadcolumn available from Toso K.K.

The GPC measurement is performed by using an apparatus ("GPC-150C", available from Waters Co.) in a molecular weight range from an initial point (where a chromatogram starts to be drawn from a base line) on a high-molecular weight side to a point of a molecular weight of ca. 400 on a low-molecular weight side.

The binder resin for providing the toner according to the present invention may include: homopolymers of styrene and its substitution derivatives such as polystyrene, poly-p-chlorostyrene and polyvinyltoluene; styrene-based copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-$\alpha$-chloromethyl methacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride, phenolic resin, natural resin-modified phenolic resin, natural resin-modified maleic resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarone-indene resin, and petroleum resin.

Among the above polymers or resins, polyester resin or styrene-based copolymers may preferably be used in the present invention.

In the case where the polyester resin is used as the binder resin for the toner of the present invention, it is possible to provide an excellent fixability, thus being suitable for a color toner. Particularly, it is preferred to use a polyester resin obtained through co-polycondensation between bisphenol or bisphenol derivative represented by the formula (I) shown below (as a polyol component) and a polycarboxylic acid component selected from the group consisting of carboxylic acids having at least two carboxylic groups, their anhydrides, and their lower alkyl esters (such as fumaric acid, maleic acid, maleic anhydride, phthalic acid, terephthalic acid, trimellitic acid, and pyromellitic acid) since it is possible to provide a good charging characteristic to a resultant color toner.

(I)

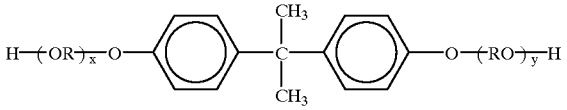

The above polyester resin may preferably be a non-linear polyester resin obtained through co-polycondensation between a polyol (polyhydric alcohol) component and a polycarboxylic acid component by using a composition including a polycarboxylic acid having three or more carboxyl groups and/or a polyalcohol having three or more hydroxyl groups.

In the present invention, the toner may preferably contain an organic metal compound in combination with the non-linear polyester resin since the toner having the above-mentioned specific viscoelastic characteristic, THF-insoluble content and molecular weight distribution according to GPC can readily be prepared.

It has been generally known that an organic metal compound is bonded to a terminal polar group of a polyester resin to effect metal crosslinking.

In order to control a degree of the metal crosslinking, we have found that it is important to appropriately determine contents of and a ratio between a polycarboxylic acid component or polyhydric alcohol component having a saturated or unsaturated aliphatic hydrocarbon group having 5–30 carbon atoms as a soft segment exhibiting steric hindrance and a polycarboxylic acid component having three or more carboxyl groups as a component having a high reaction probability for the metal crosslinking. As a result, it is possible to realize gloss control of a fixed image particularly required at the time of fixation of a full-color image and an anti-offset characteristic in combination.

In the present invention, the composition comprising the polycarboxylic acid component and a polyhydric alcohol component for producing the above-mentioned non-linear polyester resin comprises at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms. These components satisfy the following relationships:

$0.5 \leqq A \leqq 10$, $5 \leqq B \leqq 30$, and $2 \leqq B/A \leqq 10$, preferably, $1.5 \leqq A \leqq 6.5$, $10 \leqq B \leqq 25$, and $2 \leqq B/A \leqq 10$.

If the content (A mol. %) of the polycarboxylic acid component (having at least three carboxyl groups) in the composition is below 0.5 mol. %, the crosslinking reaction with the organic metal compound does not progress well, thus being liable to provide a tan $\delta$ (G"/G') when $G''=1\times10^4$–$3\times10^4$ Pa of above 2.0 to cause a difficulty of broadening the non-offset region. When a high-molecular weight resin is used for preventing the increase in tan $\delta$, the low-temperature fixability is liable to be lowered.

If the content (A mol. %) is above 10 mol. %, the non-offset region is broadened due to accelerated crosslinking reaction with the organic metal compound but the resultant tan δ is liable to be below 0.6, thus lowering the gloss required for the full-color image. Even when the fixing temperature is increased, a higher gloss is not readily obtained. Further, the light-transmission characteristic as to the OHT sheet is deteriorated and the low-temperature fixability is also lowered.

If the above-mentioned ratio B/A is below 2, the non-offset region is broadened by the crosslinking reaction with the organic metal compound but the resultant tan δ is liable to be below 0.6, thus lowering the gloss required for the full-color image. Even when the fixing temperature is increased, it is difficult to provide a higher gloss. Further, the light-transmission characteristic of the OHT sheet and the low-temperature fixability are lowered.

If the ratio B/A exceeds 10, due to the steric hindrance of the component having a saturated or unsaturated aliphatic hydrocarbon group having 5–30 carbon atoms as the soft segment to lower the crosslinking performance, the resultant tan δ is liable to exceed 2.0, thus resulting in a difficulty of broadening the non-offset region.

If the content (B mol. %) of the polyhydric alcohol component is below 5 mol. %, the non-offset region is broadened by the crosslinking reaction with the organic metal compound but the resultant tan δ is liable to be below 0.6, thus lowering the gloss required for the full-color image. Even when the fixing temperature is increased, it is difficult to provide a higher gloss. Further, the light-transmission characteristic of the OHT sheet and the low-temperature fixability are lowered.

If the content (B mol. %) exceeds 30 mol. %, due to the steric hindrance of the component having a saturated or unsaturated aliphatic hydrocarbon group having 5–30 carbon atoms as the soft segment to lower the crosslinking performance, the resultant tan δ is liable to exceed 2.0, thus resulting in a difficulty of broadening the non-offset region.

The above-mentioned content (A mol. %) of the polycarboxylic acid component having at least three carboxyl groups may preferably satisfy the following relationships with a content (C wt. %) of the organic metal compound in the toner:

$0.2 \leqq C \leqq 10$, and $2 \leqq A \times C \leqq 50$, preferably, $0.5 \leqq C \leqq 7$, and $3 \leqq A \times C \leqq 25$.

If the above relationships are fulfilled, the resultant toner can exhibit temperature stability in a medium (appropriate) gloss region.

If the content (C wt. %) of the organic metal compound in the toner is below 0.2 wt. %, the crosslinking reaction by the organic metal compound does not progress well, thus being liable to provide a tan δ (G"/G') when $G''=1\times10^4–3\times10^4$ Pa of above 2.0 to cause a difficulty of broadening the non-offset region. When a high-molecular weight resin is used for preventing the increase in tan δ, the low-temperature fixability is liable to be lowered.

If the content (C wt. %) is above 10 mol. %, the non-offset region is broadened due to accelerated crosslinking reaction with the organic metal compound but the resultant tan δ is liable to be below 0.6, thus lowering the gloss required for the full-color image. Even when the fixing temperature is increased, a higher gloss is not readily obtained. Further, the light-transmission characteristic as to the OHT sheet is deteriorated and the low-temperature fixability is also lowered.

If the product AxC between the content (A mol. %) of the polycarboxylic acid component (having at least three carboxyl groups) in the composition and the content (C wt. %) of the organic metal compound in the toner is below 2, the crosslinking degree is lowered, thus being liable to provide a tan δ (G"/G') when $G''=1\times10^4–3\times10^4$ Pa of above 2.0 to cause a difficulty of broadening the non-offset region. When a high-molecular weight resin is used for preventing the increase in tan δ, the low-temperature fixability is liable to be lowered.

If the product A×C is above 50, the non-offset region is broadened due to accelerated crosslinking reaction with the organic metal compound but the resultant tan δ is liable to be below 0.6, thus lowering the gloss required for the full-color image. Even when the fixing temperature is increased, a higher gloss is not readily obtained. Further, the light-transmission characteristic as to the OHT sheet is deteriorated and the low-temperature fixability is also lowered.

The organic metal compound used in the toner of the present invention may include an organic metal complex, metal salt, metal complex salt and chelate compound.

Examples of the organic metal compound may include: a monoazo metal complex, an acetylacetone metal complex, a salicylic acid metal complex, an alkylsalicylic acid metal complex, dialkylsalicylic acid metal complex, an oxynaphthoic acid metal complex, a polycarboxylic acid metal complex, and a carboxylic acid metal salt.

Examples of metal ion for constituting the organic metal complex, metal salt, metal complex salt, and chelate compound may include those of metal, such as chromium, iron, zinc, aluminum and zirconium. Of these, iron, aluminum and zirconium may preferably be used in order to readily control the above-mentioned viscoelastic characteristic of the toner.

In the case where the organic metal compound is used in a black toner, it is possible to use colorless one or chromatic one. In the case of color toner, the organic metal compound may preferably be colorless or pale-color one which does not adversely affect a tone or tint of the toner. Accordingly, in the case of the color toner, aluminum ion or zirconium ion may preferably be used as the metal ion constituting the organic metal complex, metal salt, metal complex salt and chelate compound. Particularly, in view of triboelectric chargeability of the toner, aluminum ion may preferably be adopted.

The organic metal compound may particularly preferably be an organic metal compound comprising a coordination or/and a bonding of a metal comprising aluminum or zirconium with an aromatic compound selected from the group consisting of aromatic diols, aromatic hydroxycarboxylic acids, aromatic monocarboxylic acids, and aromatic polycarboxylic acids.

This organic metal compound is effective in improving control of the viscoelastic characteristic of the toner and tone of the color toner image at higher level.

The organic aluminum compound is particularly preferred since it is possible to further stabilize the triboelectric chargeability of the resultant color toner.

The organic metal compound preferably used in the present invention may be classified into the following three categories:

(i) metal complexes each comprising metal element of aluminum or zirconium and a ligand of an aromatic diol, an aromatic hydroxycarboxylic acid or an aromatic polycarboxylic acid, (ii) metal complex salts each comprising a metal element of aluminum or zirconium and a ligand of an aromatic diol, an aromatic hydroxycarboxylic acid or an aromatic polycarboxylic acid, and (iii) metal salts of aluminum or zirconium with aromatic carboxylic acids inclusive of aromatic carboxylic acids, aromatic hydroxycarboxylic acids and aromatic polycarboxylic acids.

It is preferred to use a metal complex or metal complex salt including 2–4 units of aromatic diol, aromatic hydroxycarboxylic acid or aromatic polycarboxylic acid so as to form a chelate. In the case of an organic metal complex salt, it is preferred to use those having 1–4 units, more preferably 2 or 3 units, of coordinating carboxy anions of, aromatic carboxyl acid, aromatic hydroxycarboxylic acid or aromatic polycarboxylic acid. It is also possible to use a mixture of complexes or complex salts having different number of chelates or/and different species of ligands. The metal salt can also be a mixture of two or more species of organic metal salts including those of different numbers of acids per molecule.

Specific examples of the organic metal compound may include those represented by the following formula (II):

(II)

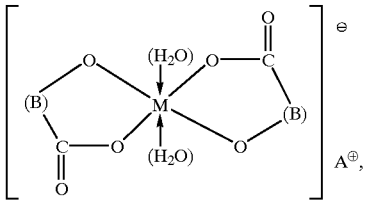

wherein M denotes a coordinating center metal, such as Cr, Co, Ni, Mn, Fe, Ti or Al B denotes

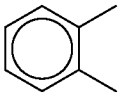

which may have a substituent such as alkyl group),

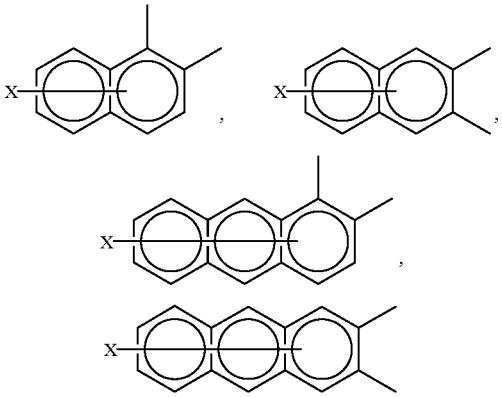

(where X is hydrogen atom, halogen atom or nitro group),

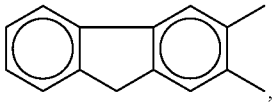

-continued

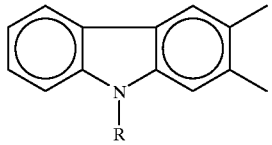

or

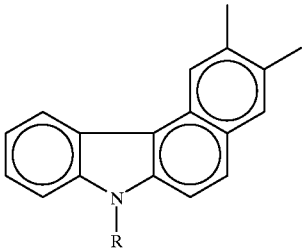

(where R is hydrogen atom or alkyl or alkenyl group having 1–18 carbon atoms); and $A^+$ is hydrogen ion, sodium ion, potassium ion, ammonium ion or aliphatic ammonium ion.

In the present invention, it is preferred to effect metal crosslinking of an organic metal compound comprising a coordination or/and a bonding of a metal comprising aluminum or zirconium with an aromatic compound selected from the group consisting of aromatic diols, aromatic hydroxycarboxylic acids, aromatic monocarboxylic acids, and aromatic polycarboxylic acids, with a non-linear polyester resin obtained through co-polycondensation of a composition comprising (a) a polycarboxylic acid component having at least three carboxyl groups and (b) a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms.

The resultant toner is effective in enlargement of the fixing region and gloss control.

The above metal crosslinking is effected during a melt-kneading of toner ingredients including the above-mentioned organic metal compound and the non-linear polyester resin through coordinate bonding or ionic bonding between a functional group, such as carboxyl group or hydroxyl group, as a terminal group of the non-linear polyester resin having a lot of terminal molecular chains, and a metal element of the organic metal compound. As a result, the resinous component of the toner has a three-dimensional network structure but the bonding thereof based on the coordinate or ionic bond is not so fir, thus effectively suppressing the offset phenomenon and allowing the low-temperature fixability and gloss control in a broader region to some extent.

The above three-dimensional network structure based on the coordinate or ionic bond which is not so firm also effectively improve a dispersibility of the wax and control of a blooming rate at the time of fixation.

In the present invention, the organic metal compound may be used in combination with the known charge control agent as described hereinabove.

The polyester resin used as the binder resin further toner according to the present invention may preferably have an acid value (Av) of 2–20 mgKOH/g, more preferably 5–15 mgKOH/g.

If the acid value (Av) of the polyester resin is below 2 mgKOH/g, the effects of improving stabilities of developing property and durability based on the interaction with the organic metal compound are not achieved and the lowering in dispersibility of the wax due to dispersion failure of the organic metal compound leads to an insufficient low-temperature fixability. Above 20 mgKOH/g, an moisture-absorbing property becomes larger, thus being liable to lower an image density and cause fogs.

The acid value (JIS-acid value) of the binder resin is measured in the following manner according to JIS K-0070.

<Measurement of Acid Value (Av)>

1) An acid value measurement sample is prepared by preliminarily removing additives other than a polymeric component from a binder resin or by determining an acid value and content of components other than the polymeric component. Then, 0.5–2.0 g of the sample in a pulverized form is accurately weighed to provide a weight W (g) of the polymeric component.

2) The sample is placed in a 300-ml beaker, and 150 ml of a toluene/ethanol (4/1) mixture liquid is added thereto to dissolve the sample.

3) The sample solution is (automatically) titrated with a 0.1 mol/liter-KOH solution in ethanol by means of a potentiometric titration apparatus (e.g., "AT-400 (win workstation)" with an "ABP-410" electromotive buret, available from Kyoto Denshi K.K.).

4) The amount of the KOH solution used for the titration is recorded at S (ml), and the amount of the KOH solution used for a blank titration is measured and recorded at B (ml).

5) The acid value (Av) is calculated according to the following equation:

$$\text{Acid value } (Av)\ (\text{mgKOH/g}) = \{(S-B)\times f\times 5.61\}/W,$$

wherein f denotes a factor of the 0.1 mol/liter-KOH solution.

Examples of the polycarboxylic acid component used in the present invention may include: 1,2,4-benzenetricarboxylic acid, 1,3,5-benzenetricarboxylic acid, 1,2,4-cyclohexane tricarboxylic acid, 1,2,4-naphthalenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, empole trimer acid, and their anhydrides and lower alkyl esters.

As a monomer or component, for constituting the polyester resin, containing a saturated or unsaturated aliphatic hydrocarbon group having 5–30 carbon atoms, it is necessary to use a monomer containing saturated or unsaturated aliphatic hydrocarbon group to be introduced into a skeleton of the resultant polyester resin in a branched chain form.

The component containing a saturated or unsaturated aliphatic hydrocarbon group having 5–30 carbon atoms may be one containing such a group as at least one of monomers having two or three or more functional groups constituting the polyester resin.

In a preferred embodiment, the component may include those of aliphatic dicarboxylic acids or diols each containing a substituent comprising a saturated or unsaturated aliphatic hydrocarbon group having 5–30 carbon atoms.

Examples of the aliphatic dicarboxylic acid monomer (or component) may preferably include $C_5$–$C_{30}$ alkyl or alkenyl-substituted products of dicarboxylic acids, such as succinic acid, sebacic acid, and azelaic acid and their anhydrides, particularly those of dodecenylsuccinic acid and octylsuccinic acid and their anhydrides.

As another component for constituting the polyester resin preferably used as the binder resin for the toner of the present invention, it is possible to use dicarboxy acid component free from a saturated or unsaturated aliphatic hydrocarbon group having 5–30 carbon atoms, and/or an alcohol component having two or three or more hydroxyl groups.

Examples of the dicarboxylic acid component may include: benzenedicarboxylic and their anhydrides acids, such as phthalic acid, terephthalic acid, isophthalic acid and phthalic anhydride, and their lower alkyl esters; alkyldicarboxylic acids, such as succinic acid, adipic acid, sebacic acid and azelalic acid, their anhydrides and their lower alkyl esters; and unsaturated dicarboxylic acids such as fumaric acid, maleic acid, citraconic acid and itaconic acid, their anhydrides and their lower alkyl esters.

Examples of dihydric alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hxanediol, and hydrogenated bisphenol A; and diols represented by the following formulas (a) and (b):

(a)

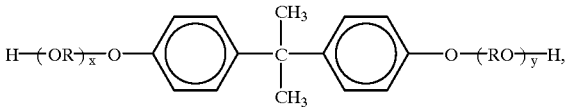

wherein R is ethylene group or propylene group and x and y are independently an integer of at least 0 providing the average of x+y being in the range of 0–7;

(b)

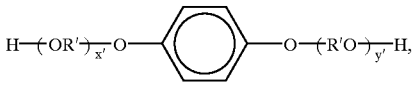

wherein R' is ethylene group or propylene group; and x' and y' are independently in integer of at least 0 providing the average of x'+y' being in the range of 0–10.

Among thee diols, it is preferred to use etherized bisphenols containing at least one propoxy group and/or ethoxy group.

Examples of the aliphatic diol component may include: ethylene glycol, diethylene glycol, triethylene glycol, tetraethylene glycol, pentaethylene glycol, 1,4-butanediol, 1,5-pentanediol, 1,6-hexanediol, 1,2-propylene glycol, 1,3-propylene glycol, dipropylene glycol and neopentyl glycol.

Examples of the polyhydric alcohol component having at least three hydroxyl groups may include: sorbitol, 1,2,3,6-hexanetetrol, 1,4-sorbitane, pentaerythritol, dipentaerythritol, tripentaerithritol, sucrose, 1,2,4-metanetriol, glycerol, 2-methylpropanetriol, 2-methyl-1,2,4-butanetriol, trimethylolethane, trimethylolpropane, and 1,3,5-trihydroxybenzene.

The polyester resin preferably used as the binder for the toner of the present invention may be used in combination with another polymers or resins including those except for polyester resin described above.

Examples of a comonomer used in combination with a styrene monomer for constituting the styrene-based copolymers used as the binder resin in the present invention may include: vinyl monomers including monocarboxylic acids having a double bond and their derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethylmethacrylate, butyl methacrylate, octyl methacrylate, acrylonitrile, methacrylonitrile, and acrylamide. These vinyl monomers may be used singly or in combination of two or more species.

The toner according to the present invention may preferably have a glass transition temperature or point (Tg) of 45–75°C., preferably 50–70° C., in view of storability.

If the Tg is below 45° C., the toner is liable to be deteriorated in a high-temperature environment and cause the offset phenomenon at the time of fixation. Above 75° C., the fixability is liable to b lowered.

In the present invention, in order to prevent winding of the recording material about the fixing roller and occurrence of the offset phenomenon, the wax contained in the toner may preferably have a maximum heat-absorption peak of 60–135° C. as measured by DSC.

Examples of the wax may include: polyolefin waxes and their derivatives, such as low-molecular weight polyethylene, low-molecular weight polypropylene, oxidation-treated polyethylene and polypropylene, and acid-modified polyethylene and polypropylene; petroleum waxes, such as paraffin wax, microcrystalline wax, and petrolactam; hydrocarbon waxes and their derivatives, such as Fischer-Tropsche wax; natural waxes and their derivatives, such as candelilla wax and carnauba wax; vegetable waxes and their derivatives, such as rice wax; Japan wax, and jojoba wax; animal waxes and their derivatives, such as beeswax, lanolin, and whale wax; mineral waxes and their derivatives, such as montan wax, and ozocerite; and fatty acid-based waxes and their derivatives, such as hydrogenated castor oil, hydroxystearic acid, aliphatic acid amide and phenolic aliphatic acid ester. The above derivatives of two axes may include oxides, block copolymers with vinyl monomer and graft-modified products of the waxes.

The waxes used in the present invention may further include known releasing compounds, such as higher fatty acids (e.g., stearic acid and palmitic acid), their metal salts, and the like.

The above-mentioned waxes may be used singly or in combination of two or more species.

Of the above-mentioned waxes, waxes having a viscosity of 5–200 mPa.s, preferably 10–200 mPa.s, further preferably 5–50 mPa.s, at a temperature giving the loss modulus G" of $1\times10^4$ Pa (measured at the angular frequency of 6.28 rad/sec) may preferably be used particularly in order to enhance the effect of prevention of winding of the recording material about the fixing roller.

Specifically, in order to achieve the winding prevention effect, it is important for the toner to be supplied from the toner surface to the fixing roller surface in a melted state where the toner is softened and deformed to provide, e.g., the loss modulus G" of $1\times10^4$ Pa. In such a state ($G''=1\times10^4$ Pa), by controlling the viscosity of the wax in the above range, it is possible to provide a good releasability between the fixing roller surface and the toner image.

If the wax viscosity is below 5 mpa.s, the toner stability is lowered and above 200 mpa.s, the releasability (separability) from the fixing roller is remarkably lowered, thus resulting in a narrower separable temperature range from the fixing roller.

The viscosity of the wax referred to herein may be measured in the following manner.

<Measurement of Viscosity>

The wax viscosity is measured by using a viscometer ("VT500", available from Haake Co.) with a sensor ("PK1") with a coneo angle of 0.5 degree under such a condition that the measuring temperature is changed from the melting point to 160° C. at an increment of 10° C. at a shear rate of 6000 (1/sec).

The thus-obtained measured data are plotted on a graph on a half-long scale.

The wax viscosity at a temperature giving $G''=1\times10^4$ Pa (at the angular frequency of the toner of 6.28 rad/sec) is taken as a value at the point showing the temperature giving $G''=1\times10^4$ Pa.

The wax used in the present invention may preferably have at least one heat-absorption peak in a temperature range of 60–120° C. according to measurement using a differential scanning calorimeter (DSC), in view of improvement in low-temperature fixability.

In order to further improve the releasability, the wax having at least one heat-absorption peak temperature of 60–120° C. may comprise polyolefins, Fischer-Tropsche hydrocarbon waxes and petroleum waxes, particularly polyethylene wax.

The wax used in the present invention may preferably have an onset temperature of 55–105° C. on a DSC curve taken on temperature increase, thus providing an excellent low-temperature fixability and a good storability.

If the onset temperature of the wax is below 55° C., the wax component contained in the toner is liable to cause blooming toward the toner particle surface from at the relatively lower temperature, thus deteriorating in its storability and developing performance on temperature increase. Above 105° C., the wax is not supplied from the toner to the fixing roller surface in a state such that the toner is softened and deformed, thus lowering the anti-winding property and the fixability.

The maximum heat-absorption peak temperatures and the onset temperatures and the toner of the present invention and the wax used in the toner referred to herein are based on values measured in the following manner.

<Measurement of Maximum Heat-absorption Peak and Onset Temperatures of Toner and Wax>

The values of maximum heat-absorption peak and onset temperature of the toner and wax are based on values measured by using a differential scanning calorimeter ("DSC-7", mfd. by Perkin-Elmer Corp.) according to ASTM D3418-82.

A sample is accurately weighed in an amount of 2–10 mg, and placed in an aluminum pan. The measurement is performed by using a blank aluminum pan as a reference at a temperature-raising rate of 10° C./min. in a temperature range of 20–200° C. in a normal temperature/normal humidity environment to obtain a DSC curve.

The maximum heat-absorption peak temperature is taken as a temperature giving a maximum peak top on a DSC (heat-absorption) curve on temperature increase.

The onset temperature is taken as a temperature at which a tangential line taken at a point giving the largest differential on a DSC (heat-absorption) curve on temperature increase intersects the base line.

The wax used in the present invention may preferably exhibit a molecular weight distribution according to GPC chromatogram including an Mn of 200–2000, more preferably 300–1000, a Mw of 200–2500, more preferably 300–1200, and a ratio (Mw/Mn) of at most 2, more preferably at most 1.5.

If the wax exhibits the above molecular weight distribution, it is possible to provide the resultant toner with preferred thermal characteristics. On the other hand, if the Mn or Mw is below the above range, the toner is liable to be thermally affected excessively to deteriorate in anti-blocking property and developing characteristic. If the Mn or Mw is above the above range, it is difficult to effectively utilize external heat energy, thus not readily providing excellent fixability and anti-offset characteristic. If the ratio Mw/Mn is above 2, the resultant molecular weight distribution becomes broader, thus failing to provide a melting behavior sensitive to heat. As a result, it is difficult to obtain a region wherein a good fixability and an excellent anti-offset characteristic are achieved in combination.

<Molecular Weight Distribution of Wax>

The molecular weight (distribution) of the wax used in the present invention may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The contact used in the present invention may be chromatic one. As such a chromatic colorant, it is possible to use known colorants.

In order to provide good chargeability, flowability and spectral reflection characteristic, it is preferred to employ a combination of a cyan toner containing copper phthalocyanine-based organic pigment, a magenta toner containing a quinacridone-based organic pigment and a yellow toner containing a diarylide-based pigment.

Examples of the copper phthalocyanine-based pigment may include: C.I. Pigment Blue 15, 15:1, 15:2, 15:3 and 15:4; and copper phthalocyanine pigments represented by the following formula and having a phthalocyanine skeleton to which 1–5 phthalimidomethyl groups or other groups are added.

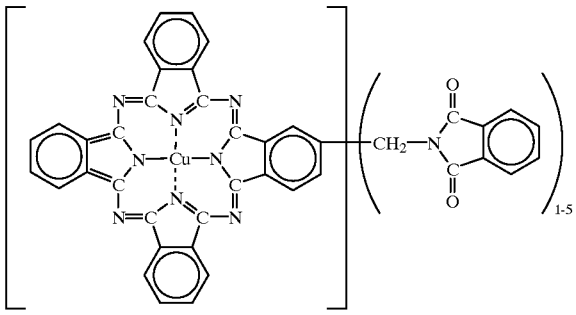

Such a copper phthalocyanine-based colorant may be added in an amount of 0.1–12 wt. parts, preferably 0.5–10 wt. parts, more preferably 1–8 wt. parts, per 100 wt. parts of the binder resin. If the addition amount exceeds 12 wt. parts, he cyan toner is lowered in its color saturation and value, thus resulting in a lower color reproducibility.

Examples of the quinacridone-based organic pigment may preferably include: C.I. Pigment Red 122, 192, 202, 206, 207 and 209; C.I. Pigment Violet 19; and a combination of C.I. Pigment Red 122 with another pigment, such as C.I. Pigment Red 1, 2, 3, 4, 5, 6, 7, 8, 9, 10, 11 12, 13, 14, 15, 16, 17, 18, 19, 21, 22, 23, 30, 31, 32, 337, 38, 39, 40, 41, 48, 49, 50, 51, 52, 53, 54, 55, 57, 58, 60, 63, 64, 68, 81, 83, 87, 88, 89, 90, 112, 114, 123, 146, 150, 163, 184, 185, 238; C.I. Pigment Violet 19; C.I. Vat Red 1, 2, 10, 13, 15, 23, 29, 35. It is possible to use a dye such as xanthene dye in combination with the above pigments.

The addition amount of such a quinacridone-based colorant may be 0.1–15 wt. parts, preferably 1–12 wt. parts, more preferably 1–10 wt. parts, per 100 wt. parts of the binder resin. In the case of using the quinacridone-based colorant in combination with other pigments and/or dyes, such other pigments and/or dyes may be used in an amount of at most 50 wt. parts, preferably at most 25. wt. parts, per 100 wt. parts of the quinacridone-based colorant.

Examples of the diarylide-based pigment may include: C.I. Pigment Yellow 55, 63, 83, 87, 90, 114, 121, 124, 126, 127, 136, 152, 170, 171, 172, 174, 176, and 188, preferably C.I. Pigment Yellow 12, 13, 14, 17, 81, 106 and 113. It is also possible to use C.I. Pigment Yellow 12, 13, 14, 17 and 81 as a base pigment in combination with other yellow pigments and/or dyes.

The addition amount of such a diarylide-based colorant may be 0.1–12 wt. parts, preferably 0.5–10, more preferably 1–8 wt. parts, per 100 wt. parts of the binder resin.

As the black colorant used in the present invention, it is possible to utilize carbon black or a mixture of the above mentioned yellow colorant/magenta colorant/cyan colorant so as to be formulated to assume black.

In the present invention, it is also possible to use as the black toner a magnetic toner containing a magnetic material as the black colorant.

The magnetic material usable in the present invention may comprise an iron oxide, such as magnetite, maghemite, ferrite; metals, such as iron, cobalt and nickel; and alloys or mixtures of these metals with other metals, such as aluminum, cobalt, copper, lead, magnesium, manganese, selenium, titanium and vanadium; preferably those containing a different (i.e., non-iron) element at the surface or within the magnetic material.

It is particularly preferred to use a magnetic iron oxide (e.g., magnetite, maghemite or ferrite) or its mixture, containing at least one element selected from lithium, beryllium, boron, magnesium, aluminum, silicon, phosphorus, germanium, titanium, zirconium, tin, lead, zinc, calcium, barium, scandium, vanadium, chromium, manganese, cobalt, copper, nickel, gallium, cadmium, indium, silver, palladium, gold, mercury, platinum, tungsten, molybdenum, niobium, osmium, strontium, yttrium, technetium, ruthenium, rhodium, and bismuth. It is particularly preferred to contain at least one of lithium, beryllium, boron, magnesium, aluminum, silicon, phosphorus, germanium, zirconium, tin, and transition metal elements on the fourth period in the periodic table.

Such a different element may be introduced into the crystal lattice of the iron oxide, incorporated as an oxide thereof in the iron oxide, or present as an oxide or a hydroxide thereon on the surface of the iron oxide particles. In a preferred embodiment, such a different element is contained as an oxide in the iron oxide.

The magnetic material particles may have a uniform particle size distribution, thus providing the resultant toner with a stable chargeability, in cooperation with a good dispersibility thereof in the binder resin. Further, while the toner particle size has been reduced in recent years, the toner thus obtained according to the present invention may be provided with an enhanced uniformity of chargeability and reduced toner agglomeratability, thus providing an increased image density and improved fog prevention effect, even at a weight-average particle size of at most 10 μm of the toner particles. The effect is particularly remarkable for a toner having a weight-average particle size of at most 6 μm, and a very high-definition image can be produced. A weight-average particle size of at least 2.5 μm is preferred in order to obtain a sufficient image density.

The above-mentioned different element may preferably be contained in 0.05–10 wt. % based on the iron element in the magnetic iron oxide. The content is more preferably be 0.1–7 wt. %, particularly preferably 0.2–5 wt. %, most preferably 0.3–4 wt. %. Below 0.05 wt. %, the addition effect of the different element is scarce, thus failing to achieve good dispersibility and uniformity of chargeability. Above 10 wt. %, the charge liberation is liable to be excessive to cause insufficient chargeability, thus resulting in a lower image density and an increased fog.

It is preferred that the different element is distributed so that it is richer in the vicinity of the surface of the magnetic iron oxide particles. For example, it is preferred that content B of the different element is present at the surface portion to be dissolved up to an iron dissolution percentage of 20% and the entire content A of the different element in the magnetic iron oxide satisfy a ratio [(B/A)×100] of at least 40%, preferably 40–80%, more preferably 60–80%. By increasing the proportion of the presence at the surface portion, the dispersibility and electrical diffusion effect of the different element can be improved.

The magnetic material usable in the present invention may be added in an amount of 20–200 wt. parts, preferably 40–150 wt. parts, per 100 wt. parts of the results component.

The magnetic material may preferably have a sphericity (ψ) of at least 0.8.

If the sphericity (ψ) is below 0.8, individual particles contact each other plane to plane, thus not readily separate them from each other in the case of smaller-sized magnetic iron oxide particles (e.g., particle size of ca. 0.1–1.0 μm) even under application of a mechanical shearing force. As a result, a sufficient dispersion of the magnetic iron oxide in the toner cannot be effected in some cases.

In order to enhance the dispersibility of the magnetic iron oxide (as the magnetic material) in the binder resin, the magnetic iron oxide used in the magnetic toner may be treated with a silane-coupling agent, a titanium coupling agent, titanate or aminosilane.

The different element quantity in the magnetic iron oxide may be measured by fluorescent X-ray analysis using a fluorescent X-ray analyzer (e.g., "SYSTEM 3080", mfd. by Rigaku Denki Kogyo K.K.) according to JIS K0119 "General Rules for Fluorescent X-ray Analysis").

The different element distribution may be measured by gradual fractional dissolution of the magnetic iron oxide particles with hydrochloric acid and measurement of the element concentration in the solution at each fractional dissolution relative to the element concentration in the complete solution, respectively according to ICP (inductively coupled plasma) emission spectroscopy.

The sphericity (ψ) of the magnetic iron oxide may be measured in the following manner.

A sample (of a magnetic iron oxide) is fixed on a collodion film held on copper mesh and subjected to observation through an electron microscope ("H-700H, mfd. by K.K. Hitachi Seisakusho) under application of an acceleration voltage of 100 kV at a final magnification of 30,000 (including a magnification of 10,000 and a printing magnification of 3) to measure a maximum length (axis diameter) and a minimum length (axis diameter) for respective particles. From the measured particles, at least 100 particles are selected at random. From averages of the minimum and maximum lengths for the at least 100 particles, the sphericity (ψ) is calculated from the following equation:

$$\text{Sphericity } (\psi) = \text{minimum length } (\mu m)/\text{maximum length } (\mu m)$$

The toner of the present invention may further contain a lubricant, such as aliphatic metal salt (e.g., zinc stearate or aluminum stearate) or fluorine-containing polymer fine powder (e.g., fine powder of polytetrafluoroethylene, polyvinylidene fluoride or tetrafluoroethylene-vinylidene fluoride copolymer), or an electroconductivity-imparting agent, such as tin oxide or zinc oxide, as desired.

The toner of the present invention may preferably contain inorganic fine powder or hydrophobic inorganic fine powder, such as those of silica, alumina and titanium oxide.

The silica fine powder usable in the present invention may include dry-process silica or fumed silica obtained by vapor-phase oxidation of a silicon halide and wet-process silica obtained from, e.g., water glass, preferably dry-process silica due to less silanol group at the surface and inside thereof and no production residue.

The silica fine powder may preferably be subjected to a hydrophobicity-imparting treatment (hydrophobization), e.g., by chemically treating the powder with an organosilicone compound, etc., reactive with or physically adsorbed by the powder.

In a preferred embodiment, dry-process silica fine powder formed by vapor-phase oxidation of a silicon halide is treated with an organosilicone compound such as a silicone oil after or simultaneously with treatment with a silane coupling agent.

Example of such a silane coupling agent for hydrophobization may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

The organosilicone compound may include silicone oils, such as dimethylsilicone oil, methylphenylsilicone oil, α-methylstyrene-modified silicone oil, chlorophenylsilicone oil and fluorine-modified silicone oil, preferably those having a viscosity at 25° C. of 30–1000 mPa.s.

The treatment with the silicone oil may be performed by directly blending the silica fine powder treated with the silane coupling agent with a silicone oil by means of a blender, such as Henschel mixer or by spraying a silica on an objective silica fine powder. It is also possible to blend a silicone oil dissolved or dispersed in an appropriate solvent with an objective silica fine powder, followed by removal of the solvent.

The toner according to the present invention can further contain other external additives, inclusive of fine resin particles and inorganic fine particles, functioning as a charging aid, an electroconductivity-imparting agent, a flowability-imparting agent, an anti-caking agent, a release agent for hot roller fixation, a lubricant, or abrasive.

Preferred examples of the lubricant may include: powders of polytetrafluoroethylene, zinc stearate and polyvinylidene fluoride; among which polyvinylidene fluoride powder is particularly preferred. Examples of the abrasive may include: powders of cerium oxide, silicon carbide and strontium titanate, among which strontium titanate powder is particularly preferred. The flowability-improving agents may include: titanium oxide powder and aluminum oxide powder, which are preferably hydrophobized. The electroconductivity-imparting agents may include carbon black powder, zinc oxide powder, antimony oxide powder and tin oxide powder. It is also possible to a small amount of white fine particles and black fine particles of opposite polarity as a developing performance-improving agent.

The (hydrophobic) inorganic fine powder may be used in an amount of 0.1–5 wt. parts, preferably 0.1–3 wt. parts, per 100 wt. parts of the toner.

The toner according to the present invention may be prepared through a process including: sufficiently blending above-mentioned ingredients (including the binder resin, the colorant, the wax and optional ingredients, such as the magnetic material, the organic metal compound and/or other additives), by means of a blender such as a Henschel mixer or a ball mill, melting and kneading the blend by hot kneading means such a hot rollers, a kneader or an extruder, and cooling and solidifying the kneaded product, followed by pulverization and classification, to recover toner particles.

Various machines as the blender are commercially available for the above process. Several examples thereof are enumerated below together with the makers thereof. For example, the commercially available blenders may include: Henschel mixer (mfd. by Mitsui Kozan K.K.), Super Mixer (Kawata K.K.), Conical Ribbon Mixer (Ohkawara Seisakusho K.K.); Nautamixer, Turbulizer and Cyclomix (Hosokawa Micron K.K.); Spiral Pin Mixer (Taiheiyo Kiko K.K.), Lodige Mixer (Matsubo Co. Ltd.). The kneaders may include: Buss Cokneader (Buss Co.), TEM Extruder (Toshiba Kikai K.K.), TEX Twin-Screw Kneader (Nippon Seiko K.K.), PCM Kneader (Ikegai Tekko K.K.); Three Roll Mills, Mixing Roll Mill and Kneader (Inoue Seisakusho K.K.), Kneadex (Mitsui Kozan K.K.); MS-Pressure Kneader and Kneadersuder (Moriyama Seisakusho K.K.), and Bambury Mixer (Kobe Seisakusho K.K.). As the pulverizers, Cowter Jet Mill, Micron Jet and Inomizer (Hosokawa Micron K.K.); IDS Mill and PJM Jet Pulberizer (Nippon Pneumatic Kogyo K.K.); Cross Jet Mill (Kurimoto Tekko K.K.), Ulmax (Nisso Engineering K.K.), SK Jet O. Mill (Seishin Kigyo K.K.), Krypron (Kawasaki Jukogyo K.K.), and Turbo Mill (Turbo Kogyo K.K.). As the classifiers, Classiell, Micron Classifier, and Spedic Classifier (Seishin Kigyo K.K.), Turbo Classifier (Nisshin Engineering K.K.); Micron Separator and Turboplex (ATP); Micron Separator and Turboplex (ATP); TSP Separator (Hosokawa Micron K.K.); Elbow Jet (Nittetsu Kogyo K.K.), Dispersion Separator (Nippon Pneumatic Kogyo K.K.), YM Microcut (Yasukawa Shoji K.K.). As the sieving apparatus, Ultrasonic (Koei Sangyo K.K.), Rezona Sieve and Gyrosifter (Tokuju Kosaku K.K.), Vitrasonic System (Dolton K.K.), Sonicreen (Shinto Kogyo K.K.), Turboscreener (Turbo Kogyo K.K.), Microshifter (Makino Sangyo K.K.), and circular vibrating sieves.

When the toner of the present invention is used in a two-component type developer, a carrier may include particles of a magnetic material selected from the group consisting of surface-oxidized or unoxidized magnetic metals, such as iron, nickel, copper, zinc, cobalt, manganese, chromium and rare earth metals; manganese, chromium and rare earth metals; magnetic alloys of these metals; magnetic oxides of these metals or alloys; and magnetic ferrites of these metals or alloys.

It is also possible to use a binder-type carrier comprising a binder resin and magnetic powder dispersed in the binder resin.

As the carrier, it is preferred to use a coated carrier comprising the above-mentioned magnetic particles (as a carrier core) and a coating material coating the surface of the magnetic particles.

The coating of the carrier core surface may be performed by wet-applying a coating liquid comprising a coating material dissolved or dispersed in a solvent onto the carrier core surface or by supply blending the coating material and the carrier core in a powdery form.

Examples of the coating material for coating the carrier core may include: polytetrafluoroethylene, monochlorotrifluoroethylene polymer, polyvinylidene fluoride, silicone resin, polyester resin, styrene resin, acrylic resin, polyamide, polyvinylbutyral, and aminoacrylate resin. These resins (polymers) may be used alone or in combination of two or more species.

The entire coating amount of the coating material may appropriately be determined, preferably be in a range of 0.1–30 wt. %, more preferably 0.5–20 wt. %, per the weight of the carrier.

The carrier usable in the present invention may preferably have an average particle size of 10–100 $\mu$m, more preferably 20–70 $\mu$m.

If the average particle size of the carrier is below 10 $\mu$m, the resultant packing density of the two-component type developer is increased to lower a mixing characteristic of the toner with the carrier, thus not readily stabilizing toner chargeability and being liable to cause sticking of the carrier onto the surface of a photosensitive member.

If the average particle size of the carrier exceeds 100 $\mu$m, contact opportunity of the carrier with the toner is decreased to include a portion of the toner having low triboelectric chargeability, thus causing fogs. Further, toner scattering is liable to occur and it is necessary to set a toner concentration in the two-component type developer to lower level, thus failing to effect image formation with a high image density in some cases.

As a particularly preferable carrier, it is possible to employ a magnetic carrier which is prepared by coating the surface of magnetic core particles (e.g., magnetic ferrite core particles) with 0.01–5 wt. % (preferably 0.1–1 wt. %) of a resin (e.g., silicone resin, fluorine-containing resin, styrene resin, acrylic resin, or methacrylic resin) so as to include at least 70 wt. % of carrier particles of 250 mesh-pass and 400 mesh-on and the above-mentioned average particle size (10–100 $\mu$m).

If the magnetic resin-coated carrier has a sharp particle size distribution, it is possible to provide the color toner of the present invention with a preferred triboelectric chargeability and improved electrophotographic characteristics.

In the case where the color toner and the carrier are blended to prepare a two-component-type developer, the toner may preferably have a (toner) concentration in the developer of 2–15 wt. %, more preferably 3–13 wt. %, further preferably 4–10 wt. %, in view of achievement of good results.

If the toner concentration is below 2 wt. %, the resultant image density is liable to be lowered. Above 15 wt. %, fog and scattering within an apparatus are liable to occur to provide a shorter life of the resultant developer.

Hereinbelow, the image forming method according to the present invention will be described.

The image forming method of the present invention includes: a charging step of charging an electrostatic latent image-bearing member; a latent image-forming step of forming an electrostatic latent image on the charged latent image-bearing member; a developing step of developing the latent image with the above-mentioned toner of the present invention to form a toner image; a transfer step of transferring the toner image onto a recording material via or without via an intermediate transfer member; and a fixing step of fixing the toner image on the recording material by causing a fixing member to contact the surface of the toner image under application of heat and pressure.

In the fixing step, the fixing member supplies a silicone oil as a release agent to a fixing surface of the toner image in an amount of $0–1\times10^{-7}$ g/cm$^2$, preferably $0–1\times10^{-8}$ g/cm$^2$, per unit area of the recording material.

If the silicone oil application amount exceeds $1\times10^{-7}$ g/cm$^2$, the resultant image is undesirably provided with a tacky feel of the silicone oil.

In a preferred embodiment, the image forming method of the present invention includes an oil-less fixing step, i.e., a fixing step wherein the silicone oil is not supplied to the toner image (substantially 0 g/cm$^2$ of the silicone oil amount present at the fixing surface of the toner image on the recording material).

The supply of the silicon oil may be performed by using a fixing member provided with web, pad or roller impregnated with the silicone oil (release agent) or a silicone rubber roller (as the fixing member) impregnated with the silicone oil.

In the present invention, however, it is preferred to employ a fixing member without using an auxiliary means for applying and/or supplying the release agent (silicone oil) to the surface contacting the toner image formed on the recording material. This is because the supply (application) amount of the release agent from the fixing member varies between an initial stage and at the time of a long-term use, thus being liable to cause fluctuation in resultant image qualities (e.g., occurrence of the tacky feel of the silicone oil). As a result, it is necessary to employ a complicated supply (application) mechanism for providing a uniform supply amount of the release agent. Further, when a new small amount of the release agent (as in the present invention) is supplied by using a simple means, irregularity in oil application is liable to occur, thus leading to irregularity in applied oil amount on the resultant toner image to considerably lower image qualities.

In the charging step of the image forming method of the present invention, a charging member may include: a non-contact charging member, such as corona charger, for effecting charging of the latent image-bearing member in a non-contact state with the surface of the latent image-bearing member; a contact charging member, such as those using a blade, roller or a brush, for effecting the charging in a contact state with the latent image-bearing member surface; and a proximity charging member for effecting the charging in a close contact (proximity) state (e.g., a distance from the latent image-bearing member surface of at most 1 mm) with the latent image-bearing member.

In view of less occurrence of ozone at the time of charging, it is preferred to use the contact or proximity charging member.

The contact charging is a charging system wherein a photosensitive member as the latent image-bearing member is caused to contact a charging member as a charge-providing member of a roller-type, blade-type, brush-type or magnetic brush-type and then is uniformly charged to have a prescribed polarity and potential by applying a prescribed bias voltage to the contact charging member. Compared with a corona charger, the contact charging member has the advantages of lower-voltage power supply, less occurrence of ozone and lower power consumption. A roller charging system using an electroconductive (charging) roller as the contact charging member is particularly preferred in view of charging stability.

Specifically, the charging is effected by discharge from the charging member to a member to be charged, so that the charging starts by application of a voltage of at least a certain threshold value. For example, in the case where the charging roller is pressed against an organic photosensitive member, a surface potential of the photosensitive member starts to increase when a voltage of at least ca. 640 V is applied and then is monotonous and linearly increased at a slope of 1 depending on the applied voltage. Hereinafter, the threshold voltage is referred to as a discharge (charge) initiation voltage (Vth) (a voltage applied to the contact charging member in the case where the charging of the latent image-bearing member as the member to be charged starts by applying a DC voltage to the contact charging member).

Such a charging system wherein only the DC voltage is applied to the contact charging member is referred to as "DC charging system".

In the DC charging system, however, an electrical resistance of the contact charging member fluctuates depending on change in environmental condition and when the thickness of the photosensitive member is charged due to abrasion thereof, the discharge initiation voltage (Vth) also thereof, thus being difficult to control the surface potential of the photosensitive member at a desired level.

In order to provide further uniform charging, JP-A 63-149669 has proposed an "AC charging system" wherein a DC voltage, corresponding to the surface potential (V) of a desired member to be charged, superposed with an AC voltage component having a peak-to-peak voltage of at least 2×Vth (i.e., a voltage changing periodically in its value with time, such as AC voltage, pulse voltage or oscillating voltage) is applied to the contact charging member. This system is used for uniformizing the potential by AC voltage application. This potential of the member to be charged is converged at a potential (V) which is a center of the peak value of the AC voltage and is not disturbed by, e.g., environmental conditions, thus providing an excellent charging method.

As a waveform of the AC voltage, it is possible to use a sine wave, a rectangular wave and a triangular wave. It is also employ a rectangular wave formed by periodically turning the DC power supply on and off. Other waveforms (bias voltages) periodically changing in voltage may be adopted.

When the charging roller is pressed against a member to be charged at an abutting pressure of 5– 500 g/cm, a DC voltage superposed with an AC voltage may preferably include a peak-to-peak (AC) voltage of 0.5–5 kV, AC frequency of 50–5 kHz and DC voltage of ±0.2–1.5 kV, and the DC voltage may preferably have a voltage value of ±0.2–1.5 kV.

The contact charging system may also include an injection or charging system wherein electric charges are directly injected into a charge injection layer (charging layer) provided to the surface of the latent image-bearing member as the member to be charged by using the contact charging member supplied with a voltage, thus charging the surface of the latent image-bearing member to prescribed polarity and potential.

A proximity charging system is a non-contact charging system for charging the member to be charged in a non-contact state close to the member and ensures a dischargeable region determined by a gap voltage and a Paschen curve between the charging member and the member to be charged (not in contact with the charging member).

According to the proximity charging system, the charging member is disposed opposite to the member to be charged with a gap of ca. several ten to several hundred microns (in a non-contact state) and is supplied with the DC voltage or the DC voltage superposed with the AC voltage to uniformly charge the surface of the member to be charged to prescribed polarity and potential.

The proximity charging system, compared with the corona charging, a low-voltage power supply can be used and ozone is less generated. In addition, the charging member does not contact the member to be charged, thus not damaging the member to be charged.

The latent image-bearing member includes an electrophotographic photosensitive member or electrostatic recording dielectric member having a photoelectric insulating material layer comprising amorphous selenium, cadmium sulfide, zinc oxide, organic photoconductor, amorphous silicon, etc., and formed in a drum or belt form. Of these members, a photosensitive member having an amorphous silicon or organic photosensitive layer.

The organic photosensitive member may have a single layer structure comprising a layer containing a charge-generating material and a charge-transporting material and a function-separation layer structure comprising a charge generation layer and a charge transport layer, preferably a function-separation layer structure comprising an electroconductive support, a charge generation layer disposed on the electroconductive support, and a charge transport layer formed on the charge generation layer.

The organization of the respective layers will be described below in further detail.

The electroconductive support may comprise a metal, such as aluminum or stainless steel, a plastic coated with a layer of aluminum alloy or indium oxide-tin oxide alloy, paper or a plastic sheet impregnated with electroconductive particles, or a plastic comprising an electroconductive polymer in a shape of a cylinder or a sheet. Such an electroconductive support may be prepared by forming the electroconductive material per se in a drum or belt (sheet) shape or applying a coating liquid containing the material or effecting various treatments, such as vapor deposition, etching and plasma treatment.

On the electroconductive support, it is possible to dispose an undercoating layer for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethylene-acrylic acid copolymer, polyvinyl butyral, phenolic resin, casein, polyamide, copolymer nylon, glue, gelatin, polyurethane, or aluminum oxide. The thickness may ordinarily be 0.1– 10 $\mu$m, preferably 0.1–3 $\mu$m.

The charge generation layer 113 may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as selenium and amorphous silicon, in the form of a dispersion in a film of an appropriate binder resin or a vapor deposition film thereof. The binder resin may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, preferably 0–40 wt. %, of the charge generation layer. The charge generation layer may preferably have a thickness of at most 5 $\mu$m, preferably 0.05–2 $\mu$m.

A charge transport layer 114 has a function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may ordinarily be 5–40 $\mu$m. Examples of the charge transporting substance may include: polycyclic aromatic compounds having in their main chain or side chain a structure such as biphenylene, anthracene, pyrene or phenanthrene; nitrogen-containing cyclic compounds, such as indole, carbazole, oxadiazole, and pyrazoline; hydrazones, styryl compounds and amorphous silicon.

Examples of the binder resin for dissolving or dispersing therein the charge transporting substance may include: resins, such as polycarbonate resin, polyester resin, polystyrene resin, acrylic resins, and polyamide resins; and organic photoconductive polymers, such as poly-N-vinylcarbazole and polyvinyl-anthracene.

As described above, it is possible to further dispose a surface protective layer. The protective layer may comprise a resin, such as polyester, polycarbonate, acrylic resin, epoxy resin, phenolic resin or a product obtained by curing these resins in the presence of a hardener. These resins may be used singly or in combination of two or more species.

It is possible to disperse electroconductive fine particles in the protective layer resin. The electroconductive particles may be fine particles of a metal or a metal oxide. Specific examples thereof may include: fine particles of materials, such as zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in combination of two or more species. In case of dispersing electroconductive fine particles in the protective layer, it is generally preferred that the electroconductive particles have a particle size smaller than the wavelength of incident light in order to avoid the scattering of the incident light with the electroconductive fine particles. Accordingly, the electroconductive particles dispersed in the protective layer may preferably have an average particle size of at most 0.5 $\mu$m. The content thereof may preferably be 2–90 wt. %, more preferably 5–80 wt. % of the total weight of the protective layer. The protective layer may have a thickness of 0.1–10 $\mu$m, preferably 1–7 $\mu$m.

The surface layer may be formed by applying a resin dispersion liquid by spray coating, beam coating or dip coating.

It is also preferred to impart a releasability to the surface layer, thus improving a transfer efficiency of the toner according to the present invention.

In the case where the surface of the latent image-bearing member principally comprise a polymeric binder material, e.g., a resinous protective film formed on an inorganic photosensitive member or the function separation type photosensitive member has a surface charge transport layer comprising a charge-transporting material and a binder resin or further has a protective layer on the surface layer, the releasability-imparting treatment is particularly effective.

The impartment of releasability to the surface layer may be performed by (i) using a film-forming resin per se having a low surface energy, (ii) adding an additive for imparting water-repellent or lipophiric property, and (iii) dispersing a material having a high releasability in a powdery form.

The method (i) may be achieved by introducing a fluorine- or silicon-containing group into a resin structure. The method (ii) may be achieved by addition a surfactant. The method (iii) may be achieved by dispersing powder of fluorine-containing compound, such as tetrafluoroethylene, polyvinylidene fluoride or fluorinated carbon, particularly preferably tetrafluoroethylene. Among these methods, it is particularly suitable to disperse a powdery release agent such as fluorine-containing resin powder in the surface (outermost) layer.

The surface layer comprising the above powdery material is formed on the latent image-bearing member by dispersing the powdery material in the binder resin and coating the resultant liquid onto the surface of the member or in the case of an organic image-bearing member comprising principally a resin, it is possible to disperse the powdery material in its outermost layer.

The powdery material may be added in the surface layer in an amount of 1–60 wt. %, preferably 2–50 wt. %, per the total weight of the surface layer.

If the addition amount of the powdery material is below 1 wt. %, a transfer efficiency is not improved and above 60 wt. %, a film strength or incident light quantity to the image-bearing member is undesirably lowered.

The powdery material may preferably have a particle size of at most 1 $\mu$m, more preferably at most 0.5 $\mu$m. Above 1 $\mu$m, incident light is scattered, thus imparting line reproducibility.

In a preferred embodiment, the surface layer comprises the charge injection layer.

The charge injection layer may preferably have a volume resistivity of $1\times10^{8}$–$1\times10^{15}$ ohm.cm in view of sufficient chargeability and suppression of image flow, more preferably $1\times10^{10}$–$1\times10^{15}$ ohm.cm in view of further suppression of image flow, further preferably $1\times10^{10}$–$1\times10^{14}$ ohm.cm in view of environmental fluctuation of the volume resistivity.

If the volume resistivity is below $1\times10^{8}$ ohm.cm, charges are not retained at the surface layer in a high-humidity environment to cause image flow. Above $1\times10^{15}$ ohm.cm, it is difficult to sufficiently inject and hold the charges from the charging member, thus being liable to cause charging failure. By disposing such a functional charge injection layer at the photosensitive member surface, it is possible to hold the injected charges from the charging member and cause the charges to pass toward the support of the photosensitive member at the time of exposure, thus deducing a residual potential.

By using such a contact charging member for injection charging and the photosensitive member in combination, it becomes possible to realize a low charge initiation voltage Vh and charge the photosensitive member to a potential which is ca. 90% or higher of the voltage applied to the charging member. For example, when a charging member is supplied with a DC voltage of 100–2000 volts, in terms of an absolute value, a photosensitive member having a charge injection layer can be charged to a potential which is 80% or higher, further 90% or higher, of the applied voltage. In contrast thereto, according to the conventional charging method utilizing discharge, a photosensitive member can only be charged to a potential which is nearly 0 at an applied voltage of at most the charge initiation voltage Vh or below 50% even at an applied voltage of 1000 V as a DC voltage.

The charge injection layer may preferably be formed as an inorganic layer o a metal-deposited film or a layer of binder resin containing electroconductive particles dispersed therein. The inorganic layer may be formed through deposition of metal. The conductive particles-dispersed resin layer may be formed by an appropriate coating method, such as dipping, spraying, roller coating or beam coating. Further the charge injection layer can also be formed with a mixture or copolymer of an insulating binder resin and a light-transmissive resin having a high ion-conductivity, or a photoconductive resin having a medium conductivity alone. In order to constitute the conductive particle-dispersed resin layer, the electroconductive particles may preferably be added in an amount of 2–250 wt. parts, more preferably 2–190 wt. parts, per 100 wt. parts of the binder resin. Below 2 wt. parts, it becomes difficult to obtain a desired volume resistivity. In excess of 250 wt. parts, the resultant charge injection layer is caused to have a lower film strength and is therefore liable to be worn out by scraping, thus resulting in a short life of the photosensitive member. Further, as the resistance is lowered, the latent image potential is liable to be flowed to result in inferior images.

The binder resin of the charge injection layer may include polyester resin, polycarbonate resin, acrylic resin, phenolic resin and a mixture of these resins cured by using a hardener. These resins may be used singly or in combination of two or more species.

The binder resin of the charge injection layer can be identical to those of lower layers, but, in this case, the charge transport layer is liable to be disturbed during the application of the charge injection layer, so that a particular care has to be exercised in selection of the coating method.

In the case of using the amorphous silicon-type photosensitive layer, the charge injection layer may preferably comprise SiC.

In the case where a large amount of the conductive particles are dispersed, the conductive particles may preferably be dispersed in a reactive monomer or oligomer and the resultant liquid is coated on the photosensitive member, followed by curing through light or heat.

Examples of the conductive particles may include fine particles of metals or metal oxides, such as zinc oxide, titanium oxide, tin oxide, antimony oxide, indium oxide, bismuth oxide, tin oxide-coated titanium oxide, tin-coated indium oxide, antimony-coated tin oxide, and zirconium oxide. These particles may be used singly or in combination of two or more species. The conductive particles or insulating particles contained in the charge injection layer may preferably have a particle size of at most 0.5 $\mu$m.

The charge injection layer may preferably further contain lubricant particles, so that a contact (charging) nip between the photosensitive member and the charging member at the time of charging becomes enlarged thereby due to a lowered friction therebetween, thus providing an improved charging performance. The lubricant powder may preferably comprise a fluorine-containing resin, silicone resin or polyolefin resin having a low critical surface tension. Polytetrafluoroethylene (PTFE) resin is further preferred. In this instance, the lubricant powder may be added in 2–50 wt. parts, preferably 5–40 wt. parts, per 100 wt. parts of the binder resin. Below 2 wt. parts, the lubricant is insufficient, so that the improvement in charging performance is insufficient. Above 50 wt. parts, the image resolution and the sensitively of the photosensitive member are remarkably lowered.

The charge injection layer may preferably have a thickness of 0.1–10 μm, particularly 1–7 μm. Below 0.1 μm, a resistance to minute scars is little exhibited to cause image defects due to injection failure. Above 10 μm, diffusion of the injected carriers is caused to occur, thus being liable to cause image flow.

The volume resistivity values of the charge injection layer described herein are based on values measured according to a method wherein a charge injection layer is formed on a conductive film (e.g., Au)-deposited PET film and subjected to measurement of a volume resistivity by using a volume resistivity measurement apparatus ("4140B PAMATER", available from Hewlett-Packard Co.) under application of a voltage of 100 volts in an environment of 23° C. and 65%RH.

In the case of a photosensitive member having no charge injection layer, it is necessary to efficiently injecting charges in less trap points, so that the resistance of the charging member is required to be relatively small. If the resistance is at most $1\times10^4$ ohm, excessive leak current from the contact charging member passes through scars or pinholes generated at the photosensitive member surface, thus causing charging failure in adjacent regions, enlargement of pinholes and electrical breakdown of the charging member. As a result, it is difficult to effect a good charge injection. In contrast thereto, in the case of forming the charge injection layer, a region capable of holding the charges at the photosensitive member surface is enlarged, thus effecting good charging even in the case of using a higher-resistance charging member. As described above, in order to improve the charging efficiency of the photosensitive member by the injection charging system in combination with the medium-resistance contact charging member, it is necessary to employ the charge injection layer for assisting better charge injection into the photosensitive member.

The injection charging may be considered to be based on such a mechanism that charge injection from the charging member surface to the photosensitive member surface is effected y causing the charging member surface to contact the photosensitive member surface. Accordingly, the charging member is required to have a sufficient density and an appropriate resistance for charge movement at the charge injection layer surface.

When the medium-resistance photosensitive member surface is subjected to charge injection by the medium-resistance contact charging member, charges may preferably be not injected to a trap potential of the surface layer material of the photosensitive member but injected to the conductive particles dispersed in the light-transmissive and insulating binder resin within the charge injection layer.

Specifically, such a charge injection is based on charging of electrical charges in a minute capacitor structure comprising a charge transport layer (as a dielectric body) disposed between an aluminum support (as a first electrode) and electroconductive particles (as a second electrode) within the charge injection layer by using the contact charging member.

At that time, the conductive particles are mutually electrically independent from each other, thus forming some minute floating electrodes, respectively. For this reason, the photosensitive member surface appears to be uniformly charged macroscopically but is actually in such a state that a lot of minute charged conductive particles cover the surface of the photosensitive member. Accordingly, the respective conductive particles are still independent of each other even when subjected to imagewise exposure, thus being capable of holding the electrostatic latent image.

The trap potential level conventionally present at the surface of an ordinary photosensitive member in ia small amount is replaced with the conductive particles, thus improving charge injection and holding performances.

The charging member for injection charging may preferably have a resistance of $1\times10^4$–$1\times10^7$ ohm.cm in view of the charge injection performance and anti-pinhole-leaking property.

The injection charging member may be shaped in a roller form, a blade form or a brush form. In order to appropriately set a difference in peripheral speed between the charging member and the photosensitive member, a rotatable charging member in a roller form, belt form or brush roller form may advantageously be employed.

As a material of the electroconductive support for the roller-shaped contact charging member, as described in JP-A 1-211799, it is possible to sue metals, such as iron, copper and stainless steel, carbon-dispersed resin, metal or metal oxide-dispersed resin.

On the electroconductive support, an elastic layer, an electroconductive layer and a resistive layer are successively formed.

Examples of the elastic layer may include: rubbers, such as chloroprene rubber, isoprene rubber, EPDM rubber, polyurethane rubber, epoxy rubber, and butyl rubber; sponges; and thermoplastic elastomers, such as those of styrene-butadiene type, polyurethane-type, polyester-type and ethylene-vinyl acetate type.

The electroconductive layer has a volume resistivity of at most $1\times10^7$ ohm.cm, preferably $1\times10^6$ ohm.cm. Examples of the electroconductive layer may include a metal-deposition film, an electroconductive particle-dispersed resin layer and an electroconductive resin layer. The metal-deposition film may comprise a metal, such as aluminum, indium, nickel, copper and iron. The electroconductive particles-dispersed resin layer may be formed by dispersing electroconductive particles, such as particles of carbon, aluminum, nickel, and titanium oxides in a resin, such as urethane resin, polyester resin, vinyl acetate-vinyl chloride copolymer or polymethyl methacrylate. The electroconductive resin may include quaternary ammonium salt-containing polymethyl methacrylate, polyvinylaniline, polyvinylpyrrole, polydiacetylene, and polyethyleneimine.

The resistive layer may, e.g., have a volume resistivity of $1\times10^6$–$1\times10^{12}$ ohm.cm and may comprise a semiconductor resin and electroconductive particle-dispersed insulating resin. Examples of the semiconductor resin may include ethyl cellulose, nitro cellulose, methoxymethylated nylon, ethoxymethylated nylon, copolymer nylon, polyvinyl pyrrolidone, and casein. The electroconductive particle-dispersed insulating resin may be prepared by dispersing electroconductive particles, such as particles of carbon, aluminum, indium oxide and titanium oxide in an insulating resin, such as urethane resin, polyester resin, vinyl acetate-vinyl chloride copolymer and polymethyl methacrylate in a small amount.

On the surface of the roller-type contact charging member, a releasing film, such as nylon-type resin, PVDF (polyvinylidene fluoride) or PVDC (polyvinylidene chloride) may be formed.

The roller-type contact charging member may be rotated mating with the photosensitive member by pressing it against the photosensitive member or may be driven for rotation by an additional driving power supply so as to provide a difference in peripheral speed with the photosensitive member.

In the case of mating rotation with the photosensitive member in an abutting state, it is not necessary to employ an additional driving power supply, thus simplifying the structure of the resultant image forming apparatus to be suitable for small-sized apparatus.

In the case of driving for rotation with a difference in peripheral speed with the photosensitive member, it is possible to achieve charging stability for a long term and long life of the photosensitive member and the charging roller in combination, thus resulting in high stable charging and long life of the image forming system. Specifically, the toner particles are liable to attach to the contact charging member surface to impair charging performance. By setting different surface-moving (rotating) speeds between the photosensitive member and the contact charging member, a larger surface area of the contact charging member substantially contacts the photosensitive member surface, thus effectively suppressing the charging failure. More specifically, when the toner is carried to a charging position, a toner having a smaller attaching force to the photosensitive member is moved toward the charging member by the electric field, thus changing locally the resistance of the charging member surface. As a result, a discharge passage is interrupted and thus the photosensitive member surface is not readily provided with a potential, thus effectively solving the problem of occurrence of the charging failure.

In the step of forming the latent image, it is possible to use a known means, such as laser or LED as the imagewise exposure means. In view of recent demands on high resolution and high image qualities, the exposure means may preferably be one capable of providing a smaller exposure spot area (diameter), particularly a laser exposure means i view of exposure power.

In the developing step, as the developing means for developing the electrostatic latent image, it is possible to use a mono-component-type developing system using a mono-component developer or a two-component-type developing system using a toner and a carrier.

The mono-component-type developing system may include a method wherein a mono-component magnetic developer comprising a magnetic toner (containing a magnetic material therein) is conveyed and charged by utilizing a magnetic constraint force due to a magnet enclosed in a developing sleeve to effect developing; and a method wherein a mono-component-type non-magnetic developer comprising a non-magnetic toner containing no magnetic material is forcely pressed against a developing sleeve to be triboelectrically charged and attached to the developing sleeve, followed by conveyance to effect development.

The mono-component-type developing method may be classified into a contact mono-component developing method wherein developing is performed by causing a mono-component developer layer carried on the developer-carrying member to contact the photosensitive member surface and a non-contact mono-component developing method wherein developing is performed in a non-contact state by causing the mono-component developer layer carried on the developer-carrying member to be spaced apart from the photosensitive member surface.

Hereinbelow, the non-contact mono-component developing method will be described.

The non-contact mono-component developing method uses a mono-component developer comprising a magnetic or non-magnetic toner.

Figure 8:
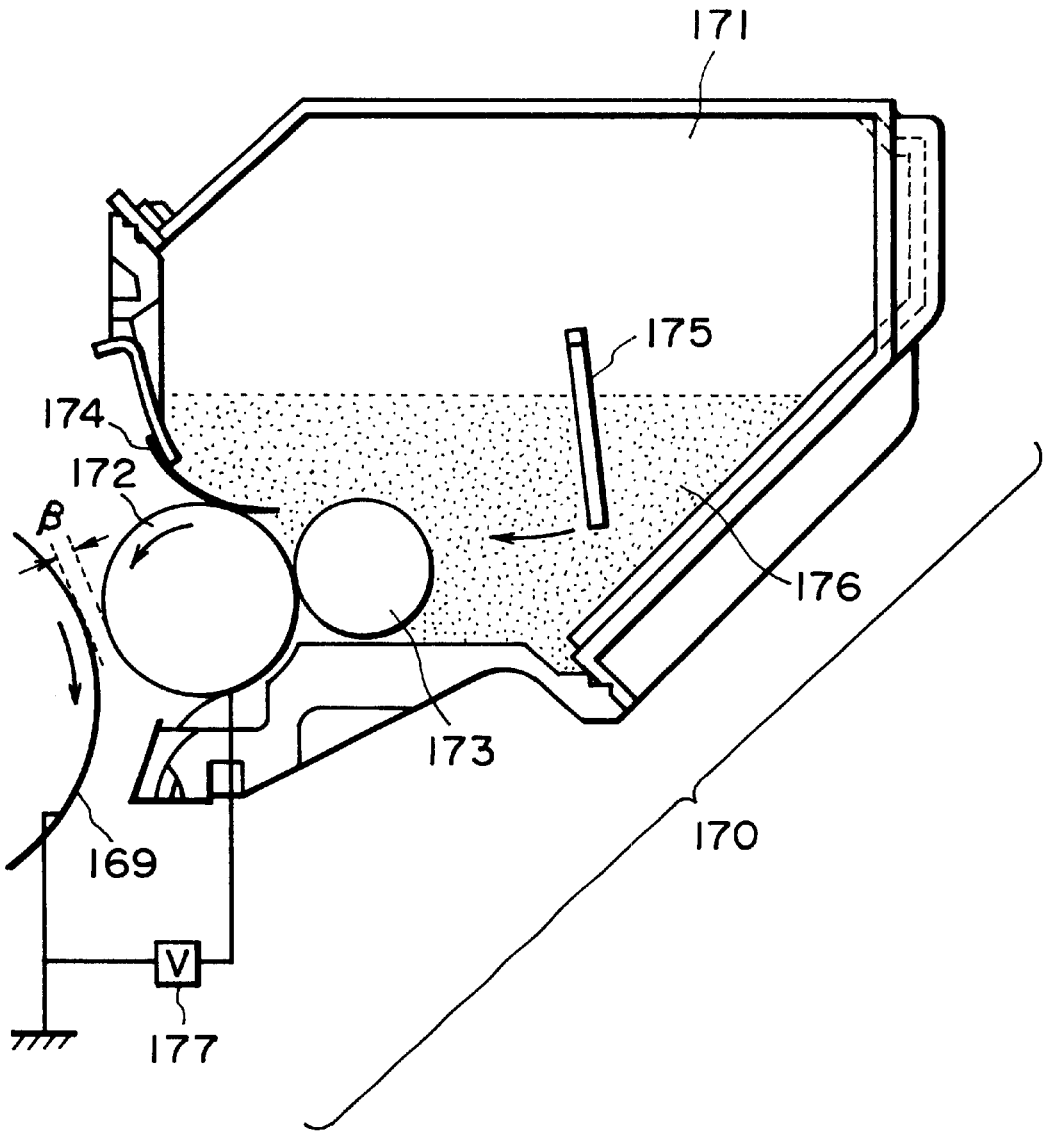
FIGS. 8–10 are schematic sectional views showing developing devices according to a non-contact type monocomponent developing scheme, a contact-type monocomponent developing scheme and a two-component developing scheme, respectively.

FIG. 8 shows a sectional view of a developing apparatus using a non-magnetic mono-component developer comprising a non-magnetic toner.

A developing apparatus 170 includes: a developer container 171 containing a non-magnetic mono-component developer 176 containing a magnetic toner, a developer-carrying member 172 for carrying the mono-component developer 176 contained in the developer container 171; a supply roller 173 for supplying the mono-component developer 176 to the developer-carrying member 172; an elastic blade 174 as a developer layer thickness-regulating member for regulating a developer layer thickness on the developer-carrying member 172; and a stirring member 175 for stirring the mono-component developer 176 contained in the developer container 171.

A latent image-bearing member 169 is disposed opposite to the developer-carrying member 172 with a gap β therebetween.

Formation of a latent image is performed by electrophotographic process means or electrostatic recording means (not shown).

The developer-carrying member 172 comprises a developing sleeve consisting of a non-magnetic sleeve formed of aluminum or stainless steel.

The developing sleeve may be prepared by using aluminum or stainless steel pipe as it is but may preferably have a uniformly roughened surface provided by blasting glass beads or a surface which is mirror-finished or coated with a resin.

The mono-component non-magnetic developer 176 is contained in the developer container 171 and supplied to the developer-carrying member 172 via the supply roller 173. The supply roller 173 is formed of a foamed material such as polyurethane foam and rotated at a non-zero speed relative to the developer-carrying member 172 in a forward or reverse direction thus also effecting removal of the developer (yet-undeveloped developer) after the developing remaining on the developer-carrying member 172 in addition to the supply of the developer.

The mono-component developer supplied onto the developer-carrying member 172 is uniformly and thinly applied by an elastic (application) blade as the developer layer thickness-regulating member 174.

The elastic blade 174 is generally pressed against the developer-carrying member 172 at an abutting pressure (as a linear pressure in a generatrix direction of the developing sleeve) of 0.3–25 kg/m, preferably 0.5–12 kg/m.

If the abutting pressure is below 0.3 kg/m, it becomes difficult to effect uniform application of the mono-component non-magnetic developer to broaden the charge amount distribution of the developer, thus leading to fog or scattering. Above 25 kg/m, a larger pressure is exerted on the developer to deteriorate the developer, thus undesirably causing agglomeration of the developer. Further, it is necessary to require a large torque for driving the developer-carrying member. By adjusting the abutting pressure in a range of 0.3–25 kg/m, it becomes possible to effectively cause deflocculation of the agglomerated developer and instantaneously effect quick increase in charging amount of the developer.

The developer layer thickness-regulating member may comprise the elastic blade described above or an elastic roller. A material for the elastic blade or roller may preferably have a triboelectric chargeability suitable for charging the developer to a desired polarity.

Examples of such a material may include: silicone rubber, urethane rubber, styrene-butadiene rubber, optionally coated with an organic resinous layer of a resin, such as polyamide, polyimide, nylon, melamine, melamine-crosslinked nylon, phenolic resin, fluorine-containing resin, silicone resin, polyester resin, urethane resin and styrene-based resin. It is preferred to prepare an elastic blade by using the above electroconductive rubber and resin and dispersing an additive including filler, such as metal oxide, carbon black, inorganic whisker or inorganic fiber, or a charge control agent, thus providing appropriate electroconductivity and charge-imparting property to the resultant elastic blade thereby to appropriately charge the mono-component non-magnetic developer.

In the above non-magnetic mono-component developing method, when a thin mono-component non-magnetic developer layer is coated on the developing sleeve by using a blade in order to provide a sufficient image density, the thickness of the developer layer on the developing sleeve may preferably be set to be smaller than the gap β between the developing sleeve and the latent image-bearing member and a developing bias voltage comprising AC voltage component may preferably be applied to the developing sleeve so as to form an alternating electric field at the gap β portion.

Specifically, referring to FIG. 8, from a bias power supply 177, a developing bias voltage comprising an AC voltage component or an AC voltage component superposed with a DC voltage component is applied to the developing sleeve 172, thus facilitating movement of the mono-component non-magnetic developer from the developing sleeve 172 to the latent image-bearing member 169 to provide good image qualities.

Next, a contact mono-component developing system as the monocomponent developing method will be described.

Figure 9:
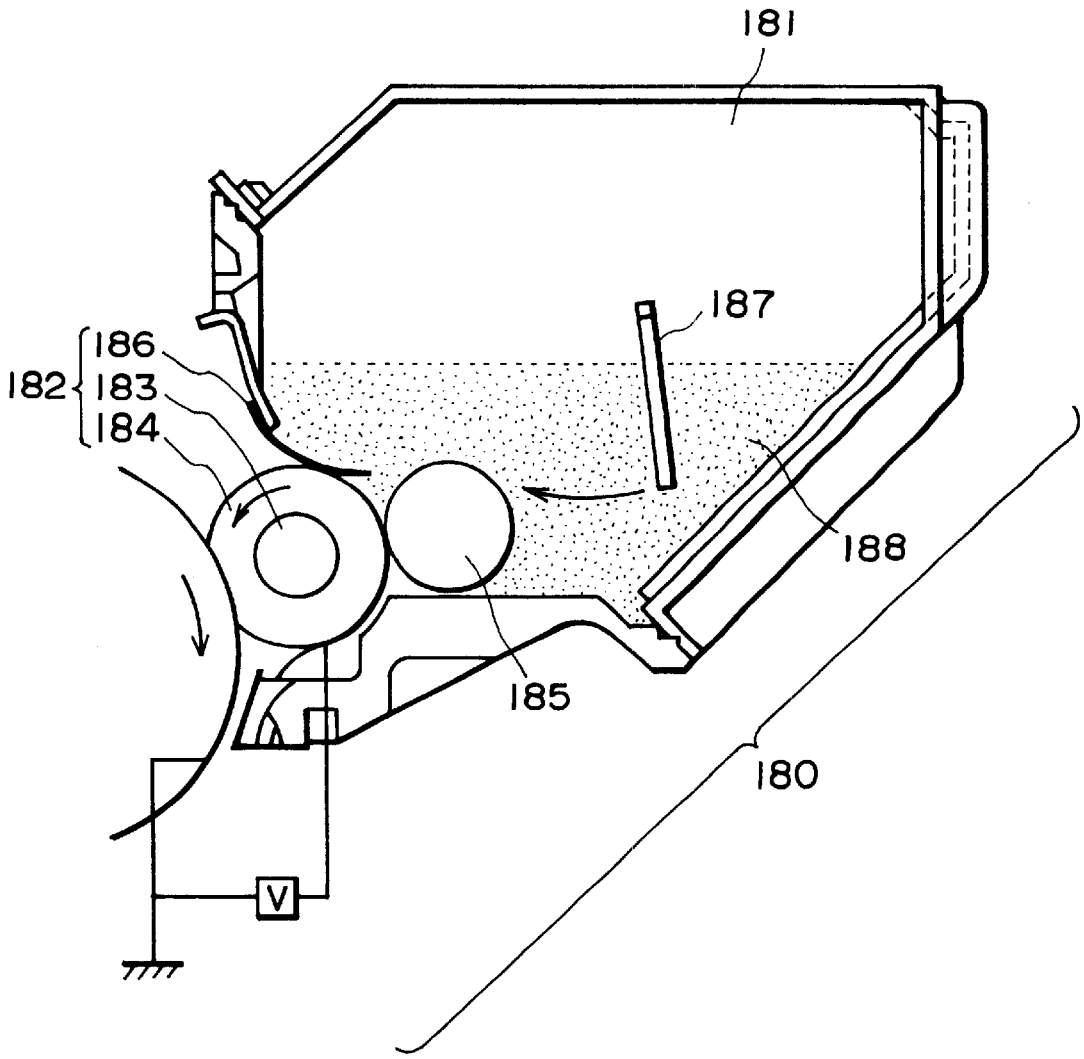

In the contact mono-component developing system (method), it is possible to effect developing with a non-magnetic toner by using a developing apparatus 80, e.g., as shown in FIG. 9.

Referring to FIG. 9, a developing apparatus 180 includes: a developer container 181 for containing a mono-component developer 188 containing a non-magnetic toner; a developer-carrying member 182 for carrying and conveying the mono-component developer 188 contained in the developer container 181 to a developing region; a supply roller 185 for supplying the developer to the developer-carrying member 182; an elastic blade 186 as a developer layer thickness-regulating member for regulating the developer layer thickness on the developer-carrying member 182; and a stirring member 187 for stirring the developer 188 contained in the developer container 181.

The developer-carrying member 182 may preferably be an elastic roller comprising a roller support 183 and an elastic layer 184 formed thereon of an elastic member, such as elastic rubber and resin (e.g., foamed silicone rubber).

The elastic roller 182 is pressed against the surface of a photosensitive drum 189 as the latent image-bearing member to effect development of an electrostatic latent image formed on the photosensitive member by using the mono-component developer 188 applied onto the elastic roller surface and also recover an unnecessary portion of the mono-component developer 188 left on the photosensitive member after the transfer.

In this embodiment, the developer-carrying member substantially contacts the photosensitive member surface. This means that the contact therebetween is still ensured even when the mono-component developer is removed from the developer-carrying member surface. At that time, an electric field exerted between the photosensitive member and the developer-carrying member ia the developer provides a good image free from the edge effect and effects cleaning at the same time. Thus, it is necessary to provide an appropriate potential at the surface or in the vicinity of the elastic roller as the developer-carrying member and an electric field between the photosensitive member surface and the elastic roller surfaces. Accordingly, it is also possible to utilize a method wherein a resistance of an elastic rubber of the elastic roller is controlled in a medium resistance range to prevent electrical conduction with the photosensitive member while retaining the electric field or a method wherein a thin dielectric layer is formed on the surface layer of the electroconductive roller. Further, it is possible to use an electroconductive resinous sleeve comprising an electroconductive roller coated with an insulating substance at its surface contacting the photosensitive member surface or an insulating sleeve provided with an electroconductive layer at its surface not contacting the photosensitive member.

The elastic roller carrying thereon the mono-component developer may be rotated in an identical direction or a reverse direction with respect to the photosensitive drum (member). In the case of the identical rotation direction, the elastic roller may preferably have a peripheral speed of at least 100% of that of the photosensitive member. Below 100%, it is liable to impair image qualities such as poor line clarity. The large peripheral speed (ratio) of the elastic roller provide a larger amount of the developer supplied to the developing region, thus resulting in much frequency of attachment and detachment of the developer to the electrostatic latent image to repeat scraping of an unnecessary portion of the developer and supply of the developer to a necessary portion. As a result, it is possible to obtain an image faithful to the electrostatic latent image. The peripheral speed ratio of the elastic roller to the photosensitive drum may move preferably be at least 115%.

The developer layer thickness-regulating member 186 may be an elastic roller which is pressed against the developer-carrying member surface at an appropriate elastic force.

The elastic blade or roller may be formed of: elastic rubbers, such as silicon rubber, urethane rubber and NBR rubber; elastic synthesis resin such as polyethyleneterephthalate; elastic metal such as stainless steel or steel; and their composites.

In the case of using the elastic blade, an upper support portion of the elastic blade is fixed and held on the developer container side and a lower portion thereof is pressed against in a deflection state such that the lower portion of the elastic blade is disposed in a forward or reverse direction of the developing sleeve rotation so as to contact the developing sleeve at its inner surface (for the forward rotation) or outer surface (for reverse rotation) at an appropriate abutting pressure.

The supply roller 185 may be composed of a foamed material such as polyurethane foam and is rotated at a non-zero speed relative to the developer-carrying member in a forward or reverse direction so as to supply the mono-component developer to the developer-carrying member and remove or scrape the developer (yet-undeveloped developer) from the developer-carrying member after the transfer.

At the time of development of the electrostatic latent image on the photosensitive member with the mono-component developer in the developing region, it is preferred to apply a developing bias voltage comprising a DC voltage component and/or an AC voltage component, more preferably a DC component, to the developer-carrying member.

In the non-contact and contact mono-component developing methods described above, it is possible to employ a mono-component developer containing a magnetic toner.

Then, a two-component developing system using a two-component developer will be described.

In the two-component developing system, a two-component developer comprising a toner and a carrier is conveyed and circulated on the developer-carrying member to a developing region between the developer-carrying member and an opposing latent image-bearing member, where a latent image held on the latent image-baring member is developed with a toner of the two-component developer.

The carrier of the two-component developer has a magnetic characteristic, which is effected by a magnet roller enclosed within the developing sleeve (developer-carrying member), thus largely affecting developing and conveying properties for the developer.

In the image forming method according to the present invention, e.g., the magnet roller may be fixed while rotating the developing sleeve alone, thus conveying and circulating the two-component developer on the developing sleeve to develop the electrostatic latent image borne on the latent image-bearing member surface with the two-component developer.

Figure 10:
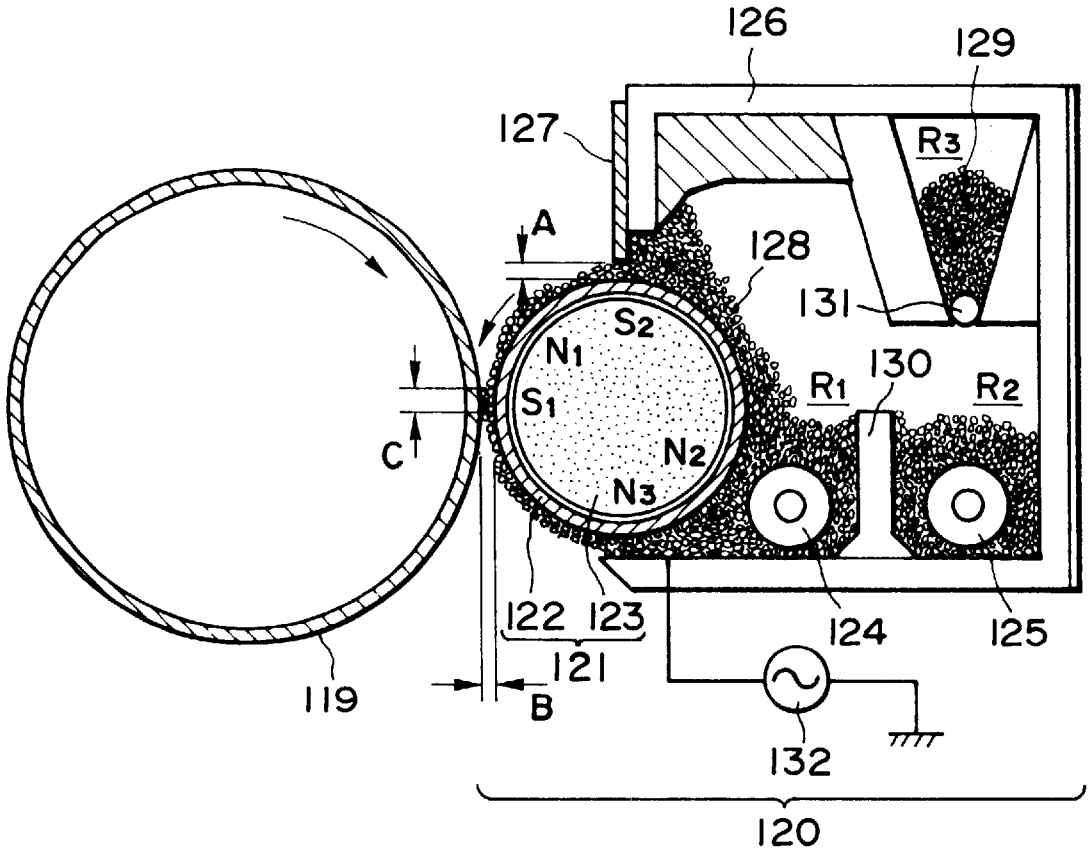

In the two-component developing method, it is possible to effect development with a two-component developer comprising a non-magnetic toner and a magnetic carrier by using a developing apparatus 120 as shown in FIG. 10.

Referring to FIG. 10, the developing apparatus 120 includes: a developer container 126 containing a two-component developer 128; a developing sleeve 121 for carrying the developer 128 contained in the developer container 126 and conveying the developer 128 to a developing region; and a developing blade as a developer layer thickness-regulating means for regulating a developer (toner) layer thickness on the developing sleeve 121.

The developing sleeve 121 includes a non-magnetic sleeve support 122 and a magnet 123 enclosed in the support 122.

The developing apparatus 120 is divided into a developer chamber $R_1$ containing the developer 128 and a stirring chamber $R_2$ containing the developer 128 by a partitioning wall 130, in which developer conveyer screws 124 and 125 are installed respectively. Above the stirring chamber $R_2$ is provided a toner storage chamber $R_3$ containing a replenishing (non-magnetic) developer 129, and at the bottom of the toner storage chamber $R_3$ is provided a developer replenishing port 131 through which an appropriate amount of the replenishing developer 129 is supplied to the stirring chamber $R_2$.

In the developing chamber $R_1$, the screw 124 is rotated to stir and convey the developer 128 in the chamber $R_1$ in one direction along the length of the developing sleeve 121. Similarly, in the stirring chamber $R_2$, the screw 125 is rotated to stir and convey the developer 128 dropped from the replenishing port 131 in the chamber $R_2$ in one direction along the length of the developing sleeve 121.

At a portion of the developer container 16 in proximity to the photosensitive drum 119, an opening is provided and through the opening, the developing sleeve 121 is protruded outward so as to provide a gap B with the photosensitive drum 119.

The developing sleeve 121 formed of a non-magnetic material is connected with a bias voltage application means 132.

The magnet 123 (magnet roller) as a magnetic field-generating means fixed within the developing sleeve 122 comprises a developing magnetic pole $S_1$, a magnetic pole $N_3$ located downward the pole $S_1$, and conveying poles $N_2$, $S_2$ and $N_1$. The magnet 123 is disposed within the sleeve support 122 so that the developing magnetic pole $S_1$ is opposite to the photosensitive drum 119. The developing magnetic pole $S_1$ forms a magnetic field in the vicinity of the developing region between the developing sleeve 121 and the photosensitive drum 119, thus forming a magnetic brush by the magnetic field.

The regulating blade 127 disposed above the developing sleeve 121 to regulate the layer thickness of the developer 128 on the developing sleeve 121 is a non-magnetic blade formed of a non-magnetic material, such as aluminum or SUS 316. The edge of the non-magnetic blade 127 may be disposed with a gap of 300–1000 $\mu$m, preferably 400–900 $\mu$m, with the developing sleeve surface. If the gap is below 300 $\mu$m, the gap may be plugged with the magnetic carrier to result in an irregularity in the developer layer and a difficulty in applying an amount of toner required for performing good development, thus being liable to result in images with a low density and much irregularity. In order to prevent an irregular coating (so-called "blade-plugging") due to contaminant particles in the developer, the gap may preferably be 400 $\mu$m or larger. Above 1000 $\mu$m, however, the amount of developer applied onto the developing sleeve 121 is increased so that it becomes difficult to effect a prescribed developer layer thickness regulation, whereby the amount of magnetic carrier attachment onto the photosensitive drum 119 is increased and the circulation of the developer and the regulation of the developer by the regulating blade 127 are weakened to provide the toner with a lower triboelectric charge, leading to foggy images.

In the developing apparatus 120, development may preferably be performed under application of an alternating electric field to the developer-carrying member and while a magnetic brush of the developer (comprising the toner and the magnetic carrier) contacts an electrostatic image-bearing member, e.g., a photosensitive drum 119. The developer-carrying member (developing sleeve) 121 may preferably be disposed with a spacing B of 100–1000 $\mu$m from the photosensitive drum 119 so as to well prevent the carrier attachment and provide an improved dot reproducibility. Below 100 $\mu$m, the developer supply is liable to be insufficient to result in a lower image density. Above 100 $\mu$m, lines of magnetic forces exerted by the magnetic pole $S_1$ are broadened to provide a magnetic brush of a lower density, thereby being liable to result in image with an interior dot reproducibility and carrier attachment due to weakening of a constraint force acting on the magnetic carrier.

The alternating electric field may preferably have a peak-to-peak voltage of 500–5000 volts, and a frequency of 500–10000 Hz, more preferably 500–3000 Hz, as suitably determined depending on the process. The alternating electric field may have an appropriate waveform, selected from various waveforms, such as triangular wave, rectangular wave, sinusoidal wave, waveforms obtained by modifying the duty ratio. If the application voltage is below 400 volts it may be difficult to obtain a sufficient image density and fog toner on a non-image region cannot be satisfactorily recovered in some cases. Above 500 volts, the latent image can be disturbed by the magnetic brush to cause lower image qualities in some cases.

By using a two-component type developer containing a well-changed toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follows the electric field, thus being liable to cause lower image qualities.

In the developing method according to the present invention, it is preferred to set a contact width (developing nip C) of the magnetic brush on the developing sleeve 121 with the photosensitive drum 119 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip may be appropriate adjusted by changing the distance A between a developer regulating member 127 and the developing sleeve 121 and/or changing the gap B between the developing sleeve 121 and the photosensitive drum 119.

The residual toner remaining on the photosensitive member is recovered by the magnetic brush comprising the toner and the carrier contained in the developer container described above.

Hereinabove, a developing bias voltage particularly preferably used in the above-mentioned two-component-type developing method will be described more specifically.

In the image forming method of the present invention, in order to form a developing electric field in a developing region between a latent image-bearing member and a developer-carrying member, a developing bias voltage comprising a DC voltage component and a discontinuous AC voltage component is applied to the developer-carrying member to develop an electrostatic latent image borne on the latent image-bearing member with a toner of a two-component-type developer carried on the developer-carrying member.

The developing bias voltage comprises a first voltage for directing the toner in the developing region from the latent image-bearing member to the developer-carrying member, a second voltage for directing the toner from the developer-carrying member to the latent image-bearing member, and a third voltage of a value between those of the first and second voltages, and is applied to the developer-carrying member to form a developing electric field between the latent image-bearing member and the developer-carrying member.

In a preferred embodiment, a period ($T_2$) wherein the third voltage is applied to the developer-carrying member (i.e., a time of pause in AC voltage component application) is set to be longer than a period ($T_1$) wherein the first and second voltages are applied to the developer-carrying member (i.e., a total actuation time of the AC voltage component), thus effectively realign the toner particles on the latent image-bearing member to allow faithful reproduction of the latent image.

Specifically, an electric field for directing the toner from the latent image-bearing member to the developer-carrying member and an opposing electric field for directing the toner from the developer-carrying member to the latent image-bearing member is applied at least one time in a prescribed total period ($T_1$) to the developer-carrying member in the developing region between the latent image-bearing member and the developer-carrying member. Thereafter, an electric field for directing the toner from the developer-carrying member to the latent image-bearing member at an image part of the latent image bearing member and directing the toner from the latent image-bearing member to the developer-carrying member at a non-image part in a prescribed period ($T_2$), thus developing the electrostatic latent image with the toner of the two-component developer. In this developing step, the period ($T_2$) may preferably be set to be longer than the period ($T_1$).

In the above-mentioned developing method using the alternating (developing) electric field, when the developing electric field including pause period in which the alternating electric field application is periodically interrupted is used for development, carrier attachment is not readily caused to occur.

That reason has not been clarified as yet but may be attributable the following mechanism.

In the case of a conventional sinusoidal or rectangular wave, when an electric field intensity is increased to obtain a higher image density, the toner and carrier are liable to be together reciprocated between the latent image-bearing member and the developer-carrying member, thus resulting in a strong frictional action of the carrier onto the latent image-bearing member to cause carrier attachment. This tendency is more noticeable in the case of a larger amount of minute carrier particles.

On the other hand, when the above-mentioned alternating electric field is applied, one pulse application does not cause a complete reciprocating motion, i.e., cause a behavior such that either one of the toner and the carrier is not reciprocated between the developer-carrying member and the latent image-bearing member, whereby if a potential difference Vcont between the resultant surface potential of the latent image-bearing member and that of a DC voltage component of the developing bias is below zero (i.e., Vcont<0), Vcont causes jumping of the carrier from the developer-carrying member but the carrier attachment can be suppressed by controlling magnetic properties of the carrier and magnetic flux density of the magnetic roller in the developing region. If Vcont>0, the magnetic field force and Vcont acts on the developing carrier so as to be attracted to the developer-carrying member side, thus causing no carrier attachment.

The magnetic properties of the carrier is affected by the magnetic roller enclosed in the developing sleeve, thus largely affecting the developing and conveyance characteristic of the developer.

In the present invention, on the developing sleeve enclosing therein the magnetic roller, the magnetic roller is fixed and the developing sleeve is rotated alone to circulate and convey the two-component-type developer comprising the carrier (consisting of magnetic particles) and an insulating color toner, thereby to effect development of the electrostatic latent image with the two-component-type developer. in the above developing step, when (1) the magnetic roller is desired to have opposite magnetic poles, (2) the magnetic density in the developing region is set in a range of 500–1200 Gauss, and (3) the saturation magnetization of the carrier is set to 20–70 $Am^2/kg$ under a magnetic field of 3000 oersted, it is possible to provide excellent image uniformity and gradation reproducibility in color copying operation.

If the saturation magnetization of the carrier is above 70 $Am^2/kg$ (under 3000 oersted), an ear of magnetic brush comprising the carrier and the toner carried on the developing sleeve disposed opposite to the electrostatic latent image on the photosensitive member is firmly packed in a dense state at the time of development, thus resulting in poor gradation performance and reproducibility of halftone. Below 20 $Am^2/kg$, it becomes difficult to well retain the toner and the carrier onto the developing sleeve, thus being liable to cause carrier attachment and provide a poor toner scattering-prevention effect.

In the transfer step, the transfer means may comprise corona charger, transfer roller or transfer belt.

In the case where the residual toner present on the photosensitive member after the transfer step is conveyed to the developing region through the photosensitive member surface and recovered for repetitive use, it is possible to realize such a conveyance and recovery operation without changing the charging bias voltage for the photosensitive member. However, when jamming of the transfer-receiving paper is caused to occur or an image having a large image-portion area is continuously formed for practical use, an excessive amount of the toner particles may presumably be contained in the toner charger.

In this case, during the operation of the electrophotographic apparatus, by utilizing a non-image forming period, it is possible to move the toner from the charger to the developing apparatus. Such a non-image forming period includes periods of pre-rotation and post-rotation and an intermediate period between conveyance of successive transfer-receiving papers. In such an instance, it is preferred to change the charging bias voltage so that the toner is liable to be moved from the charger to the photosensitive member. Such a bias voltage may include a smaller peak-to-peak voltage for the AC voltage component or the DC voltage. It is also possible to decrease an effective AC voltage value by changing the applied waveform while retaining the peak-to-peak voltage.

In the transfer step, in addition to the direct transfer for transferring the toner image formed on the latent image-bearing member onto the recording (transfer-receiving) material, it is possible to effect a secondary transfer using an intermediate transfer member wherein the toner image formed on the latent image-bearing member is transferred onto the intermediate transfer member (primary transfer) and then the toner image transferred onto the intermediate transfer member is transferred onto the recording material (secondary transfer).

Hereinbelow, a color image forming method wherein a multiple or multi-color toner image is concurrently transferred onto the recording material by using the intermediate transfer member will be described with reference to FIG. 3.

Figure 3:
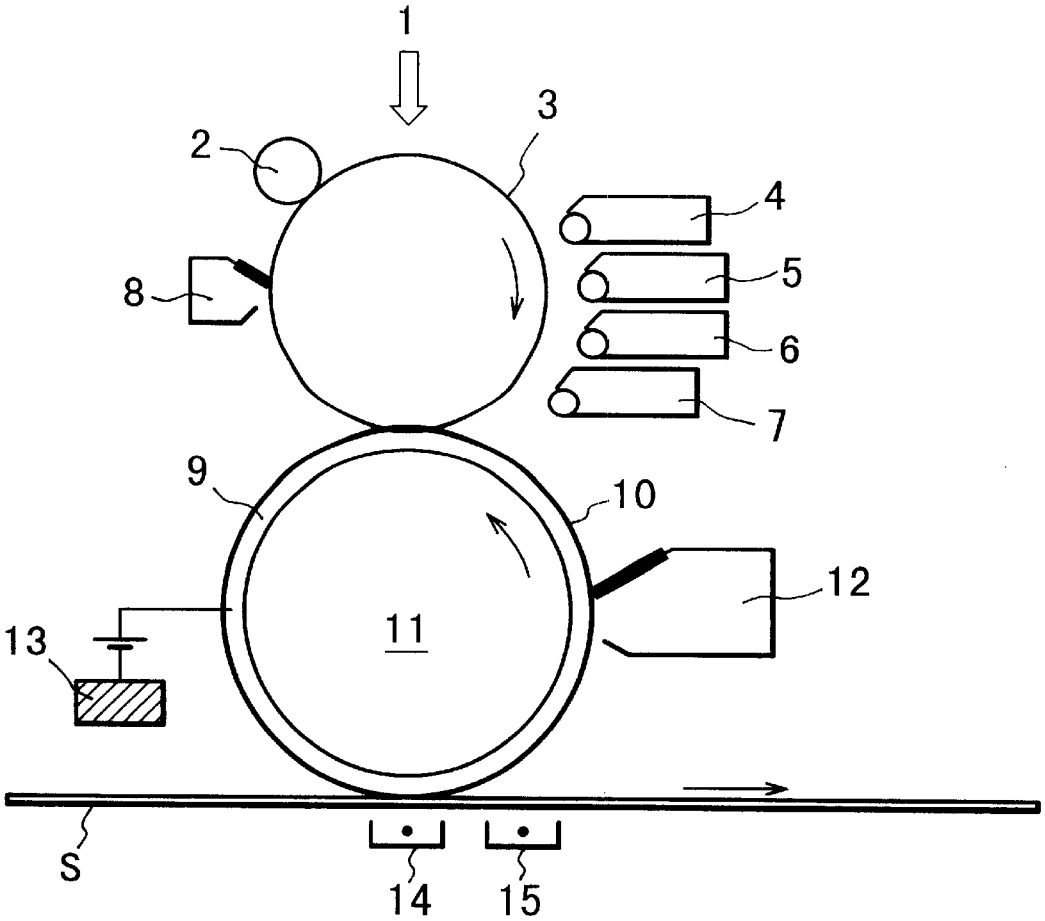
FIGS. 3–7 are schematic sectional views each showing an embodiment of an image-forming apparatus for practicing the image-forming method of the present invention.

Referring to FIG. 3, a photosensitive drum 3 as a latent image-bearing member is charged to have a prescribed surface potential by causing a charging roller to rotate in contact with the photosensitive member 3 to form an electrostatic latent image. The electrostatic latent image is successively developed with a first developing device 4, a second developing device 5, a third developing device 6 and a fourth developing device 6 to form respective color toner images. The respective color toner images are successively transferred onto an intermediate transfer member 11 having a drum or belt shape to form a superposed multi-color toner image. The drum-shaped intermediate transfer member has a outer peripheral surface provided with a holding member and includes a support and an elastic layer disposed thereon comprising a rubber material (e.g., nitrile-butadiene rubber) and an electroconductive material sufficiently dispersed therein (e.g., particles of carbon black, zinc oxide, tin oxide, silicon carbide or titanium oxide). The intermediate transfer member may preferably include an elastic layer having a hardness of 10–50 degrees as measured according to JIS K-6301 or, in the case of a transfer belt-form, comprises a supporting member comprising such an elastic member in a transfer region of the recording (transfer-receiving) material. The transfer from the photosensitive drum 3 to the intermediate transfer member 11 is performed by applying a bias voltage from a power supply 13 to a core metal 9 of the intermediate transfer member 11 to provide a transfer current, thus effecting the transfer. The bias voltage application may be performed from the backside of the holding member or the belt by using corona discharge or roller charging. The (superposed) multi-color toner image on the intermediate transfer member 11 is then concurrently transferred onto a recording material S by using a transfer charger 14, such as corona charger or contact-type electrostatic transfer means using a transfer roller or a transfer belt.

The toner image transferred onto the recording material through any one of the above-mentioned transfer steps is fixed on the recording material under application of heat and pressure.

Figure 4:
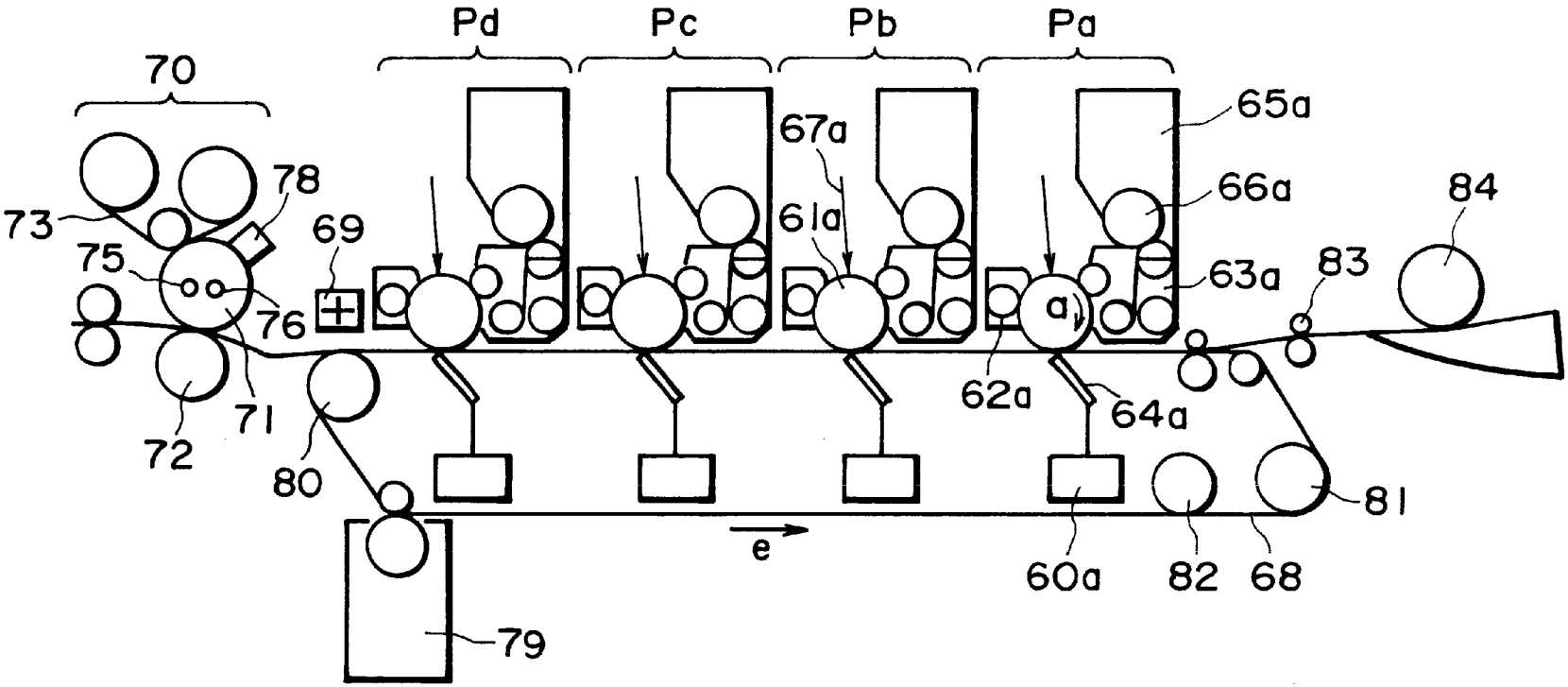

FIG. 4 illustrates a full-color image forming system suitable for practicing another embodiment of the image forming method according to the present invention.

Referring to FIG. 4, a full-color image forming apparatus main body 8 includes a first image forming unit Pa, a second image forming unit Pb, a third image forming unit Pc and a fourth image forming unit Pd disposed in juxtaposition for forming respectively images of difference colors each formed through a process including electrostatic image formation, development and transfer steps on a recording material.

The organization of the image forming units juxtaposed in the image forming apparatus will now be described with reference to the first image forming unit Pa, for example.

The first image forming unit Pa includes an electrophotographic photosensitive drum 61*a* of 30 mm in diameter as an electrostatic image-bearing member, which rotates in an indicated arrow a direction. A primary charger 62*a* as a charging means includes a 16 mm-dia. sleeve on which a magnetic brush is formed so as to contact the surface of the photosensitive drum 61*a*. The photosensitive drum 61*a* uniformly surface-charged by the primary charger 62*a* is illuminated with laser light 67*a* from an exposure means (not shown) to form an electrostatic image on the photosensitive drum 61*a*. A developing device 63*a* containing a color toner is disposed so as to develop the electrostatic image on the photosensitive drum 61*a* to form a color toner image thereon. A transfer blade 64*a* is disposed as a transfer means opposite to the photosensitive drum 61*a* for transferring a color toner image formed on the photosensitive drum 61*a* onto a surface of a transfer material (recording material) conveyed by a belt-form transfer material-carrying member 68, the transfer blade 64*a* is abutted against a back surface of the transfer material carrying member 68 to supply a transfer bias voltage thereto.

In operation of the first image forming unit Pa, the photosensitive drum 61*a* is uniformly primarily surface-charged by the primary charger 62*a* and then exposed to laser light 67*a* to form an electrostatic image thereon, which is then developed by means of the developing device 6a to form a color toner image. Then, the toner image on the photosensitive drum 61*a* is moved to a first transfer position where the photosensitive drum 61*a* and a transfer material abut to each other and the toner image is transferred onto the transfer material conveyed by and carried on the belt-form transfer material-carrying member 68 under the action of a transfer bias electric field applied from the transfer blade 64*a* abutted against the back-side of the transfer material-carrying member 68.

The first image forming unit Pa does not have a cleaning member, for removing a residual toner from the photosensitive drum surface by causing it to abut against the photosensitive drum surface, disposed ordinarily between the transfer region and the charging region and/or between the charging region and the developing region.

In the first image forming unit Pa, the developing device also functions as means for removing the residual toner, thus employing concurrent developing-cleaning scheme.

The image forming apparatus includes the second image forming unit Pb, the third image forming unit Pc and the fourth image forming unit Pd each of which has an identical organization as the above-described first image forming unit Pa but contains a toner of a different color, in juxtaposition with the first image forming unit Pa. For example, the first to fourth units Pa to Pd contain a yellow toner, a magenta toner a cyan toner and a black toner, respectively, and at the transfer position of each image forming unit, the transfer of toner image of each color is sequentially performed onto an identical transfer material while moving the transfer material once for each color toner image transfer and taking a registration of the respective color toner images, whereby superposed color images are formed on the transfer material. After forming superposed toner images of four colors on a transfer material, the transfer material is separated from the transfer material-carrying member 68 by means of a separation charger 69 and sent by a conveyer means like a transfer belt to a fixing device 70 where the superposed color toner images are fixed onto the transfer material in a single fixation step to form an objective full-color image.

The fixing device 70 includes, e.g., a pair of a 40 mm-dia. fixing roller 71 and a 30 mm-dia. pressure roller 72. The fixing roller 71 includes internal heating means 75 and 76 and staining at the fixing roller 71 is removed by a web member 73 which may be omitted in the present invention. Yet unfixed color-toner images on a transfer material are fixed onto the transfer material under the action of heat and pressure while being passed through a pressing position between the fixing roller 71 and the pressure roller 72 of the fixing device 70.

In the apparatus shown in FIG. 4, the transfer material-carrying member 68 is an endless belt member and is moved in the direction of an indicated arrow e direction by a drive roller 80 and a follower roller 81. During the movement, the transfer belt 68 is subjected to operation of a transfer belt cleaning device 79 and a belt discharger 80. In synchronism with the movement of the transfer belt 68, transfer materials are sent out by a supply roller 84 and moved under the control of a pair of registration rollers 83 for conveying the transfer materials to the transfer belt 68.

As transfer means, such a transfer blade abutted against the back side of a transfer material-carrying member can be replaced by other contact transfer means capable of directly supplying a transfer bias voltage while being in contact with the transfer material-carrying member.

Further, instead of the above-mentioned contact transfer means, it is also possible to use a non-contact transfer means, such as a generally used corona charger for applying a transfer bias voltage to the back side of a transfer material-carrying member.

However, in view of the suppressed occurrence of ozone accompanying the transfer bias voltage application, it is preferred to use a contact transfer means.

Next, another embodiment of the image forming method according to the present invention wherein plural color toner images are formed in an image forming region and successively transferred and superposed on an identical recording material will be described with reference to FIG. 5.

Figure 5:
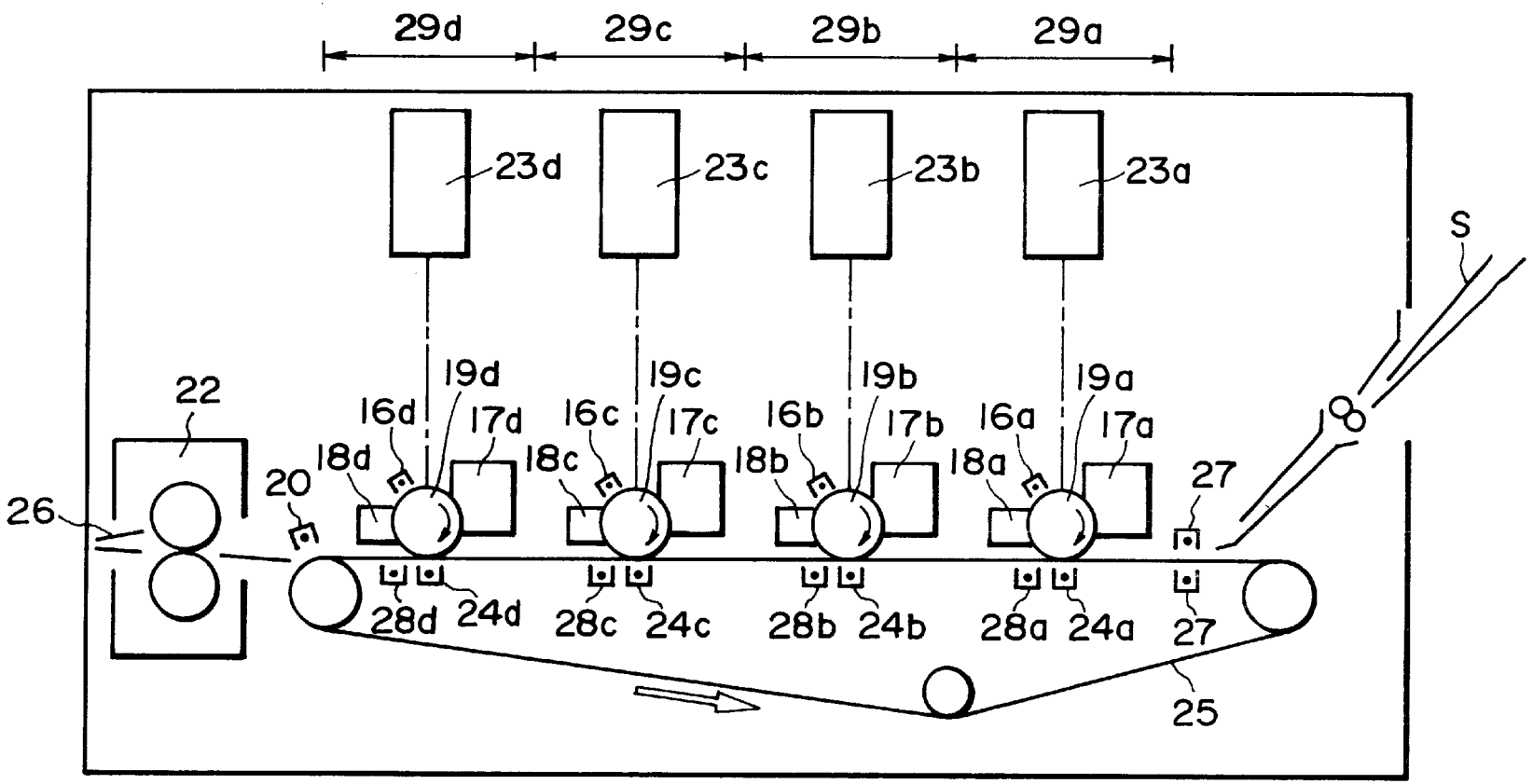

Referring to FIG. 5, an image forming apparatus includes first to fourth image forming units 29*a*, 29*b*, 29*c* and 29*d*, respectively, disposed in this order along a conveyer belt 25. Each of the image forming units 29*a*–29*d* is provided with latent image-bearing member (photosensitive drum) 19*a*, 19*b*, 19*c* or 19*d*. Each of the photosensitive drums 19*a*–19*d* is provided at its peripheral surface successively with a latent image-forming means 23*a*–23*d*, a developing means 17*a*–17*d*, a transfer means 24*a*–24*d*, and a cleaning means 18*a*–18*d*.

For color image formation, first, e.g., an electrostatic latent image for a yellow component color of an original image is formed on the photosensitive drum 19*a* of the first image forming unit 29*a* by the latent image-bearing member 23*a*. The electrostatic latent image is developed with a developer containing a yellow toner of the developing means 17*a* and transferred onto a recording material S by the transfer means 24*a*.

During the transfer of the yellow toner image is transferred onto the recording material S, in the second image forming unit 29*b*, an electrostatic latent image for a magenta component color is formed on the photosensitive drum 19*b* and then developed with a developer containing a magenta toner of the developing means 17*b*. The developed (visualized) image (magenta toner image) is transferred onto the recording material S at its prescribed position in ai superposed form when the recording material after completion of the transfer step in the first image forming unit 29*a* is conveyed to the transfer means 24*b*.

Thereafter, in a similar manner, cyan toner image formation and black toner image formation are successively performed by the third and fourth image forming units 29*c* and 29*d*, thus successively superposing cyan and black toner images on the magenta toner image (on the yellow toner image) held on the same recording material S.

When such an image forming process is completed, the recording material is conveyed to a fixing means 22 by which the superposed toner images are fixed to form a multi-color image on the recording material S.

The respective photosensitive drums 19*a*–19*d* are subjected to cleaning for removing residual toners by the cleaning means 18*a*–18*d*, respectively, and are prepared for a subsequent latent image formation.

In the above image forming method, the conveyance of the recording material S is conducted by the conveyer belt 25. In FIG. 5, the recording material is conveyed from the left to right sides on the drawing and in the course of conveyance, the recording material S is subjected to transfer by causing it to pass through the respective transfer means 24*a*–24*d* of the image forming units 29*a*–29*d*.

As the conveyer belt 25, in view of easy processing or shaping and durability, it is possible to utilize one using tetron fiber mesh and one using a thin dielectric film of polyethyleneterephthalate-type resin, polyimide-type resin or urethane-type resin.

When the recording material S passes through the fourth image forming unit 29*d*, an AC voltage is applied to a charge-removing device 20 to effect charge removal of the recording material S, whereby the recording material S is separated from the conveyer belt 25 and then enters the fixing device 22, where image fixation is performed, followed by discharge of the recording material S from a discharge port 26.

In the above image forming method, the image forming units may be provided with a common latent image-bearing member and the recording material S may be repeatedly sent to a transfer section of the latent image-bearing member by a drum-type conveyance means, thus effecting respective toner image transfers.

Figure 6:
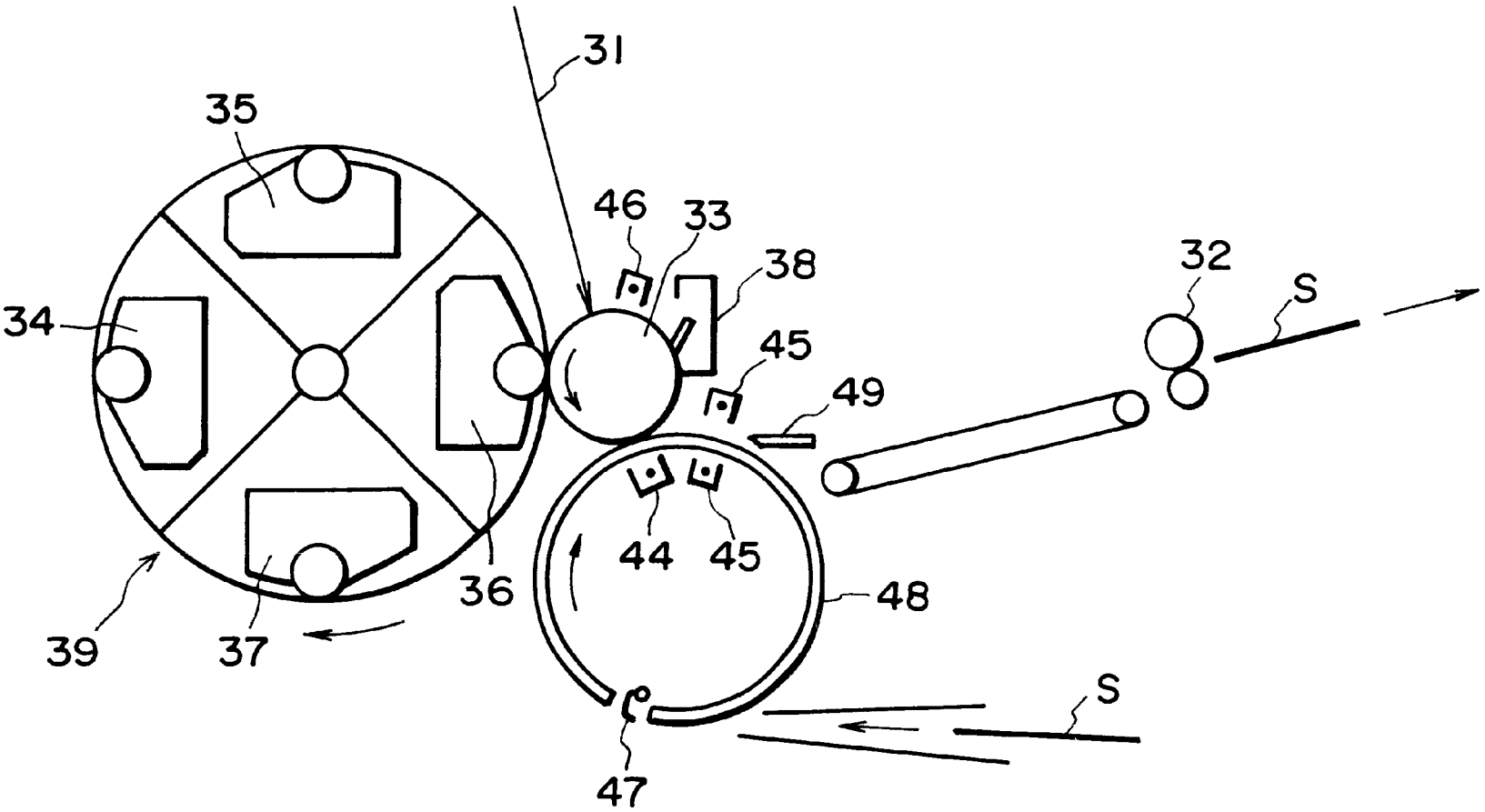

FIG. 6 shows another embodiment of the image forming method for forming full-color images.

Referring to FIG. 6, an electrostatic latent image formed on a photosensitive drum 33 by an appropriate means is developed with a two-component-type developer comprising a first color toner and a carrier contained in a developing device 36 as a developing means installed in a rotary developing unit 29 rotating in a direction of the indicated arrow. The thus-formed first color toner image on the photosensitive drum is transferred onto a recording material S held by a gripper 47 on a transfer drum 48 by using a transfer charger 44.

The transfer charger 44 may be a corona charger or contact charger. In the case of the corona charger, a voltage of −10 kV to +10 kV is applied and a transfer current is −500 $\mu$A to +500 $\mu$A.

At the peripheral surface of the transfer drum 48, a holding member of a dielectric film (sheet) of polyvinylidene fluoride or polyethyleneterephthalate is formed in a thickness of 100–200 $\mu$m and has a volume resistivity of $1\times10^{12}$–$1\times10^{14}$ ohm.cm.

For second color image formation, the rotary developing unit is rotated so that a developing device 35 is disposed opposite to the photosensitive drum 33, where an electrostatic latent image for a second color component is developed with a developer comprising a second color toner and a carrier contained in the developing device 35. The developed second color toner image is also superposed and transferred onto the same recording material S having thereon the front color toner image.

Similarly, third and fourth color toner image formations are successively conducted.

Thus, the transfer drum 48 is rotated prescribed times while holding the recording material S, whereby a prescribed number of color toner images are transferred in superposition form.

A transfer current for electrostatic transfer may preferably be increased so as to satisfy the relationship: for first color<for second color<for third color<for fourth color, in order to reduce residual toner particles remaining on the photosensitive drum after the transfer.

The recording material S after the multiplicity-transfer of the toner images is separated from the transfer drum 44 by a separation charger 45 and then is subjected to fixation using a hot-pressure roller fixing device 32 with or without a web mechanism which is impregnated with a silicone oil or not impregnated with the silicone oil, thus forming a full-color copy image through addition color mixing at the time of fixation.

Replenishing toners supplied to the respective developing deices 34–37 are conveyed to a toner replenishing tube at the center of the rotary developing unit in a prescribed amount based on a replenishing signal through a toner-conveying cable, and then are sent to the respective developers.

A method for multiple development and concurrent transfer will be described with reference to FIG. 7 while taking a full-color electrophotographic printer as an example.

Figure 7:
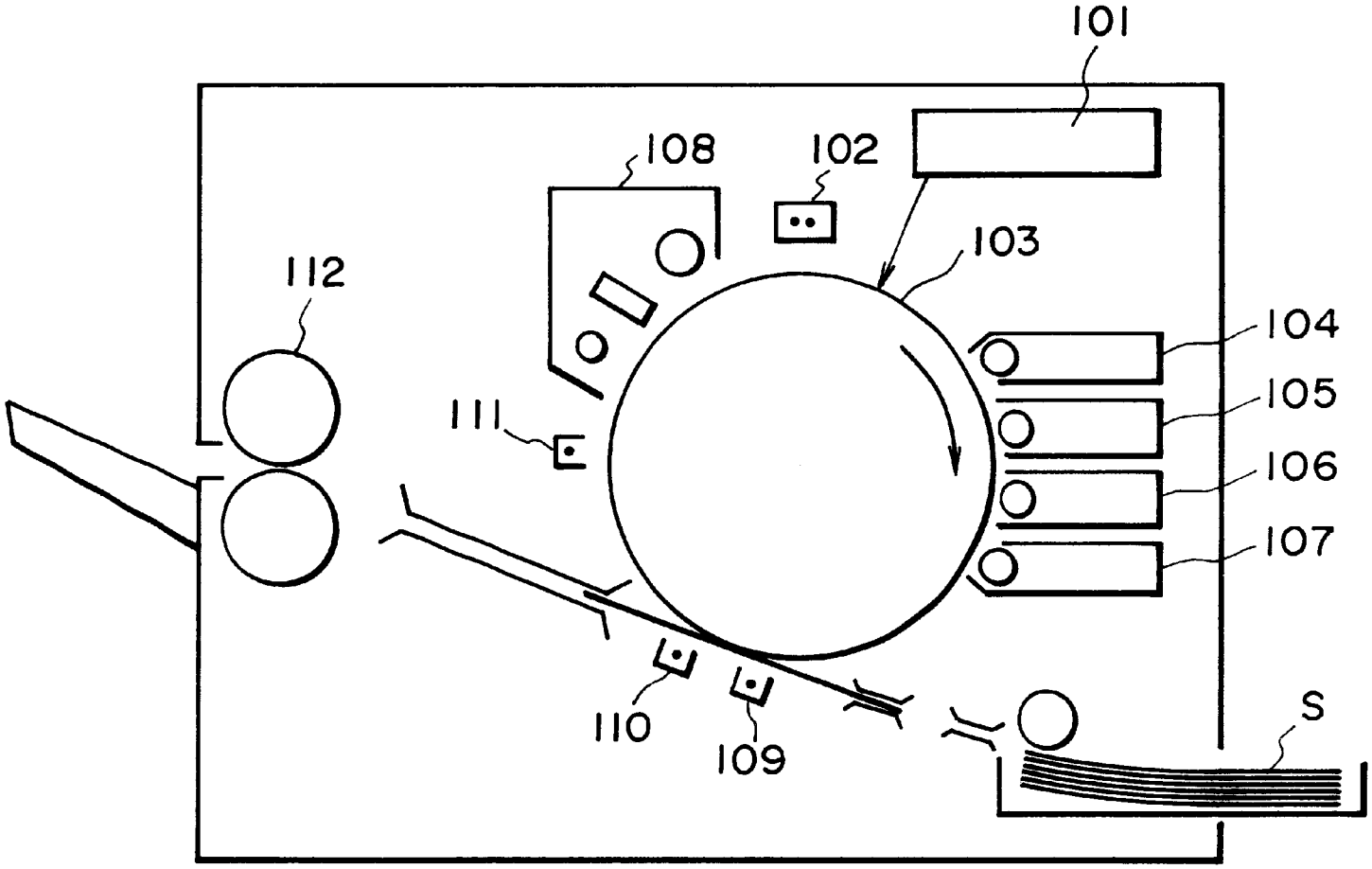

Referring to FIG. 7, an electrostatic latent image formed on a photosensitive drum by using a charger 102 and an exposure unit 101 using a laser light is developed successively with toners contained in developing devices 104, 105, 106 and 107, respectively, according to a non-contact developing method. In the non-contact developing method, a developer layer within the developing device does not rub the surface of the latent image-bearing member, thus effecting development without disturbing an image formed in a preceding (first) developing operation in second to fourth developing operation. The order of development may preferably be the order of higher color value and saturation except for black in the case of multi-color development. In the case of full-color development, the order of development may preferably be the order of yellow, magenta, cyan and black or yellow, cyan, magenta and black.

The multi-color of full-color superposed toner image formed on the photosensitive drum 103 is transferred onto a recording material S by a transfer charger 109. In the transfer step, an electrostatic transfer method using corona discharge or contact transfer may preferably be employed. According to the corona discharge method, the transfer charger 109 causing corona discharge is disposed opposite to the developed toner image via the recording material S and the corona discharge acts on the toner image from the backside of the recording material S to electrostatically transferring the toner image onto the recording material S. According to the contact transfer method, a transfer roller or belt is caused to contact the image-bearing member and is supplied with a bias voltage or the electrostatic transfer is performed from the backside of the transfer belt, thus concurrently transferring the multi-color toner images carried on the surface of the photosensitive drum 103 onto the recording material S.

The transfer material S onto which the multi-color toner images are concurrently transferred is then separated from the photosensitive drum 103 and fixed by a hot-roller fixing device 112 to provide a multi-color image.

In the above-mentioned image forming methods according to the present invention, it is possible to prepare an apparatus unit detachably mountable to an image forming apparatus main assembly by integrally supporting a plurality of structural members selected from the respective structural members constituting the image forming apparatus to form a single unit.

Such an apparatus unit according to the present invention includes at least a toner for developing an electrostatic latent image, a toner container for holding the toner, a toner-carrying member for carrying and conveying the toner contained in the toner container to a developing region, and a toner layer thickness-regulating member for regulating a thickness of the toner layer carried on the toner-carrying member. The apparatus unit is installed in the image forming apparatus (main assembly) so that the apparatus unit can be attached to or detached from the apparatus. As the toner used in the apparatus unit, the above-mentioned toners are applicable.

Examples of the apparatus unit may include the developing device 170 shown in FIG. 8 and the developing device 180 shown in FIG. 9.

In the case where the developing device 170 shown in FIG. 8 is used as the apparatus unit, it is possible to form an apparatus unit by a combination of a developer container 171 as a toner container, a mono-component-type developer 176 as a toner, a developing sleeve 172 as a toner-carrying member, an elastic blade 174 as a toner layer thickness-regulating member, and a supply roller 173 for supplying the mono-component developer onto the developing sleeve 172.

In the case where the developing device 180 shown in FIG. 9 is used as the apparatus unit, it is possible to form an apparatus unit by a combination of a developer container 181 as a toner container, a mono-component-type developer 188 as a toner, a an elastic roller 182 as a toner-carrying member, an elastic blade 186 as a toner layer thickness-regulating member, a supply roller 185 for supplying the mono-component developer onto the elastic roller 182, and a stirring member 187 for stirring the mono-component developer 188 within the developer container 181.

In the case here the developing devices 170 (FIG. 8) and 180 (FIG. 9) are used as the developing means 17*a*–17*d* of the full-color image forming method as shown in FIG. 5, it is possible to prepare an apparatus unit comprising, e.g., a combination of the developing means 17*a* and the photosensitive drum 19*a* as the latent image-bearing member and the apparatus unit is detachably mountable to an image forming apparatus main assembly. It is also possible to constitute similar apparatus units comprising combinations of the developing means 17*b* with the photosensitive drum 19*b*, the developing means 17*c* with the photosensitive drum 19*c*, and the developing means 17*d* with the photosensitive drum 18*d*, respectively.

In the above cases, it is also possible to further add the cleaning means 18*a*–18*d* to the combinations of the developing devices 17*a*–17*d* with the photosensitive drums 19*a*–19*d*, respectively, thus providing other apparatus units, respectively.

Next, the heat fixing method of the present invention will be described.

According to the heat fixing method, a fixing member is caused to contact the surface of a toner image formed on a recording material under application of heat and pressure to the toner image, thus fixing the toner image on the recording material.

At the time of fixing the toner image on the recording material, a silicone oil is supplied and applied from the fixing member to a fixing surface of the toner image on the recording material in an amount of $0–1\times10^{-7}$ g/cm$^2$ per unit area of the recording material. The toner image is formed with the toner of the present invention described above.

Figure 11:
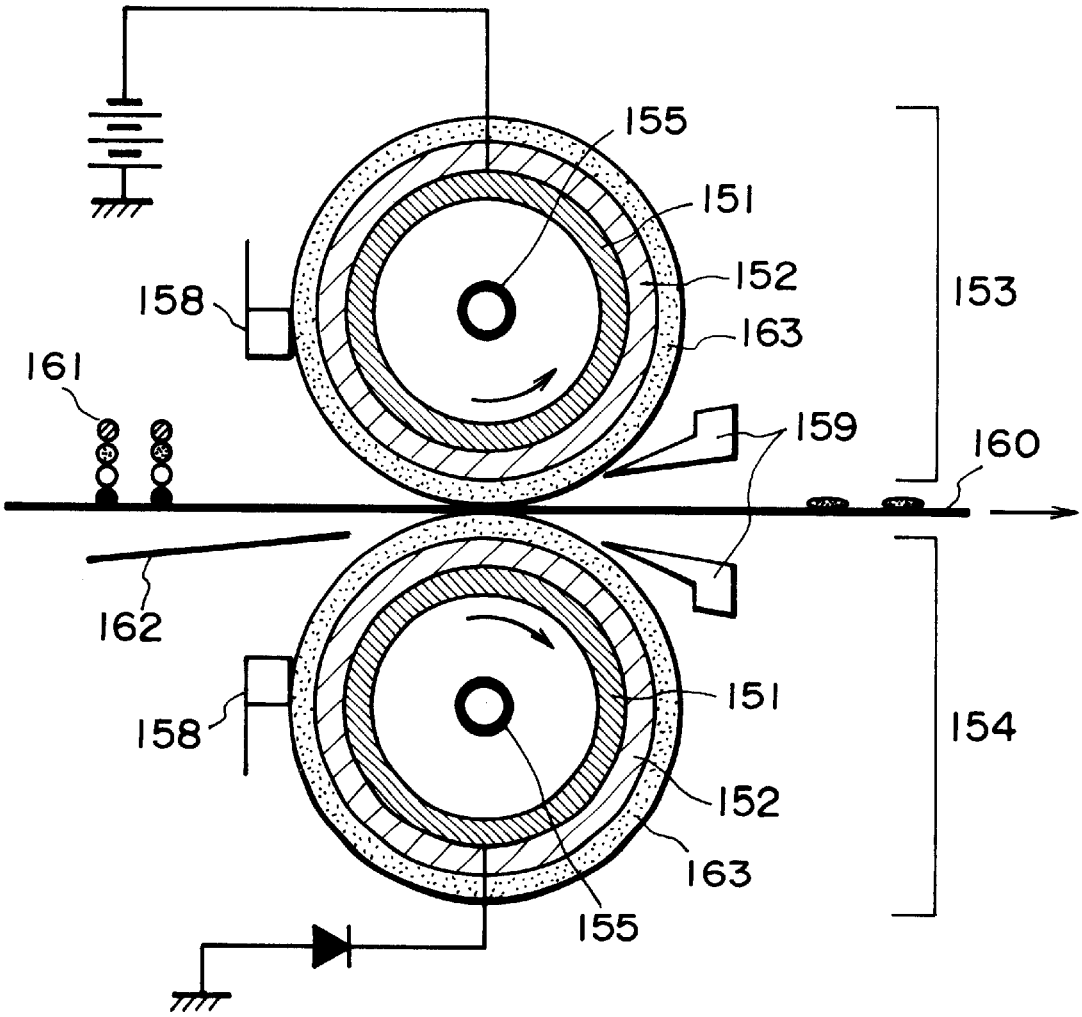
FIG. 11 is a schematic sectional view of a heat-pressure fixing device.

FIG. 11 shows a schematic sectional view of a fixing apparatus (device) of a hot-pressure roller scheme used in the heat fixing method of the present invention.

Referring to FIG. 11, in the heat fixing method of the present invention, yet-unfixed toner images 161 transferred onto a recording material 160 are conveyed in the hot-pressure fixing apparatus using a heating roller 153 and a pressure roller 154 to be subjected to hot-pressure fixation and the recording material 160 having thereon the fixed toner images is discharged rightward from the fixing apparatus on the drawing.

In the heat fixing method, plural color toner images superposed on the recording material are fixed in a contact state by the fixing apparatus under heat and pressure application. At that time, the fixing surface of the toner image 161 on the recording material is supplied with a silicone oil in an amount of $0–10^{-7}$ g/cm$^2$, preferably $0–3\times10^{-8}$ g/cm$^2$, more preferably 0 g/cm$^2$ (i.e., no oil application).

In order to effect silicone oil application to the fixing member, it is possible to adopt as a simple mechanism a cleaning means 158 provided with, e.g., a pad or web impregnated with a silicone oil. It is also possible to employ a winding-type web or other silicone oil-supply members, such as a silicone rubber roller impregnated with a silicone oil.

The fixing apparatus includes the fixing (heating) roller 153 and the pressure roller 154 each enclosing a heating means 155 (e.g., a heater) therein.

In a preferred embodiment, an elastic roller is used as the fixing roller 153 directly contacting the toner images 161 formed on the recording material 160. More specifically, in the case where the fixing roller has elastic properties, the fixing roller surface per se is pressed against uneven surfaces of the yet-unfixed toner images in a determined state to allow uniform heating and pressure application, thus being also effective in uniformization in gloss.

The elastic fixing roller may preferably have a multi-layer structure comprising a core metal 151, an elastic layer 152 disposed on the core metal 151, and a release layer 163 disposed on the elastic layer 152.

Similarly, the pressure roller 154 may preferably be an elastic roller and may preferably be pressed against the fixing roller 153 at a pressing force of 20–60 kgf.

Based on the elastic properties of the pressure roller 154, it is possible to provide an appropriate nip width of 5–12 mm. The pressure roller 154 may also preferably have a release layer 163 as a surface layer.

The use of the heater 155 in the pressure roller 154 is preferred in order to allow a precise temperature control and a gloss stability for the resultant toner images but may be omitted depending on the fixing system used.

It is possible to optionally use separation means (claws) 159 for separating the recording material 160 from the fixing roller 153 and the pressure roller 154, cleaning means 158 for cleaning the surfaces of the fixing roller 153 and the pressure roller 154, and a bias voltage power supply, as desired.

When a process speed is 15–150 mm/sec, the fixing roller may preferably have a surface temperature of 140–180° C.

As described hereinabove, according to the heat fixing member of the present invention, it is possible to use a fixing system wherein a release agent, such as a silicone oil is not supplied to the fixing apparatus, thus suppressing the winding of the recording material to the fixing apparatus and to use a toner having a larger latitude in offset prevention.

According to the present invention, it is possible to provide a toner capable of stably providing a broader fixable temperature range and an appropriately glossy image in a broader temperature range without causing a difference in gloss between resultant images even when a heat capacitance of a fixing device is decreased due to size reduction or a temperature of a fixing roller is charged during a high-speed continuous printing operation.

Hereinbelow, the present invention will be specifically described with reference to examples. In the following, "part(s)" means "weight part(s)".

RESIN PRODUCTION EXAMPLE I

Polyester resins and comparative polyester resins used in Examples and Comparative Examples were prepared through co-polycondensation by using compositions comprising alcohol and acid components indicated in Table 1, respectively.

The thus-obtained Polyester resin a–d and Comparative polyester resins e–g exhibited physical properties (molecular weight distribution, THF-insoluble content and acid value (Av)) as shown in Table 2.

TABLE 1

| Polyester resin No. | Component a | mol. % | Component b | mol. % | Component c | mol. % | Component d | A mol. % | Component e | B mol. % | B (mol. %)/ A (mol. %) |
|---|---|---|---|---|---|---|---|---|---|---|---|
| a | PO-BPA | 35 | EO-BPA | 16 | TPA | 23 | TMA | 6 | DSA | 20 | 3.33 |
| b | " | 46 | " | 5.5 | " | 35 | " | 1.5 | " | 12 | 8.00 |

TABLE 1-continued

| Polyester resin No. | Component a | mol. % | Component b | mol. % | Component c | mol. % | Component d | A mol. % | Component e | B mol. % | B (mol. %)/ A (mol. %) |
|---|---|---|---|---|---|---|---|---|---|---|---|
| c | " | 51 | — | — | " | 31 | " | 5.5 | " | 12.5 | 2.77 |
| d | " | 35 | EO-BPA | 16 | FA | 14 | " | 7 | " | 28 | 4.00 |
| Comp. e | " | 50 | — | — | TPA | 32 | " | 5.5 | " | 12.5 | 2.77 |
| Comp. f | " | 26 | EO-BPA | 22 | FA | 34.5 | " | 16.5 | " | 1 | 0.06 |
| Comp. g | " | 15 | " | 36 | " | 47.7 | " | 0.1 | " | 1.2 | 12.0 |

(Notes)
PO-BPA: propylene oxide-modified bisphenol A
EO-BPA: ethylene oxide-modified bisphenol A
TPA: terephthalic acid
FA: fumaric acid
TMA: trimellitic acid
DSA: dodecenyl succinic acid
Component e (mol. %)/Component d (mol. %): soft segment/polycarboxylic acid (at least 3 carboxyl groups)

TABLE 2

| Polyester | Molecular weight distribution (GPC) | | | | | THF-in-soluble content | Av |
|---|---|---|---|---|---|---|---|
| resin No. | M1 (%) ≦ $1 \times 10^4$ | $1 \times 10^4$ < M2 (%) ≦ $5 \times 10^4$ | $5 \times 10^4$ < M3 (%) ≦ $5 \times 10^5$ | $5 \times 10^5$ < M4 (%) | $\times 10^3$ Mw | (wt. %) | (mgKOH/g) |
| a | 42 | 38 | 16 | 4 | 92 | 0 | 12 |
| b | 45 | 35 | 18 | 2 | 78 | 0 | 7 |
| c | 40.1 | 31 | 24.6 | 4.3 | 141 | 0 | 8.6 |
| d | 39 | 30 | 20 | 11 | 250 | 0 | 10 |
| Comp. e | 47 | 41 | 8 | 4 | 185 | 8 | 15 |
| Comp. f | 45 | 42 | 10.8 | 2.2 | 176 | 2.5 | 27 |
| Comp. g | 50 | 35 | 13 | 2 | 155 | 0 | 8 |

EXAMPLE 1

| | |
|---|---|
| Polyester resin a | 90 parts |
| Copper phthalocyanine pigment (C.I. Pigment Blue 15:3) | 4 parts |
| Polyethylene wax a (maximum heat-absorption peak temp. = 102° C., Mn = 670, Mw/Mn = 1.35) | 2 parts |
| Zirconium compound (A) (having the formula shown hereinafter) | 4 parts |

The copper-phthalocyanine pigment was pre-dispersed in Polyester resin a.

The above ingredients were sufficiently preliminarily blended by a Henschel mixer and melt-kneaded through a twin-screw kneading extruder set at 120° C. After cooling, the kneaded product was coarsely crushed by a cutter mill, finely pulverized by a pulverizer using an air jet stream and classified by a multi-division classifier utilizing the Coanda effect to obtain classified powder (toner particles A) having a weight-average particle size (D4) of 6.5 $\mu$m.

100 parts of the above-prepared toner particles A were blended by a Henschel mixer with 1.0 part of hydrophobic silica fine powder (methanol-wettability=80%, BET specific surface area=120 $m^2/g$) hydrophobized with 10 parts of hexamethyldisilazane and 10 parts of dimethylsilicone oil and 0.6 part of hydrophobic γ-alumina fine powder (methanol-wettability=70%, BET specific surface area=200 $m^2/g$) hydrophobized with 20 parts of isobutyltrimethoxysilane to obtain Cyan toner A, which exhibited properties shown in Table 4 (appearing hereinafter). The toner prescription was shown in Table 3 (appearing hereinafter).

The thus-prepared Cyan toner A was blended with Cu—Zn—Fe-based ferrite carrier (average particle size=45 $\mu$m) coated with ca. 0.35% of styrene-methyl methacrylate (65:35) copolymer so as to provide a toner concentration of 6.0% to prepare Two-component developer A.

The thus-prepared Two-component developer A was subjected to yet-unfixed toner image formation (uniform solid (yet-unfixed) toner image having a size (length=200 mm, width=150 mm) with a forward margin of 5 mm at a toner coverage of 0.7–0.8 $mg/cm^2$ on A4-plain paper copying paper ("Office Reader A4", mfd. by Canon K.K.; 64 $g/m^2$) by using a commercially available full-color copying machine ("Color Laser Copier 800", mfd. by Canon K.K.) equipped with a two-component developing device as shown in FIG. 10.

The yet-unfixed toner image thus formed was then subjected to a fixing test by using an external fixing device which included a hot-pressure rollers free from an oil applicator as shown in FIG. 11 and was capable of controlling a fixing temperature.

<Fixing Device Structure and Conditions>

Fixing roller: ø40 mm, surface layer=PFA (perfluoroalkoxyethylene)

Pressure roller: ø40 mm, surface layer=PFA

Nip width: 8 mm

Total pressing force: 40 kgf

Paper feed speed: 110 mm/sec

The yet-unfixed toner image was caused to pass through the fixing device set at respective temperatures (between 110° C. and 200° C. at an increment of 5° C.) to evaluate a fixability (gloss) and anti-offset characteristic.

Similarly, a yet-unfixed toner image was formed on an OHT sheet and then fixed on the OHT sheet at 175° C. and at a fixing speed of 35 mm/sec. The thus-fixed toner image was evaluated as to OHT light transmission characteristic by using an overhead projector (OHP).

The above-prepared Two-component developer A was then subjected to a successive image formation test on 10,000 sheets in environments of 23° C./5%RH (for fog test) and 30° C./80%RH (for developing test) by using a full-color copying machine ("Color Laser Copier 800") remodeled by replacing its fixing device with the hot-pressure roller-type fixing device free from the oil applicator shown in FIG. 11.

The evaluation results are shown in Table 5 appearing hereinbelow.

As a result, the two-component developer A provided a higher image density (good developing performance) and a lower fog concentration(good fog-suppression effect). Further, the Two-component developer A showed a lower fixing-initiation temperature of 115° C., provided a gloss of at least 10 at a relatively low temperature of 160° C. and retained a gloss of ca. 20 up to 200° C. without causing the offset phenomenon, thus exhibiting a good temperature stability of gloss.

On the OHT sheet, the resultant toner image (OHT sheet) did not cause the offset phenomenon and color reproducibility in combination. The OHT image does not have a tacky (or sticky) feel resulting from a releasing oil.

EXAMPLES 2–7

Two-component developers B–G using Cyan toners B–G shown in Tables 3 and 4 were prepared and evaluated in the same manner as in Example 1 except for appropriately changing kneading conditions (such as kneading temperature, shaft-rotating speed, paddle structure, etc.), respectively.

The evaluation results are shown in Table 5.

Comparative Examples 1–6

Comparative two-component developers H–M using Comparative toners H–M shown in Tables 3 and 4 were prepared and evaluated in the same manner as in Example 1 except that Comparative toner I was formulated in a black toner y changing the copper-phthalocyanine pigment to carbon black.

The results are shown in Table 5.

Explanation of evaluation items shown in Table 5 will be supplemented hereinbelow.

(1) Developing Performance (Image Density)

In the environment of 30° C./80%RH, evaluation was made based on a relative image density after printing out on 10,000 sheets of the PPC paper (64 g/m$^2$) by a Macbeth reflective densitometer (mfd. by Macbeth Co.) relative to a print-out image of a white ground portion having an original density of 0.00 according to the following standard:

A: ≧1.40

B: ≧1.30 and <1.40

C: ≧1.20 and <1.30

D: <1.20

(2) Fog (Density)

Image fog was evaluated by a fog density (%) based on a difference in whiteness (reflectance) between a white ground portion of a print-out image after printing out on 10,000 sheets in the environment of 23° C./5%RH and the PPC paper (64 g/m$^2$) per se before the printing based on values measured by using a reflective densitometer ("REFLECTOMETER", mfd. by Tokyo Denshoku K.K.).

A: Very good (<1.0%)

B: Good (≧1.0% and <2.0%)

C: Fair (≧2.0% and <3.0%)

D: Poor (≧3.0%).

(3) Fixability (Gloss)

Fixability was evaluated in the following manner.

A yet-unfixed toner image was fixed on the PPC paper (64 m$^2$/g) as described above. Each of the fixed toner images at various fixing temperatures rubbed with a soft tissue paper under a load of 50 g/cm$^2$, a temperature giving an image density lowering of at most 10% was evaluated as a fixing-initiation temperature ($T_{fix}$). Similarly, a temperature causing an offset phenomenon was taken as an offset temperature ($T_{offset}$), and a temperature giving a gloss of at least 10 was taken as gloss temperature ($T_{gloss}$). Further, an anti-offset performance was evaluated based on a temperature range not causing the offset phenomenon.

Gloss of the fixed image was measured by using a handy gloss meter ("Gloss Meter PG-3D", available from Nippon Denshoku Kogyo K.K) at a light incident angle of 75 deg.

(4) OHT Image Transparency

Transparency (light-transmission performance) on the OHT sheet was evaluated according to the following standard:

A: Excellent transparency and color reproducibility with no irregularity in color value at the toner image portion and no occurrence of the offset phenomenon.

B: Irregularity in color value was somewhat caused to occur but was at practically acceptable level.

C: Irregularity in color value was caused to occur and color reproducibility was poor.

(5) Winding of Paper About Fixing Roller

In the fixing test, a temperature causing the winding of the PPC paper (64 m$^2$/g) about the fixing roller was evaluated as a winding temperature ($T_{winding}$).

TABLE 3

| | | | Wax | | | | | | Organic metal compound | | |
|---|---|---|---|---|---|---|---|---|---|---|---|
| Toner No. | Polyester resin No. | Colorant content* (wt. Parts) | Species*2 | Content*3 (wt. %) | Viscosity*4 (mPa · s) | Max. peak*5 (° C.) | Mn | Mw/Mn | Organic metal compound (shown below) | Content*6 C (wt. %) | Product*7 (A mol. % × C wt. %) |
| A | a | 4.4 | PE wax a | 2 | 31 | 102 | 670 | 1.35 | Zr compound (A) | 4 | 24 |
| B | b | 4.4 | P wax b | 2 | 17 | 75 | 390 | 1.50 | Zr compound (A) | 3 | 4.5 |
| C | c | 4.4 | FTH wax c | 2 | 21 | 99 | 1200 | 1.70 | Zr compound (B) | 4.5 | 38.5 |
| D | d | 4.4 | HA-based wax d | 2 | 29 | 105 | 470 | 1.97 | Cr compound (C) | 5 | 46.75 |

TABLE 3-continued

| Toner No. | Polyester resin No. | Colorant content* (wt. Parts) | Wax: Species*2 | Wax: Content*3 (wt. %) | Wax: Viscosity*4 (mPa · s) | Wax: Max. peak*5 (° C.) | Wax: Mn | Wax: Mw/Mn | Organic metal compound: Organic metal compound (shown below) | Organic metal compound: Content*6 C (wt. %) | Organic metal compound: Product*7 (A mol. % × C wt. %) |
|---|---|---|---|---|---|---|---|---|---|---|---|
| E | a | 4.4 | PE wax e | 4.5 | not measurable | 128 | 2400 | 1.25 | Zr compound (A) | 4 | 24 |
| F | a | 4.4 | PE wax a | 2 | 32 | 102 | 670 | 1.35 | Al compound (D) | 4 | 24 |
| G | b | 4.4 | PE wax b | 2 | 15 | 75 | 390 | 1.50 | Cr compound (E) | 3 | 4.5 |
| H | Comp. e | 4.4 | PE wax f | 3 | not measurable | 136 | 1650 | 1.50 | Zn compound (F) | 4.5 | 22 |
| I | Comp. f | 4.4 | PP wax g | 3 | not measurable | 145 | 830 | 4.50 | Cr compound (C) | 4 | 66 |
| J | Comp. g | 4.4 | PE wax h | 2 | 29 | 109 | 550 | 3.00 | Cr compound (G) | 4 | 0.4 |
| K | Comp. f | 4.4 | PE wax a | 2 | 20 | 102 | 670 | 1.35 | Zr compound (A) | 4 | 66 |
| L | a | 4.4 | PP wax g | 2 | not measurable | 145 | 830 | 4.50 | Zr compound (A) | 4 | 24 |
| M | b | 4.4 | P wax b | 10 | 18 | 75 | 390 | 1.50 | Zr compound (A) | 3 | 4.5 |

Notes:
*1Wt. parts per 100 wt. parts of the resinous component.
*2PE (polyethylene, P (paraffin), FTH (Fischer-Tropsch hydrocarbon), HA (higher alcohol), PP (polypropylene).
*3,*6Content in the toner.
*4Wax viscosity when G" = 1 × $10^4$ Pa.
*5Maximum heat-absorption peak temperature (° C.).
*7Product of A (mol. %) of component d (Table 1) and the content C (wt. %) of the organic metal compound.

<Original Metal Compound>

(A)

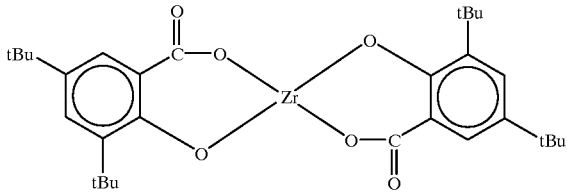

Zirconium compound (A)

(B)

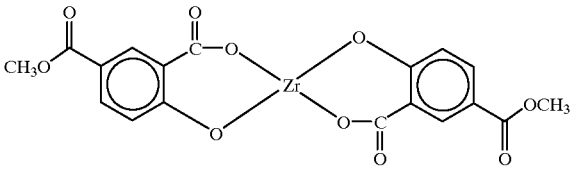

Zirconium compound (B)

(C)

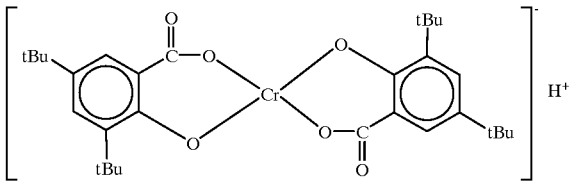

Chromium compound (C)

(D)

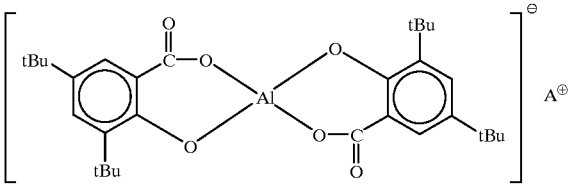

Aluminum compound (D)

-continued (E)

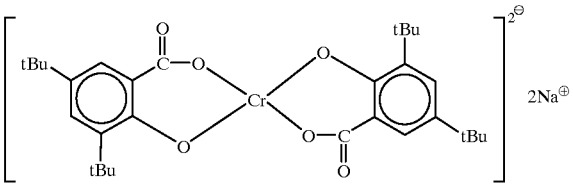

Chromium compound (E)

(F)

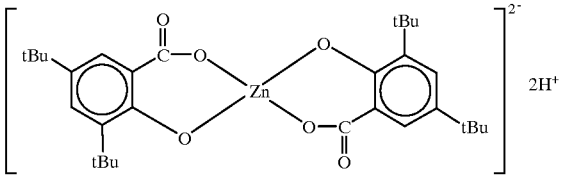

Zinc compound (F)

(G)

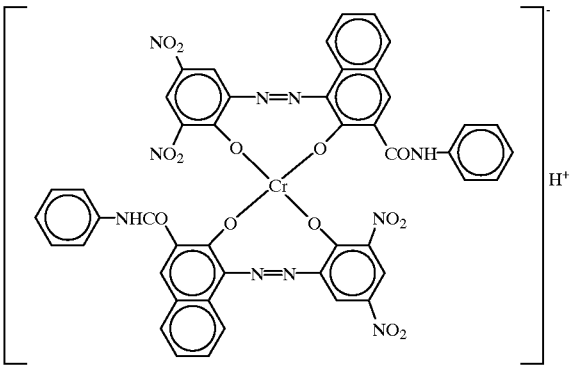

Chromium compound (G)

TABLE 4

| Toner No. | Viscoelasticities of toners: Temp. (° C.) giving G" = 1 × $10^4$–3 × $10^4$ Pa: G" = 3 × $10^4$ Pa | G" = 2 × $10^4$ Pa | G" = 1 × $10^4$ Pa | Tan δ: G" = 3 × $10^4$ Pa(X) | G" = 2 × $10^4$ Pa | G" = 1 × $10^4$ Pa(Y) | 170° C. | 150° C. | tan δ 170/ tan δ 150 | G' 170 (× $10^3$ Pa) | G" 170 (× $10^3$ Pa) | tan δ (X) − tan δ (Y)*1 |
|---|---|---|---|---|---|---|---|---|---|---|---|---|
| A | 100 | 105 | 117 | 1.17 | 1.14 | 1.08 | 1.94 | 1.55 | 1.25 | 0.32 | 0.62 | 0.09 |
| B | 96 | 100 | 108 | 1.21 | 1.14 | 1.22 | 1.74 | 1.44 | 1.21 | 0.27 | 0.47 | 0.01 |
| C | 108 | 118 | 132 | 0.82 | 0.86 | 0.96 | 1.65 | 1.20 | 1.38 | 0.64 | 1.00 | 0.14 |
| D | 112 | 119 | 134 | 0.79 | 0.71 | 0.61 | 0.56 | 0.42 | 1.33 | 7.50 | 4.20 | 0.18 |
| E | 101 | 105 | 118 | 1.21 | 1.12 | 1.10 | 1.89 | 1.53 | 1.24 | 0.32 | 0.60 | 0.09 |
| F | 102 | 106 | 116 | 1.24 | 1.14 | 1.00 | 0.82 | 0.58 | 1.41 | 1.90 | 1.55 | 0.20 |
| G | 98 | 102 | 111 | 1.68 | 1.60 | 1.33 | 0.80 | 0.57 | 1.40 | 2.32 | 1.85 | 0.35 |
| Comp. H | 105 | 109 | 116 | 1.58 | 1.44 | 1.10 | 0.36 | 0.32 | 1.13 | 7.80 | 2.80 | 0.48 |
| Comp. I | 116 | 123 | 135 | 0.79 | 0.75 | 0.65 | 0.68 | 0.50 | 1.36 | 5.00 | 3.40 | 0.14 |
| Comp. J | 122 | 128 | 140 | 1.35 | 1.51 | 1.74 | 2.05 | 1.90 | 1.08 | 0.88 | 1.80 | 0.39 |
| Comp. K | 117 | 123 | 133 | 0.76 | 0.80 | 0.88 | 1.42 | 1.15 | 1.23 | 2.95 | 4.20 | 0.12 |
| Comp. L | 100 | 105 | 118 | 1.17 | 1.08 | 1.03 | 1.77 | 1.41 | 1.26 | 0.40 | 0.71 | 0.14 |
| Comp. M | 92 | 96 | 104 | 1.21 | 1.15 | 1.05 | 1.99 | 1.62 | 1.22 | 0.11 | 0.22 | 0.16 |

| Toner No. | THF-insoluble content (wt. %) | Molecular weight distribution of THF-soluble content*3: Mp*2 (× $10^3$) | Mw/Mn | M1 ≦ $10^4$ (%) | $10^4$ < M2 ≦ 5 × $10^4$ (%) | 5 × $10^4$ < M3 ≦ 5 × $10^5$ (%) | 5 × $10^5$ < M4 (%) | M1 + M2 (%) | Max peak*4 (° C.) |
|---|---|---|---|---|---|---|---|---|---|
| A | 6.4 | 8.7 | 535 | 47.2 | 35.5 | 12.5 | 4.8 | 82.7 | 102 |
| B | 5.1 | 7.2 | 270 | 45.0 | 39.2 | 8.6 | 7.2 | 84.2 | 75 |
| C | 12.4 | 11.6 | 163 | 39.0 | 37.6 | 14.6 | 8.8 | 76.6 | 99 |
| D | 14.9 | 22.0 | 104 | 39.0 | 36.1 | 19.1 | 5.8 | 75.1 | 105 |
| E | 8.9 | 6.9 | 528 | 47.2 | 35.1 | 12.8 | 4.9 | 82.3 | 128 |
| F | 9.8 | 6.9 | 155 | 48.6 | 36.4 | 9.6 | 5.4 | 85.0 | 102 |
| G | 8.1 | 7.2 | 325 | 44.6 | 38.2 | 8.4 | 8.8 | 82.8 | 75 |
| Comp. H | 26.1 | 6.3 | 861 | 53.6 | 40.1 | 5.1 | 1.2 | 93.7 | 136 |
| Comp. I | 32.0 | 23.1 | 89 | 42.1 | 36.6 | 12.3 | 9.0 | 78.7 | 145 |
| Comp. J | 0 | 31.3 | 11.5 | 44.2 | 45.9 | 8.2 | 1.7 | 90.1 | 109 |
| Comp. K | 15.0 | 23.1 | 62 | 42.5 | 40.2 | 11.1 | 6.2 | 82.7 | 102 |
| Comp. L | 9.0 | 6.9 | 541 | 47.1 | 35.3 | 12.6 | 5.0 | 82.4 | 145 |
| Comp. M | 3.2 | 7.2 | 192 | 45.3 | 40.3 | 7.9 | 6.5 | 85.6 | 75 |

Notes:
*1Difference between tan δ(X) (at G" = 3 × $10^4$ Pa) and tan δ(Y) (at G" = 1 × $10^4$ Pa).
*2Mp (main peak molecular weight)
*3Molecular weight distribution of THF-soluble content in the toner according to GPC.
*4Maximum heat-absorption peak temperature.

TABLE 5

| Ex. No. | Toner No. | Evaluation results: Fixability: Tfix (° C.) | Toffset (° C.) | Tgloss (° C.) | Developing | Fog (%) | OHT transparency | Twinding (° C.) |
|---|---|---|---|---|---|---|---|---|
| Ex. 1 | A | 115 | ≧200 | 160 | A | A | A | — |
| Ex. 2 | B | 110 | 185 | 140 | A | B | A | — |
| Ex. 3 | C | 120 | ≧200 | 170 | B | B | B | — |
| Ex. 4 | D | 130 | ≧200 | 180 | B | C | B | — |
| Ex. 5 | E | 150 | ≧200 | 160 | B | B | B | up to 145 |
| Ex. 6 | F | 115 | ≧200 | 150 | A | A | A | — |
| Ex. 7 | G | 110 | ≧200 | 140 | A | B | B | — |
| Comp. Ex. 1 | H | 140 | 150 | 140 | B | C | offset | up to 135 |
| Comp. Ex. 2 | I | 170 | ≧200 | none | C | D | not evaluated* | up to 165 |
| Comp. Ex. 3 | J | 125 | 130 | none | D | D | offset | — |
| Comp. Ex. 4 | K | 160 | ≧200 | none | A | A | C | — |
| Comp. Ex. 5 | L | 160 | ≧200 | 160 | A | A | A | up to 155 |
| Comp. Ex. 6 | M | 110 | 165 | 135 | C | C | B | — |

*Not evaluated due to the black toner image.

EXAMPLE 8

The fixing device shown in FIG. 11 used in the (remodeled) fill-color copying apparatus ("Color Laser Copier 800") used in Example 1 was modified so that a silicon oil-impregnating pad was pressed against the fixing roller surface to provide a fixed toner image surface on the PPC paper with an oil application (supply) amount (per unit area of the PPC paper) of at most $3\times10^{-8}$ g/cm$^2$, and was subjected to successive image formation similarly as in Example 1.

As a result, good image-forming performances similar to those in Example 1 were confirmed.

Similarly as in Example 1, when formation of the OHT image was also performed by using the above-modified apparatus, good results substantially equivalent to those in Example 1 were attained. Further, the resultant OHT image had substantially no tacky feel (resulting from the oil application), thus being practically of no problem.

Comparative Example 7

The Comparative two-component developer H using the Comparative toner H prepared in Comparative Example 1 was evaluated in the same manner as in Example 8 except that the oil application amount (a most $3\times10^{-8}$ g/cm$^2$) was changed to $5\times10^{-6}$–$5\times10^{-7}$ g/cm$^2$.

As a result, although the temperature range causing no winding about the fixing roller and no offset phenomenon was broadened to 110–180° C., the resultant OHT image had unpleasant tacky feel resulting from the excessive oil application.

EXAMPLE 9

Magenta toner N, Yellow toner O, and Black toner P were prepared in the same manner as in Example 1 except for using C.I. Pigment Red 122, C.I. Pigment Yellow 113, and carbon black, respectively, in place of the copper-phthalocyanine pigment.

Two-component developers N, O and P were prepared in the same manner as in Example 1 by using the above-prepared Magenta toner N, Yellow toner O and Black toner P, respectively.

The thus-prepared three developers N, O and P and the developer A prepared in Example 1 were subjected to full-color image formation by using the (remodeled) full-color copying apparatus "Color Laser Copier 800") used in Example 1.

As a result, although the oil-less fixation was performed, full-color continuous printing using the four-color developers did not cause separation problem as to the PPC paper (64 m$^2$/g) from the fixing roller and provided good fixed toner images excellent in color reproducibility. Further, there was no fluctuation in gloss in the successive printing operation, thus stably providing a natural glossy image (gloss of ca. 15–25) free from glistening portion throughout the continuous printing.

Further, when a full-color toner image was fixed on a OHT sheet at 175° C. at a fixing speed of 35 mm/sec, the resultant full-color toner image had no tacky feel at all.

When the full-color OHT image was projected by using the OHP, the resultant full-color image was excellent in color reproducibility and light-transmission performance in combination.

RESIN PORDUCTION EXAMPLE II

Polyester resins and comparative polyester resins used in Examples and Comparative Examples were prepared through co-polycondensation by using compositions comprising alcohol and acid components indicated in Table 6, respectively.

The thus-obtained Polyester resin h–k exhibited physical properties (molecular weight distribution, THF-insoluble content and acid value (Av)) as shown in Table 7.

TABLE 6

| Polyester resin No. | Component a | mol. % | Component b | mol. % | Component c | mol. % | Component d | A mol. % | Component e | B mol. % | B (mol. %)/ A (mol. %) |
|---|---|---|---|---|---|---|---|---|---|---|---|
| h | PO-BPA | 20 | EO-BPA | 31 | TPA | 30 | TMA | 4 | DSA | 15 | 3.75 |
| I | " | 15 | " | 35 | " | 15 | FA | 35 | — | — | — |
| j | " | 49 | — | — | " | 20 | TMA | 6 | DSA | 25 | 6.25 |
| k | " | 30 | EO-BPA | 15 | FA | 40 | TMA | 15 | — | — | — |

TABLE 7

| Polyester resin No. | Molecular weight distribution (GPC) M1 (%) $\leqq 1\times10^4$ | $1\times10^4 <$ M2 (%) $\leqq 5\times10^4$ | $5\times10^4 <$ M3 (%) $\leqq 5\times10^5$ | $5\times10^5 <$ M4 (%) | $\times10^4$ Mw | THF-insoluble content (wt. %) | Av (mgKOH/g) |
|---|---|---|---|---|---|---|---|
| h | 47.6 | 39.7 | 10.1 | 2.6 | 5 | 0 | 14 |
| I | 72.0 | 28.0 | 0 | 0 | 1.5 | 0 | 10 |
| j | 38.5 | 35.2 | 20.7 | 5.6 | 15 | 2 | 25 |
| k | 40.5 | 28.1 | 21.9 | 9.5 | 20 | 20 | 10 |

EXAMPLE 10

| | |
|---|---|
| Polyester resin i | 45 parts |
| Polyester resin j | 45 parts |
| Copper phthalocyanine pigment (C.I. Pigment Blue 15:3) | 4 parts |
| Polyethylene wax a (maximum heat-absorption peak temp. = 102° C., Mn = 670, Mw/Mn = 1.35) | 2 parts |
| Zirconium compound (A) | 4 parts |

By using the above ingredients, toner particles Q having a weight-average particle size of 6.7 μm were prepared in the same manner as in Example 1.

100 parts of the above-prepared toner particles Q were blended by a Henschel mixer with 0.4 part of hydrophobic silica fine powder (methanol-wettability=80%, BET specific surface area=120 $m^2/g$) hydrophobized with 10 parts of hexamethyldisilazane and 10 parts of dimethylsilicone oil and 0.8 part of hydrophobic γ-alumina fine powder (methanol-wettability=70%, BET specific surface area=200 $m^2/g$) hydrophobized with 20 parts of isobutyltrimethoxysilane to obtain Cyan toner Q, which exhibited properties shown in Table 9 (appearing hereinafter). The toner prescription was shown in Table 8 (appearing hereinafter).

The thus-prepared Cyan toner Q was subjected to yet-unfixed toner image formation (uniform solid (yet-unfixed) toner image having a size (length=200 mm, width=150 mm) with a forward margin of 5 mm at a toner coverage of 0.7–0.8 $mg/cm^2$ on A4-plain paper copying paper ("Office Reader A4", mfd. by Canon K.K.; 64 $g/m^2$) by using a commercially available laser beam printer ("LBP-2160" mfd. by Canon K.K.) equipped with a two-component developing device as shown in FIG. 8.

The yet-unfixed toner image thus formed was then subjected to a fixing test by using an external fixing device which included a hot-pressure rollers free from an oil applicator as shown in FIG. 11 and was capable of controlling a fixing temperature.

The yet-unfixed toner image was caused to pass through the fixing device set at respective temperatures (between 120° C. and 200° C. at an increment of 10° C.) to evaluate a fixability (gloss) and anti-offset characteristic.

Similarly, a yet-unfixed toner image was formed on an OHT sheet and then fixed on the OHT sheet at 175° C. and at a fixing speed of 35 mm/sec. The thus-fixed toner image was evaluated as to OHT light transmission characteristic by using an overhead projector (OHP).

The above-prepared Cyan toner Q was also subjected to evaluation as to anti-winding performance at a toner coverage of 1.1–1.2 $mg/cm^2$ (ca. 1.5 times that of the fixing test) (as a disadvantageous condition).

The evaluation results are shown in Table 10 appearing hereinbelow.

As shown in Table 10, the two-component developer Q provided a broader temperature range giving better gloss-image (gloss=10–25) of 160–200° C. without causing the winding and offset phenomena.

On the OHT sheet, the resultant toner image (OHT sheet) did not cause the offset phenomenon and color reproducibility in combination. The OHT image does not have a tacky (or sticky) feel resulting from a releasing oil.

EXAMPLES 11–13

Cyan toners R–T shown in Tables 8 and 9 were prepared and evaluated in the same manner as in Example 10 except for appropriately changing kneading conditions (such as kneading temperature, shaft-rotating speed, paddle structure, etc.), respectively.

The evaluation results are shown in Table 10.

Comparative Examples 8–10

Comparative cyan toners U–W shown in Tables 8 and 9 were prepared and evaluated in the same manner as in Example 10 except for appropriately changing kneading conditions (such as kneading temperature, shaft-rotating speed, paddle structure, etc.), respectively.

The evaluation results are shown in Table 10.

TABLE 8

| | | | Wax | | | | | | | Organic metal compound | | |
|---|---|---|---|---|---|---|---|---|---|---|---|---|
| Toner No. | Polyester resin No. | Colorant content* (wt. Parts) | Species*2 | Content*3 (wt. %) | Viscosity*4 (mPa · s) | Max. peak*5 (° C.) | Mn | Mw/Mn | Organic metal compound (shown below) | Content*6 C (wt. %) | Product*7 (A mol. % × C wt. %) |
| Q | i (50) j (50) | 4.4 | PE wax a | 2 | 32 | 102 | 670 | 1.35 | Zr compound (A) | 5 | 12 |
| R | i (30) j (70) | 4.4 | FTH wax c | 2 | 23 | 99 | 1200 | 1.70 | Al compound (D) | 2 | 8.4 |
| S | h | 4.4 | PE wax a | 2 | 20 | 102 | 670 | 1.35 | Cr compound (E) | 6 | 24 |
| T | j | 4.4 | a | 2 | 29 | 102 | 670 | 1.35 | Cr compound (E) | 0.5 | 3 |
| U | i (70) j (30) | 4.4 | e | 2 | not measurable | 128 | 2400 | 1.25 | Al compound (D) | 4 | 7.2 |
| V | i (70) k (30) | 4.4 | a | 2 | 39 | 102 | 670 | 1.35 | Zr compound (A) | 4 | 18 |
| W | i | 4.4 | P wax b | 2 | 21 | 75 | 390 | 1.50 | Al compound (D) | 4 | — |

TABLE 9

| Toner No. | Viscoelasticities of toners: Temp.(° C.) giving G" = 1 × 10⁴ – 3 × 10⁴ Pa: G" = 3 × 10⁴ Pa | G" = 2 × 10⁴ Pa | G" = 1 × 10⁴ Pa | Tan δ: G" = 3 × 10⁴ Pa(X) | G" = 2 × 10⁴ Pa | G" = 1 × 10⁴ Pa(Y) | 170° C. | 150° C. | tan δ 170/ tan δ 150 | G'170 (×10³ Pa) | G"170 (×10³ Pa) | tan δ (X) – tan δ (Y) *1 |
|---|---|---|---|---|---|---|---|---|---|---|---|---|
| Q | 100 | 105 | 117 | 1.22 | 1.12 | 1.13 | 1.97 | 1.55 | 1.27 | 0.29 | 0.57 | 0.09 |
| R | 107 | 114 | 128 | 0.91 | 0.94 | 1.02 | 1.78 | 1.50 | 1.19 | 0.63 | 1.12 | −0.11 |
| S | 110 | 115 | 134 | 0.93 | 0.79 | 0.60 | 0.55 | 0.51 | 1.07 | 5.5 | 3.0 | 0.33 |
| T | 102 | 107 | 120 | 1.44 | 1.42 | 1.51 | 1.90 | 1.61 | 1.18 | 0.41 | 0.78 | −0.07 |
| U | 105 | 109 | 118 | 1.74 | 1.64 | 1.53 | 0.69 | 0.65 | 1.06 | 1.80 | 1.12 | 0.21 |
| V | 105 | 109 | 116 | 1.60 | 1.42 | 1.10 | 0.42 | 0.32 | 1.30 | 6.0 | 2.5 | 0.50 |
| Comp. W | 89 | 94 | 99 | 3.6 | 4.2 | 4.4 | 1.86 | 2.2 | 0.85 | 0.22 | 0.41 | −0.8 |

| Toner No. | THF-insulable content (wt. %) | Molecular weight distribution of THF-soluble content *3: Mp *2 (×10³) | Mw/Mn | M1 ≦ 10⁴ (%) | 10⁴ < M2 ≦5 × 10⁴ (%) | 5 × 10⁴ < M3 ≦5 × 10⁵ (%) | 5 × 10⁵ < M4 (%) | M1 + M2 (%) | Max peak *4 (° C.) |
|---|---|---|---|---|---|---|---|---|---|
| Q | 5.3 | 6.5 | 535 | 52 | 30 | 18 | 10 | 82 | 102 |
| R | 9.8 | 11.0 | 280 | 40 | 36 | 16 | 8 | 76 | 99 |
| S | 12.1 | 10.0 | 140 | 38 | 36 | 19 | 7 | 74 | 102 |
| T | 4.4 | 11.0 | 220 | 47 | 37 | 10 | 6 | 84 | 102 |
| U | 2.1 | 6.5 | 63 | 60 | 36 | 2 | 2 | 96 | 128 |
| V | 15.6 | 6.5 | 84 | 55 | 39 | 5 | 1 | 94 | 102 |
| Comp. W | 0 | 6.5 | 32 | 47 | 48 | 4 | 1 | 95 | 75 |

TABLE 10

| Ex. No. | Toner No. | Evaluation results: Gloss at toner coverage of 0.7–0.8 mg/cm²: 120° C. | 130° C. | 140° C. | 150° C. | 160° C. | 170° C. | 180° C. | 190° C. | 200° C. | Twinding of toner coverage of 1.1–1.2 mg/cm² | OHT trans-parency | Offset on OHT sheet |
|---|---|---|---|---|---|---|---|---|---|---|---|---|---|
| Ex. 10 | Q | 3.1 | 5.1 | 6.8 | 9.7 | 14.6 | 18.3 | 21.8 | 22.3 | 16 | 120–200° C. | A | Not occurred |
| Ex. 11 | R | 4.1 | 5.6 | 8.2 | 11.3 | 15.8 | 19.6 | 21.1 | 21.1 | 13.9 | 120–190° C. | A | " |
| Ex. 12 | S | 1.9 | 2.6 | 3.5 | 2.7 | 5.0 | 7.0 | 8.3 | 10.2 | 10.9 | 120–200° C. | B | " |
| Ex. 13 | T | 5.3 | 9.5 | 12.5 | 20.3 | 25.8 | 29.4 | 26.5 | 19.5 | x | 120–160° C. | A | " |
| Comp. Ex. 8 | Comp. U | x | x | x | 14.3 | 21.1 | 23.2 | 26.6 | x | x | 150–160° C. | A | Somewhat occurred |
| Comp. Ex. 9 | Comp. V | x | 6.5 | 10.7 | 17.2 | 21.2 | x | x | x | x | 130–140° C. | — | Occurred |
| Comp. Ex. 10 | Comp. W | 22 | 28.8 | x | x | x | x | x | x | x | 130° C. | — | Occurred |

x: Winding/offset occurred.
—: Not evaluated due to occurred of offset.

EXAMPLE 14

Magenta toner X, Yellow toner Y, and Black toner Z were prepared in the same manner as in Example 10 except for using C.I. Pigment Red 122, C.I. Pigment Yellow 113, and carbon black, respectively, in place of the copper-phthalocyanine pigment.

The thus-prepared three toners X, Y and Z and the toner Q prepared in Example 10 were subjected to full-color image formation by using the (remodeled) full-color copying apparatus ("LBP-2160") used in Example 10.

As a result, although the oil-less fixation was performed, full-color continuous printing using the four-color toners X, Y, Z and Q did not cause separation problem as to the PPC paper (64 m²/g) from the fixing roller and provided good fixed toner images excellent in color reproducibility. Further, there was no fluctuation in gloss in the successive printing operation, thus stably providing a natural glossy image (gloss of ca. 15–25) free from glistening portion throughout the continuous printing.

Further, when a full-color toner image was fixed on a OHT sheet at 175° C. at a fixing speed of 35 mm/sec, the resultant full-color toner image had no tacky feel at all.

When the full-color OHT image was projected by using the OHP, the resultant full-color image was excellent in color reproducibility and light-transmission performance in combination.

EXAMPLE 15

A fixing device used in a laser beam printer test machine as shown in FIG. 4 was modified so that a silicon oil-impregnating web 70 was pressed against the fixing roller surface to provide a fixed toner image surface on the PPC paper with an oil application (supply) amount (per unit area of the PPC paper) of at most $3\times10^{-8}$ g/cm$^2$, and was subjected to successive full-color image formation similarly as in Example 14.

As a result, good image-forming performances similar to those in Example 14 were confirmed.

Similarly as in Example 14, when formation of the OHT image was also performed by using the above-modified apparatus, good results substantially equivalent to those in Example 14 were attained. Further, the resultant OHT image had substantially no tacky feel (resulting from the oil application), thus being practically of no problem.

What is claimed is:

1. A toner comprising: at least a binder resin, a colorant and a wax, wherein the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

2. The toner according to claim 1, wherein the toner contains a THF-insoluble content of 0–15.0 wt. % based on a weight of an entire resinous component of the toner.

3. The toner according to claim 1, wherein the toner contains a THF-insoluble content of 1–10.0 wt. % based on a weight of an entire resinous component of the toner.

4. The toner according to claim 1, wherein the THF-soluble content exhibits a molecular weight distribution according to GPC chromatogram providing a ratio (Mw/Mn) of 105–2,000.

5. The toner according to claim 1, wherein the THF-soluble content exhibits a molecular weight distribution according to GPC chromatogram including a content (M1) of a component having molecular weights of at most $1\times10^4$ of 35–55%, a content (M2) of a component having molecular weights above $1\times10^4$ and at most $5\times10^4$ of 30–45%, a content (M3) of a component having molecular weights above $5\times10^4$ and at most $5\times10^5$ of 8–20%, and a content (M4) of a component having molecular weights above $5\times10^5$ of 2–12%, said contents M1, M2, M3 and M4 satisfying the following relationships:

$75\% \leqq M1+M2 \leqq 90\%$, and $M1>M2>M3>M4$.

6. The toner according to claim 1, wherein said viscoelastic characteristic includes a ratio (tan $\delta_{170}$/tan $\delta_{150}$) of 1.15–1.4.

7. The toner according to claim 1, wherein said viscoelastic characteristic includes a temperature giving a loss modulus G" of $1\times10^4$ Pa of 110–130° C.

8. The toner according to claim 1, wherein said viscoelastic characteristic includes a temperature giving a loss modulus G" of $3\times10^4$ Pa of 95–110° C.

9. The toner according to claim 1, wherein said viscoelastic characteristic includes a tan δ (G"/G') when G"=$1\times10^4$–$3\times10^4$ Pa of 0.7–1.5.

10. The toner according to claim 1, wherein said viscoelastic characteristic includes a tan δ (G"/G') when G"=$3\times10^4$ Pa and a tan δ (G"/G') when G"=$1\times10^4$ Pa providing a difference therebetween of below 0.4 as an absolute value.

11. The toner according to claim 1, wherein the toner has a maximum heat-absorption peak of 60–125 ° C. as measured by DSC.

12. The toner according to claim 1, wherein the toner has a maximum heat-absorption peak of 60–120° C. as measured by DSC.

13. The toner according to claim 1, wherein the wax has a viscosity of 5–200 mPa.s at a temperature giving a loss modulus G" of $1\times10^4$ Pa as measured at an angular frequency of 6.28 rad/sec.

14. The toner according to claim 1, wherein the wax exhibits a molecular weight distribution according to GPC chromatogram providing a ratio (Mw/Mn) of 1.0–2.0.

15. The toner according to claim 14, wherein said Mn is 200–2,000 and said Mw is 200–2,500.

16. The toner according to claim 1, wherein the wax comprises a hydrocarbon wax.

17. The toner according to claim 1, wherein the wax comprises a polyethylene wax.

18. The toner according to claim 1, wherein the toner contains the wax in an amount of 0.3–5.0 wt. %.

19. The toner according to claim 1, wherein the toner contains the wax in an amount of 0.5–5.0 wt. %.

20. The toner according to claim 1, wherein the toner contains an organic metal compound.

21. The toner according to claim 1, wherein the binder resin comprises a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5 \leqq A \leqq 10$, $5 \leqq B \leqq 30$, and $2 \leqq B/A \leqq 10$.

22. The toner according to claim 1, wherein the toner contains C mol. % of an organic metal compound and, as the binder resin, a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5 \leqq A \leqq 10$, $5 \leqq B \leqq 30$, $2 \leqq B/A \leqq 10$, $0.2 \leqq C \leqq 10$, and $2 \leqq A \times C \leqq 50$.

23. The toner according to claim 21, wherein said saturated or unsaturated aliphatic hydrocarbon group having 5–30 carbon atoms is incorporated into a polyester resin skeleton as a branched chain.

24. The toner according to claim 20, wherein the organic metal compound is a metal compound selected from the group consisting of a monoazo metal complex, an acetylacetone metal complex, a salicylic acid metal complex, an alkylsalicylic acid metal complex, dialkylsalicylic acid metal complex, an oxynaphthoic acid metal complex, a polycarboxylic acid metal complex, and a carboxylic acid metal salt.

25. The toner according to claim 20, wherein the organic metal compound is an organic metal compound comprising a coordination or/and a bonding of a metal comprising aluminum or zirconium with an aromatic compound selected from the group consisting of aromatic diols, aromatic hydroxycarboxylic acids, aromatic monocarboxylic acids, and aromatic polycarboxylic acids.

26. The toner according to claim 1, wherein the binder resin has an acid value of 2–20 mgKOH/g.

27. The toner according to claim 1, wherein the toner is a color toner comprising a dye or a pigment as the colorant.

28. The toner according to claim 1, wherein the toner is a cyan toner containing a cyan colorant adapted to form a full-color image by a combination of at least the cyan toner, a magenta toner, a yellow toner and a black toner.

29. The toner according to claim 1, wherein the toner is a magenta toner containing a magenta colorant adapted to form a full-color image by a combination of a cyan toner, the magenta toner, a yellow toner and a black toner.

30. The toner according to claim 1, wherein the toner is a yellow toner containing a yellow colorant adapted to form a full-color image by a combination of at least a cyan toner, a magenta toner, the yellow toner and a black toner.

31. The toner according to claim 1, wherein the toner is a black toner containing a black colorant adapted to form a full-color image by a combination of a cyan toner, a magenta toner, a yellow toner and the black toner.

32. A two-component type developer comprising:

a toner and a carrier, said toner comprising at least a binder resin, a colorant and a wax, wherein the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when $G''=1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

33. The developer according to claim 32, wherein the toner contains a THF-insoluble content of 0–15.0 wt. % based on a weight of an entire resinous component of the toner.

34. The developer according to claim 32, wherein the toner contains a THF-insoluble content of 1–10.0 wt. % based on a weight of an entire resinous component of the toner.

35. The developer according to claim 32, wherein the THF-soluble content exhibits a molecular weight distribution according to GPC chromatogram providing a ratio (Mw/Mn) of 105–2,000.

36. The developer according to claim 32, wherein the THF-soluble content exhibits a molecular weight distribution according to GPC chromatogram including a content (M1) of a component having molecular weights of at most $1\times10^4$ of 35–55%, a content (M2) of a component having molecular weights above $1\times10^4$ and at most $5\times10^4$ of 30–45%, a content (M3) of a component having molecular weights above $5\times10^4$ and at most $5\times10^5$ of 8–20%, and a content (M4) of a component having molecular weights above $5\times10^5$ of 2–12%, said contents M1, M2, M3 and M4 satisfying the following relationships:

$75\% \leqq M1+M2 \leqq 90\%$, and $M1>M2>M3>M4$.

37. The developer according to claim 32, wherein said viscoelastic characteristic includes a ratio (tan $\delta_{170}$/tan $\delta_{150}$) of 1.15–1.4.

38. The developer according to claim 32, wherein said viscoelastic characteristic includes a temperature giving a loss modulus G" of $1\times10^4$ Pa of 110–130° C.

39. The developer according to claim 32, wherein said viscoelastic characteristic includes a temperature giving a loss modulus G" of $3\times10^4$ Pa of 95–110° C.

40. The developer according to claim 32, wherein said viscoelastic characteristic includes a tan δ (G"/G') when $G''=1\times10^4$–$3\times10^4$ Pa of 0.7–1.5.

41. The developer according to claim 32, wherein said viscoelastic characteristic includes a tan δ (G"/G') when $G''=3\times10^4$ Pa and a tan δ (G"/G') when $G''=1\times10^4$ Pa providing a difference therebetween of below 0.4 as an absolute value.

42. The developer according to claim 32, wherein the toner has a maximum heat-absorption peak of 60–125° C. as measured by DSC.

43. The developer according to claim 32, wherein the toner has a maximum heat-absorption peak of 60–120° C. as measured by DSC.

44. The developer according to claim 32, wherein the wax has a viscosity of 5–200 mPa.s at a temperature giving a loss modulus G" of $1\times10^4$ Pa as measured at an angular frequency of 6.28 rad/sec.

45. The developer according to claim 32, wherein the wax exhibits a molecular weight distribution according to GPC chromatogram providing a ratio (Mw/Mn) of 1.0–2.0.

46. The developer according to claim 45, wherein said Mn is 200–2,000 and said Mw is 200–2,500.

47. The developer according to claim 32, wherein the wax comprises a hydrocarbon wax.

48. The developer according to claim 32, wherein the wax comprises a polyethylene wax.

49. The developer according to claim 32, wherein the toner contains the wax in an amount of 0.3–5.0 wt. %.

50. The developer according to claim 32, wherein the toner contains the wax in an amount of 0.5–5.0 wt. %.

51. The developer according to claim 32, wherein the toner contains an organic metal compound.

52. The developer according to claim 32, wherein the binder resin comprises a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5 \leqq A \leqq 10$, $5 \leqq B \leqq 30$, and $2 \leqq B/A \leqq 10$.

53. The developer according to claim 32, wherein the toner contains C mol. % of an organic metal compound and, as the binder resin, a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5 \leqq A \leqq 10$, $5 \leqq B \leqq 30$, $2 \leqq B/A \leqq 10$, $0.2 \leqq C \leqq 10$, and $2 \leqq A \times C \leqq 50$.

54. The developer according to claim 52, wherein said saturated or unsaturated aliphatic hydrocarbon group having 5–30 carbon atoms is incorporated into a polyester resin skeleton as a branched chain.

55. The developer according to claim 51, wherein the organic metal compound is a metal compound selected from the group consisting of a monoazo metal complex, an acetylacetone metal complex, a salicylic acid metal complex, an alkylsalicylic acid metal complex, dialkylsalicylic acid metal complex, an oxynaphthoic acid metal complex, a polycarboxylic acid metal complex, and a carboxylic acid metal salt.

56. The developer according to claim 51, wherein the organic metal compound is an organic metal compound comprising a coordination or/and a bonding of a metal comprising aluminum or zirconium with an aromatic compound selected from the group consisting of aromatic diols, aromatic hydroxycarboxylic acids, aromatic monocarboxylic acids, and aromatic polycarboxylic acids.

57. The developer according to claim 32, wherein the binder resin has an acid value of 2–20 mgKOH/g.

58. The developer according to claim 32, wherein the toner is a color toner comprising a dye or a pigment as the colorant.

59. The developer according to claim 32, wherein the toner is a cyan toner containing a cyan colorant adapted to form a full-color image by a combination of at least the cyan toner, a magenta toner, a yellow toner and a black toner.

60. The developer according to claim 32, wherein the toner is a magenta toner containing a magenta colorant adapted to form a full-color image by a combination of a cyan toner, the magenta toner, a yellow toner and a black toner.

61. The developer according to claim 32, wherein the toner is a yellow toner containing a yellow colorant adapted to form a full-color image by a combination of at least a cyan toner, a magenta toner, the yellow toner and a black toner.

62. The developer according to claim 32, wherein the toner is a black toner containing a black colorant adapted to form a full-color image by a combination of a cyan toner, a magenta toner, a yellow toner and the black toner.

63. The developer according to claim 32, wherein the carrier comprises magnetic carrier particles.

64. The developer according to claim 63, wherein the carrier comprises a resin-coated carrier comprising a magnetic carrier core and a resinous coating layer coating the surface of the magnetic carrier core.

65. A heat fixing method, comprising the steps of:

forming a toner image on a recording material, and fixing the toner image onto the recording material by causing a fixing member to contact the surface of the toner image formed on the recording material while applying heat and pressure to the toner image, wherein the fixing member supplies a silicone oil to a fixing surface of the toner image in an amount of $0–1\times10^{-7}$ g/cm$^2$ per unit are of the recording material in the fixing step; and the toner comprises at least a binder resin, a colorant and a wax, the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

66. The heat fixing method according to claim 65, wherein in the fixing step, the fixing member does not supply the silicone oil.

67. The heat fixing method according to claim 65, wherein the toner contains a THF-insoluble content of 0–15.0 wt. % based on a weight of an entire resinous component of the toner.

68. The heat fixing method according to claim 66, wherein the toner contains a THF-insoluble content of 1–10.0 wt. % based on a weight of an entire resinous component of the toner.

69. The heat fixing method according to claim 65, wherein the THF-soluble content exhibits a molecular weight distribution according to GPC chromatogram providing a ratio (Mw/Mn) of 105–2,000.

70. The heat fixing method according to claim 65, wherein the THF-soluble content exhibits a molecular weight distribution according to GPC chromatogram including a content (M1) of a component having molecular weights of at most $1\times10^4$ of 35–55%, a content (M2) of a component having molecular weights above $1\times10^4$ and at most $5\times10^4$ of 30–45%, a content (M3) of a component having molecular weights above $5\times10^4$ and at most $5\times10^5$ of 8–20%, and a content (M4) of a component having molecular weights above $5\times10^5$ of 2–12%, said contents M1, M2, M3 and M4 satisfying the following relationships:

$75\% \leqq M1+M2 \leqq 90\%$, and $M1>M2>M3>M4$.

71. The heat fixing method according to claim 65, wherein said viscoelastic characteristic includes a ratio ($\tan \delta_{170}/\tan \delta_{150}$) of 1.15–1.4.

72. The heat fixing method according to claim 65, wherein said viscoelastic characteristic includes a temperature giving a loss modulus G" of $1\times10^4$ Pa of 110–130° C.

73. The heat fixing method according to claim 65, wherein said viscoelastic characteristic includes a temperature giving a loss modulus G" of $3\times10^4$ Pa of 95–110° C.

74. The heat fixing method according to claim 65, wherein said viscoelastic characteristic includes a tan δ (G"/G') when $G'=1\times10^4$–$3\times10^4$ Pa of 0.7–1.5.

75. The heat fixing method according to claim 65, wherein said viscoelastic characteristic includes a tan δ (G"/G') when $G''=3\times10^4$ Pa and a tan δ (G"/G') when $G''=1\times10^4$ Pa providing a difference therebetween of below 0.4 as an absolute value.

76. The heat fixing method according to claim 65, wherein the toner has a maximum heat-absorption peak of 60–125° C. as measured by DSC.

77. The heat fixing method according to claim 65, wherein the toner has a maximum heat-absorption peak of 60–120° C. as measured by DSC.

78. The heat fixing method according to claim 65, wherein the wax has a viscosity of 5–200 mPa.s at a temperature giving a loss modulus G" of $1\times10^4$ Pa as measured at an angular frequency of 6.28 rad/sec.

79. The heat fixing method according to claim 65, wherein the wax exhibits a molecular weight distribution according to GPC chromatogram providing a ratio (Mw/Mn) of 1.0–2.0.

80. The heat fixing method according to claim 79, wherein said Mn is 200–2,000 and said Mw is 200–2,500.

81. The heat fixing method according to claim 65, wherein the wax comprises a hydrocarbon wax.

82. The heat fixing method according to claim 65, wherein the wax comprises a polyethylene wax.

83. The heat fixing method according to claim 65, wherein the toner contains the wax in an amount of 0.3–5.0 wt. %.

84. The heat fixing method according to claim 65, wherein the toner contains the wax in an amount of 0.5–5.0 wt. %.

85. The heat fixing method according to claim 65, wherein the toner contains an organic metal compound.

86. The heat fixing method according to claim 65, wherein the binder resin comprises a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5 \leqq A \leqq 10$, $5 \leqq B \leqq 30$, and $2 \leqq B/A \leqq 10$.

87. The heat fixing method according to claim 65, wherein the toner contains C mol. % of an organic metal compound and, as the binder resin, a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5 \leqq A \leqq 10$, $5 \leqq B \leqq 30$, $2 \leqq B/A \leqq 10$, $0.2 \leqq C \leqq 10$, and $2 \leqq A\times C \leqq 50$.

88. The heat fixing method according to claim 87, wherein said saturated or unsaturated aliphatic hydrocarbon group having 5–30 carbon atoms is incorporated into a polyester resin skeleton as a branched chain.

89. The heat fixing method according to claim 85, wherein the organic metal compound is a metal compound selected from the group consisting of a monoazo metal complex, an acetylacetone metal complex, a salicylic acid metal complex, an alkylsalicylic acid metal complex, dialkylsalicylic acid metal complex, an oxynaphthoic acid metal complex, a polycarboxylic acid metal complex, and a carboxylic acid metal salt.

90. The heat fixing method according to claim 85, wherein the organic metal compound is an organic metal compound comprising a coordination or/and a bonding of a metal comprising aluminum or zirconium with an aromatic compound selected from the group consisting of aromatic diols, aromatic hydroxycarboxylic acids, aromatic monocarboxylic acids, and aromatic polycarboxylic acids.

91. The heat fixing method according to claim 65, herein the binder resin has an acid value of 2–20 mgKOH/g.

92. The heat fixing method according to claim 65, wherein the toner is a color toner comprising a dye or a pigment as the colorant.

93. The heat fixing method according to claim 65, wherein the toner image comprises a multi-color toner image formed by a combination of a cyan toner, a magenta toner, a yellow toner and a black toner, and the multi-color toner image is formed on the recording material by using the toner comprising at least one species of a color toner selected from the group consisting of the cyan toner, the magenta toner, the yellow toner and the black toner.

94. The heat fixing method according to claim 93, wherein the color toner comprises a cyan toner containing a cyan colorant.

95. The heat fixing method according to claim 93, wherein the color toner comprises a magenta toner containing a magenta colorant.

96. The heat fixing method according to claim 93, wherein the color toner comprises a yellow toner containing a yellow colorant.

97. The heat fixing method according to claim 93, wherein the color toner comprises a black toner containing a black colorant.

98. The image forming method, comprising the steps of:

charging an electrostatic latent image-bearing member, forming an electrostatic latent image on the charged latent image-bearing member, developing the electrostatic latent image with a toner to form a toner image, transferring the developed toner image onto a recording material via or without via an intermediate transfer member, and fixing the toner image onto the recording material by causing a fixing member to contact the surface of the toner image formed on the recording material while applying heat and pressure to the toner image, wherein the fixing member supplies a silicone oil to a fixing surface of the toner image in an amount of $0–1\times10^{-7}$ g/cm$^2$ per unit are of the recording material in the fixing step; and the toner comprises at least a binder resin, a colorant and a wax, the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

99. The image forming method according to claim 98, wherein in the fixing step, the fixing member does not supply the silicone oil.

100. The image forming method according to claim 98, wherein the toner contains a THF-insoluble content of 0–15.0 wt. % based on a weight of an entire resinous component of the toner.

101. The image forming method according to claim 98, wherein the toner contains a THF-insoluble content of 1–10.0 wt. % based on a weight of an entire resinous component of the toner.

102. The image forming method according to claim 98, wherein the THF-soluble content exhibits a molecular weight distribution according to GPC chromatogram providing a ratio (Mw/Mn) of 105–2,000.

103. The image forming method according to claim 98, wherein the THF-soluble content exhibits a molecular weight distribution according to GPC chromatogram including a content (M1) of a component having molecular weights of at most $1\times10^4$ of 35–55%, a content (M2) of a component having molecular weights above $1\times10^4$ and at most $5\times10^4$ of 30–45%, a content (M3) of a component having molecular weights above $5\times10^4$ and at most $5\times10^5$ of 8–20%, and a content (M4) of a component having molecular weights above $5\times10^5$ of 2–12%, said contents M1, M2, M3 and M4 satisfying the following relationships:

$75\% \leqq M1+M2 \leqq 90\%$, and $M1>M2>M3>M4$.

104. The image forming method according to claim 98, wherein said viscoelastic characteristic includes a ratio (tan $\delta_{170}$/tan $\delta_{150}$) of 1.15–1.4.

105. The image forming method according to claim 98, wherein said viscoelastic characteristic includes a temperature giving a loss modulus G" of $1\times10^4$ Pa of 110–130° C.

106. The image forming method according to claim 98, wherein said viscoelastic characteristic includes a temperature giving a loss modulus G" of $3\times10^4$ Pa of 95–110° C.

107. The image forming method according to claim 98, wherein said viscoelastic characteristic includes a tan δ (G"/G') when G"=$1\times10^4$–$3\times10^4$ Pa of 0.7–1.5.

108. The image forming method according to claim 98, wherein said viscoelastic characteristic includes a tan δ (G"/G') when G"=$3\times10^4$ Pa and a tan δ (G'/G') when G"=$1\times10^4$ Pa providing a difference therebetween of below 0.4 as an absolute value.

109. The image forming method according to claim 98, wherein the toner has a maximum heat-absorption peak of 60–125° C. as measured by DSC.

110. The image forming method according to claim 98, wherein the toner has a maximum heat-absorption peak of 60–120° C. as measured by DSC.

111. The image forming method according to claim 98, wherein the wax has a viscosity of 5–200 mPa.s at a temperature giving a loss modulus G" of $1\times10^4$ Pa as measured at an angular frequency of 6.28 rad/sec.

112. The image forming method according to claim 98, wherein the wax exhibits a molecular weight distribution according to GPC chromatogram providing a ratio (Mw/Mn) of 1.0–2.0.

113. The image forming method according to claim 112, wherein said Mn is 200–2,000 and said Mw is 200–2,500.

114. The image forming method according to claim 98, wherein the wax comprises a hydrocarbon wax.

115. The image forming method according to claim 98, wherein the wax comprises a polyethylene wax.

116. The image forming method according to claim 98, wherein the toner contains the wax in an amount of 0.3–5.0 wt. %.

117. The image forming method according to claim 98, wherein the toner contains the wax in an amount of 0.5–5.0 wt. %.

118. The image forming method according to claim 98, wherein the toner contains an organic metal compound.

119. The image forming method according to claim 98, wherein the binder resin comprises a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5 \leqq A \leqq 10$, $5 \leqq B \leqq 30$, and $2 \leqq B/A \leqq 10$.

120. The image forming method according to claim 98, wherein the toner contains C mol. % of an organic metal compound and, as the binder resin, a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5 \leqq A \leqq 10$, $5 \leqq B \leqq 30$, $2 \leqq B/A \leqq 10$, $0.2 \leqq C \leqq 10$, and $2 \leqq A \times C \leqq 50$.

121. The image forming method according to claim 119, wherein said saturated or unsaturated aliphatic hydrocarbon group having 5–30 carbon atoms is incorporated into a polyester resin skeleton as a branched chain.

122. The image forming method according to claim 118, wherein the organic metal compound is a metal compound selected from the group consisting of a monoazo metal complex, an acetylacetone metal complex, a salicylic acid metal complex, an alkylsalicylic acid metal complex, dialkylsalicylic acid metal complex, an oxynaphthoic acid metal complex, a polycarboxylic acid metal complex, and a carboxylic acid metal salt.

123. The image forming method according to claim 118, wherein the organic metal compound is an organic metal compound comprising a coordination or/and a bonding of a metal comprising aluminum or zirconium with an aromatic compound selected from the group consisting of aromatic diols, aromatic hydroxycarboxylic acids, aromatic monocarboxylic acids, and aromatic polycarboxylic acids.

124. The image forming method according to claim 98, wherein the binder resin has an acid value of 2–20 mgKOH/g.

125. The image forming method according to claim 98, wherein the toner is a color toner comprising a dye or a pigment as the colorant.

126. The image forming method according to claim 125, wherein the image forming method comprises:

a first charging step of charging an electrostatic latent image-bearing member, a first latent image-forming step of forming an electrostatic latent image on the charged latent image-bearing member, a first developing step of developing the electrostatic latent image with a first toner to form a first toner image, a first transfer step of transferring the first toner image onto an intermediate transfer member, a second charging step of charging an electrostatic latent image-bearing member, a second latent image-forming step of forming an electrostatic latent image on the charged latent image-bearing member, a second developing step of developing the electrostatic latent image with a second toner to form second toner image, a second transfer step of transferring the second toner image onto the intermediate transfer member carrying the first toner image, a third charging step of charging an electrostatic latent image-bearing member, a third latent image-forming step of forming an electrostatic latent image on the charged latent image-bearing member, a third developing step of developing the electrostatic latent image with a third toner to form a third toner image, a third transfer step of transferring the third toner image onto the intermediate transfer member carrying the first and second toner images, a fourth charging step of charging an electrostatic latent image-bearing member, a fourth latent image-forming step of forming an electrostatic latent image on the charged latent image-bearing member, a fourth developing step of developing the electrostatic latent image with a fourth toner to form a fourth toner image, a fourth transfer step of transferring the fourth toner image onto the intermediate transfer member carrying the first, second and third toner images to form a multi-color toner image, a concurrent transfer step of transferring the multi-color toner image comprising the first to fourth toner images onto a recording material at the same time, and a fixing step of fixing the multi-color toner image on the recording material by causing a fixing member to contact the surface of the multi-color toner image while applying heat and pressure to the multi-color toner image to form a full-color image; wherein the first toner is a color toner selected from the group consisting of a cyan toner, a magenta toner, a yellow toner, and a black toner, the second toner is a color toner selected from the group consisting of the cyan, magenta, yellow and black toners except for that for the first toner, the third toner is a color toner selected from the group consisting of the cyan, magenta, yellow and black toners except for those for the first and second toners, and the fourth toner is a color toner selected from the group consisting of the cyan, magenta, yellow and black toners except for those for the first, second and third toners.

127. The image forming method according to claim 125, wherein the image forming method comprises:

a first charging step of charging an electrostatic latent image-bearing member, a first latent image-forming step of forming an electrostatic latent image on the charged latent image-bearing member, a first developing step of developing the electrostatic latent image with a first toner to form a first toner image, a first transfer step of transferring the first toner image onto a recording material, a second charging step of charging an electrostatic latent image-bearing member, a second latent image-forming step of forming an electrostatic latent image on the charged latent image-bearing member, a second developing step of developing the electrostatic latent image with a second toner to form a second toner image, a second transfer step of transferring the second toner image onto the recording material carrying the first toner image, a third charging step of charging an electrostatic latent image-bearing member, a third latent image-forming step of forming an electrostatic latent image on the charged latent image-bearing member, a third developing step of developing the electrostatic latent image with a third toner to form a third toner image, a third transfer step of transferring the third toner image onto the recording material carrying the first and second toner images, a fourth charging step of charging an electrostatic latent image-bearing member, a fourth latent image-forming step of forming an electrostatic latent image on the charged latent image-bearing member, a fourth developing step of developing the electrostatic latent image with a fourth toner to form a fourth toner image, a fourth transfer step of transferring the fourth toner image onto the recording material carrying the first, second and third toner images to form a multi-color toner image, and a fixing step of fixing the multi-color toner image comprising the first to fourth toner images successively transferred on the recording material by causing a fixing member to contact the surface of the multi-color toner image while applying heat and pressure to the multi-color toner image to form a full-color image; wherein the first toner is a color toner selected from the group consisting of a cyan toner, a magenta toner, a yellow toner, and a black toner, the second toner is a color toner selected from the group consisting of the cyan, magenta, yellow and black toners except for that for the first toner, the third toner is a color toner selected from the group consisting of the cyan, magenta, yellow and black toners except for those for the first and second toners, and the fourth toner is a color toner selected from the group consisting of the cyan, magenta, yellow and black toners except for those for the first, second and third toners.

128. The image forming method according to claim 98, wherein the developing step, the electrostatic latent image is developed with a developer comprising a toner held on a developer-carrying member by applying a developing bias voltage including an alternating current component to the developer-carrying member.

129. The image forming method according to claim 128, wherein the developer is a monocomponent-type non-magnetic developer comprising a non-magnetic toner.

130. The image forming method according to claim 128, wherein the developer is a monocomponent-type magnetic developer comprising a magnetic toner containing a magnetic material.

131. The image forming method according to claim 128, wherein the developer is a two-component type developer comprising a magnetic carrier and a non-magnetic toner.

132. An apparatus unit detachably mountable on a main assembly of an image forming apparatus, comprising:

a toner for developing an electrostatic latent image, a toner container for holding the toner, a toner-carrying member for holding and carrying the toner to a developing region, and a toner layer thickness-regulating member for regulating a thickness of a layer of the toner held on the toner-carrying member, wherein the toner comprises at least a binder resin, a colorant and a wax, the toner has a maximum heat-absorption peak of 60–135° C. as measured by differential scanning calorimetry (DSC);

the toner has a viscoelastic characteristic measured at an angular frequency of the toner of 6.28 rad/sec including: a temperature giving a loss molecules G" of $3\times10^4$ Pa of 90–115° C., a temperature giving a loss modulus G" of $2\times10^4$ Pa of 95–120° C., a temperature giving a loss modulus G" of $1\times10^4$ Pa of 105–135° C., a tan δ (loss modulus G"/storage modulus G') when G"=$1\times10^4$–$3\times10^4$ Pa of 0.6–2.0, a storage modulus at 170° C. (G' (170° C.)) of $1\times10^2$–$1\times10^4$ Pa, a loss modulus at 170° C. (G" (170° C.)) of $1\times10^2$–$1\times10^4$ Pa, and a ratio of a tan δ at 170° C. (tan $\delta_{170}$) to a tan δ at 150° C. (tan $\delta_{150}$) (tan $\delta_{170}$/tan $\delta_{150}$) of 1.05–1.6; and the toner contains a tetrahydrofuran (THF)-soluble content exhibiting a molecular weight distribution according to gel permeation chromatography (GPC) chromatogram providing a main peak in a molecular weight region of 2,000–30,000 and a ratio (Mw/Mn) of above 100 between weight-average molecular weight (Mw) and number-average molecular weight (Mn).

133. The apparatus unit according to claim 132, wherein the toner contains a THF-insoluble content of 0–15.0 wt. % based on a weight of an entire resinous component of the toner.

134. The apparatus unit according to claim 132, wherein the toner contains a THF-insoluble content of 1–10.0 wt. % based on a weight of an entire resinous component of the toner.

135. The apparatus unit according to claim 132, wherein the THF-soluble content exhibits a molecular weight distribution according to GPC chromatogram providing a ratio (Mw/Mn) of 105–2,000.

136. The apparatus unit according to claim 132, wherein the THF-soluble content exhibits a molecular weight distribution according to GPC chromatogram including a content (M1) of a component having molecular weights of at most $1\times10^4$ of 35–55%, a content (M2) of a component having molecular weights above $1\times10^4$ and at most $5\times10^4$ of 30–45%, a content (M3) of a component having molecular weights above $5\times10^4$ and at most $5\times10^5$ of 8–20%, and a content (M4) of a component having molecular weights above $5\times10^5$ of 2–12%, said contents M1, M2, M3 and M4 satisfying the following relationships:

$75\% \leqq M1+M2 \leqq 90\%$, and $M1>M2>M3>M4$.

137. The apparatus unit according to claim 132, wherein said viscoelastic characteristic includes a ratio (tan $\delta_{170}$/tan $\delta_{150}$) of 1.15–1.4.

138. The apparatus unit according to claim 132, wherein said viscoelastic characteristic includes a temperature giving a loss modulus G" of $1\times10^4$ Pa of 110–130° C.

139. The apparatus unit according to claim 132, wherein said viscoelastic characteristic includes a temperature giving a loss modulus G" of $3\times10^4$ Pa of 95–110° C.

140. The apparatus unit according to claim 132, wherein said viscoelastic characteristic includes a tan δ (G"/G') when G"=$1\times10^4$–$3\times10^4$ Pa of 0.7–1.5.

141. The apparatus unit according to claim 132, wherein said viscoelastic characteristic includes a tan δ (G"/G') when $G''=3\times10^4$ Pa and a tan δ (G"/G') when $G''=1\times10^4$ Pa providing a difference therebetween of below 0.4 as an absolute value.

142. The apparatus unit according to claim 132, wherein the toner has a maximum heat-absorption peak of 60–125° C. as measured by DSC.

143. The apparatus unit according to claim 132, wherein the toner has a maximum heat-absorption peak of 60–120° C. as measured by DSC.

144. The apparatus unit according to claim 132, wherein the wax has a viscosity of 5–200 mPa.s at a temperature giving a loss modulus G" of $1\times10^4$ Pa as measured at an angular frequency of 6.28 rad/sec.

145. The apparatus unit according to claim 132, wherein the wax exhibits a molecular weight distribution according to GPC chromatogram providing a ratio (Mw/Mn) of 1.0–2.0.

146. The apparatus unit according to claim 145, wherein said Mn is 200–2,000 and said Mw is 200–2,500.

147. The apparatus unit according to claim 132, wherein the wax comprises a hydrocarbon wax.

148. The apparatus unit according to claim 132, wherein the wax comprises a polyethylene wax.

149. The apparatus unit according to claim 132, wherein the toner contains the wax in an amount of 0.3–5.0 wt. %.

150. The apparatus unit according to claim 132, wherein the toner contains the wax in an amount of 0.5–5.0 wt. %.

151. The apparatus unit according to claim 132, wherein the toner contains an organic metal compound.

152. The apparatus unit according to claim 132, wherein the binder resin comprises a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5\leqq A\leqq 10$, $5\leqq B\leqq 30$, and $2\leqq B/A\leqq 10$.

153. The apparatus unit according to claim 132, wherein the toner contains C mol. % of an organic metal compound and, as the binder resin, a non-linear polyester resin obtained from a composition which comprises a polycarboxylic acid component and a polyhydric alcohol component, said composition comprising at least (a) A mol. % of a polycarboxylic acid component having at least three carboxyl groups and (b) B mol. % of a polycarboxylic acid component having a saturated or unsaturated aliphatic hydrocarbon group having 5–30 carbon atoms and/or a polyhydric alcohol component having a saturated or unsaturated aliphatic hydrocarbon group having 5–30 carbon atoms, satisfying the following relationships:

$0.5<A\leqq 10$, $5\leqq B\leqq 30$, $2\leqq B/A\leqq 10$, $0.2\leqq C\leqq 10$, and $2\leqq A\times C\leqq 50$.

154. The apparatus unit according to claim 152, wherein said saturated or unsaturated aliphatic hydrocarbon group having 5–30 carbon atoms is incorporated into a polyester resin skeleton as a branched chain.

155. The apparatus unit according to claim 151, wherein the organic metal compound is a metal compound selected from the group consisting of a monoazo metal complex, an acetylacetone metal complex, a salicylic acid metal complex, an alkylsalicylic acid metal complex, dialkylsalicylic acid metal complex, an oxynaphthoic acid metal complex, a polycarboxylic acid metal complex, and a carboxylic acid metal salt.

156. The apparatus unit according to claim 151, wherein the organic metal compound is an organic metal compound comprising a coordination or/and a bonding of a metal comprising aluminum or zirconium with an aromatic compound selected from the group consisting of aromatic diols, aromatic hydroxycarboxylic acids, aromatic monocarboxylic acids, and aromatic polycarboxylic acids.

157. The apparatus unit according to claim 132, wherein the binder resin has an acid value of 2–20 mgKOH/g.

158. The apparatus unit according to claim 132, wherein the toner is a color toner comprising a dye or a pigment as the colorant.

159. The apparatus unit according to claim 132, wherein the toner is a cyan toner containing a cyan colorant adapted to form a full-color image by a combination of at least the cyan toner, a magenta toner, a yellow toner and a black toner.

160. The apparatus unit according to claim 132, wherein the toner is a magenta toner containing a magenta colorant adapted to form a full-color image by a combination of a cyan toner, the magenta toner, a yellow toner and a black toner.

161. The apparatus unit according to claim 132, wherein the toner is a yellow toner containing a yellow colorant adapted to form a full-color image by a combination of at least a cyan toner, a magenta toner, the yellow toner and a black toner.

162. The apparatus unit according to claim 132, wherein the toner is a black toner containing a black colorant adapted to form a full-color image by a combination of a cyan toner, a magenta toner, a yellow toner and the black toner.

163. The apparatus unit according to claim 132, wherein the apparatus unit further comprises a latent image-bearing member.

164. The apparatus unit according to claim 163, wherein the apparatus unit further comprises a cleaning member for cleaning the surface of the latent image-bearing member.

165. The apparatus unit according to claim 163, wherein the apparatus unit further comprises a charging member for charging the latent image-bearing member.

166. The apparatus unit according to claim 163, wherein the apparatus unit further comprises a cleaning member for cleaning the surface of the latent image-bearing member and a charging member for charging the latent image-bearing member.

* * * * *

UNITED STATES PATENT AND TRADEMARK OFFICE

CERTIFICATE OF CORRECTION

PATENT NO. : 6,300,024 B1
DATED : October 9, 2001
INVENTOR(S) : Hiroshi Yusa et al.

It is certified that error appears in the above-identified patent and that said Letters Patent is hereby corrected as shown below:

Title page,
Item [57], ABSTRACT, line 7, "molecules G"" should read -- modulus G" --.

Column 2,
Line 17, "an" should read -- a --; and
Line 39, "case." should read -- cases. --.

Column 11,
Line 41, "i" should be deleted.

Column 12,
Line 3, "resulting" should read -- resulting in --;
Line 25, "glass" should read -- gloss --; and
Line 31, "enlarged" should read -- enlarge --.

Column 19,
Line 41, "group)," should read -- group, --; and
Lines 61-65, " 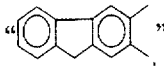 " should read -- 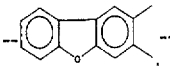 --.

Column 20,
Line 50, "fir," should read -- firm, --;
Line 56, "improve" should read -- improves --; and
Line 61, "further toner" should be deleted.

Column 22,
Line 41, "in" should read -- an --; and
Line 43, "thee" should read -- the --.

Column 23,
Line 12, "to b" should read -- to be --.

Column 25,
Line 62, "he" should read -- the --.

Column 26,
Line 27, "above" should read -- above --.

UNITED STATES PATENT AND TRADEMARK OFFICE

CERTIFICATE OF CORRECTION

PATENT NO. : 6,300,024 B1
DATED : October 9, 2001
INVENTOR(S) : Hiroshi Yusa et al.

It is certified that error appears in the above-identified patent and that said Letters Patent is hereby corrected as shown below:

Column 30,
Line 40, "fogs." should read -- fog. --.

Column 32,
Line 48, "It is" should read -- One can --.

Column 35,
Line 12, "addition" should read -- addition of --.

Column 36,
Line 6, "layer o" should read -- layer to --.

Column 37,
Line 12, "PAMATER"," should read -- pAMATER", --;
Line 17, "injecting" should read -- inject --; and
Line 39, "effected y" should read -- effected by --.

Column 38,
Line 2, "ia" should read -- a --.

Column 39,
Line 30, "means i" should read -- means in --; and
Line 45, "forcely" should read -- forcibly --.

Column 41,
Line 62, "ia" should read -- in --.

Column 42,
Line 29, "be" should read -- to be --.

Column 44,
Line 42, "image" should read -- an image --.

Column 45,
Line 3, "follows" should read -- follow --; and
Line 17, "priate" should read -- priately --.

Column 46,
Line 49, "developer. in" should read -- developer. ¶ In --.

UNITED STATES PATENT AND TRADEMARK OFFICE

CERTIFICATE OF CORRECTION

PATENT NO. : 6,300,024 B1
DATED : October 9, 2001
INVENTOR(S) : Hiroshi Yusa et al.

It is certified that error appears in the above-identified patent and that said Letters Patent is hereby corrected as shown below:

Column 47,
Line 54, "a" (first occurrence) should read -- an --.

Column 48,
Line 20, "difference" should read -- different --.

Column 50,
Line 20, "ai" should read -- a --.

Column 51,
Line 47, "deices" should read -- devices --.

Column 52,
Line 12, "transferring" should read -- transfer --; and
Line 58, "a" (second occurrence) should be deleted.

Column 57,
Lines 8 and 21, "Two-component" should read -- two-component --.

Column 64,
Line 10, ""Color" should read -- ("Color --.

Column 67,
Table 9, "THF-insulable" should read -- THF-insoluble --; and
Table 10, "occurred" should read -- occurrence --.

Column 69,
Line 27, "molecules G"" should read -- modulus G" --.

Column 71,
Line 53, "molecules G"" should read -- modulus G" --.

Column 74,
Line 23, "are" should read -- area --; and
Line 32, "molecules G"" should read -- modulus G" --.

UNITED STATES PATENT AND TRADEMARK OFFICE

CERTIFICATE OF CORRECTION

PATENT NO. : 6,300,024 B1
DATED : October 9, 2001
INVENTOR(S) : Hiroshi Yusa et al.

It is certified that error appears in the above-identified patent and that said Letters Patent is hereby corrected as shown below:

Column 75,
Line 23, "G'=1x$10^4$-3x$10^4$ Pa" should read -- G"=1x$10^4$-3x$10^4$ Pa --.

Column 77,
Line 1, "The" should read -- An --;
Line 17, "are" should read -- area --; and
Line 26, "molecules G"" should read -- modulus G" --.

Column 78,
Line 19, "tan δ (G'/G')" should read -- tan δ (G"/G') --.

Column 81,
Line 46, "wherein" should read -- wherein in --.

Column 82,
Line 11, "molecules G"" should read -- modulus G" --.

Signed and Sealed this

Second Day of April, 2002

*Attest:*

*Attesting Officer*

JAMES E. ROGAN
*Director of the United States Patent and Trademark Office*